US010046571B2

(12) United States Patent
Totsuka et al.

(10) Patent No.: US 10,046,571 B2
(45) Date of Patent: Aug. 14, 2018

(54) IMAGE PROCESSING APPARATUS, IMAGE PROCESSING METHOD, AND STORAGE MEDIUM

(71) Applicant: CANON KABUSHIKI KAISHA, Tokyo (JP)

(72) Inventors: Atsushi Totsuka, Kawasaki (JP); Hiromitsu Nishikawa, Tokyo (JP); Kimitaka Arai, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/559,558

(22) PCT Filed: May 20, 2016

(86) PCT No.: PCT/JP2016/002479
§ 371 (c)(1),
(2) Date: Sep. 19, 2017

(87) PCT Pub. No.: WO2016/189847
PCT Pub. Date: Dec. 1, 2016

(65) Prior Publication Data

US 2018/0043700 A1 Feb. 15, 2018

(30) Foreign Application Priority Data

May 22, 2015 (JP) ..... 2015-104459
Apr. 26, 2016 (JP) ..... 2016-088486

(51) Int. Cl.
*B41J 2/21* (2006.01)
*B41M 5/52* (2006.01)
(Continued)

(52) U.S. Cl.
CPC ..... *B41J 2/211* (2013.01); *B41J 2/04* (2013.01); *B41J 2/525* (2013.01); *B41M 5/52* (2013.01)

(58) Field of Classification Search
CPC ..... B41J 2/21; B41J 2/2107; B41J 2/04; B41J 2/211; B41J 2/52; G06F 3/12;
(Continued)

(56) References Cited

U.S. PATENT DOCUMENTS 8,807,698 B2 8/2014 Seki et al.
2013/0100188 A1 4/2013 Kagata
(Continued)

FOREIGN PATENT DOCUMENTS

JP 2012-051211 A 3/2012
JP 2013-134410 A 7/2013

OTHER PUBLICATIONS

International Search Report dated Aug. 2, 2016, issued in PCT/JP2016/002479.

*Primary Examiner* — Jannelle M Lebron
(74) *Attorney, Agent, or Firm* — Fitzpatrick, Cella, Harper & Scinto

(57) ABSTRACT

An image processing apparatus in an embodiment is an image processing apparatus for forming structures on a print medium, the structures being configured to express such a characteristic that sparkle points change in position with change in angle of observation. The image processing apparatus in this embodiment includes a generation unit configured to generate arrangement data based on information on a characteristic of sparkle points, the arrangement data specifying arrangement of the structures of two or more types that are capable of being formed on the print medium and at least include one or more first structure associated with a first inclination angle and one or more second structures associated with a second inclination angle different from the first inclination angle.

25 Claims, 44 Drawing Sheets

(51) Int. Cl.
*B41J 2/04* (2006.01)
*B41J 2/525* (2006.01)

(58) Field of Classification Search
CPC ..... G06F 3/1205; H04N 1/52; H04N 1/54; B41M 5/52
USPC ..... 347/14, 15, 111
See application file for complete search history.

(56) References Cited

U.S. PATENT DOCUMENTS

2013/0100191 A1* 4/2013 Miyamoto ..... B41J 2/2114 347/14
2016/0267365 A1* 9/2016 Totsuka ..... H04N 1/52

* cited by examiner

801

FIG.8A

| s2 (μm²) | θ(°) | | | | | | | | | | | | | | | | | | | | | | | | |
|---|---|---|---|---|---|---|---|---|---|---|---|---|---|---|---|---|---|---|---|---|---|---|---|---|---|
| 60×60 | 0 | | | | | | 14.0 | | | | | | 26.6 | | | | | | 36.9 | | | | | | 45.0 |
| 90×90 | 0 | | | | 9.5 | | | | 18.4 | | | | 26.6 | | | | 33.7 | | | | 39.8 | | | | 45.0 |
| 120×120 | 0 | | 7.1 | | | | 14.0 | | | | 20.6 | | 26.6 | | 32.0 | | | | 36.9 | | | | 41.2 | | 45.0 |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| 210×210 | 0 | 4.0 | | 8.1 | | 12.1 | | 15.9 | | 19.7 | | 23.2 | 26.6 | 29.7 | | 32.7 | | 35.5 | | 38.2 | | 40.6 | | 42.9 | 45.0 |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |

802

FIG.8B

| θ(°) / s2 (μm²) | 0 | ··· | 7.1 | ··· | 9.5 | ··· | 14.0 | ··· | 18.4 | ··· | 20.6 | ··· | 26.6 | ··· | 32.0 | ··· | 33.7 | ··· | 36.9 | ··· | 39.8 | ··· | 41.2 | ··· | 45.0 |
|---|---|---|---|---|---|---|---|---|---|---|---|---|---|---|---|---|---|---|---|---|---|---|---|---|---|
| 60×60 | 4% | | | | | | 12% | | | | | | 20% | | | | | | 28% | | | | | | 36% |
| 90×90 | 4% | | | | 7% | | | | 11% | | | | 14% | | | | 18% | | | | 21% | | | | 25% |
| 120×120 | 4% | | 4% | | | | 7% | | | | 9% | | 11% | | 13% | | | | 16% | | | | 18% | | 20% |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |

2701

| PRINT MEDIUM MATERIAL | AMOUNT OF REFLECTED LIGHT PER UNIT AREA(1/mm$^2$) |
|---|---|
| GLOSSY PAPER 1 | 20 |
| GLOSSY PAPER 2 | 21 |
| ⋮ | ⋮ |
| SILVER FILM | 300 |

FIG.31

| DIRECTION / INCLINATION ANGLE | 1 | 2 | ... | W |
|---|---|---|---|---|
| 1 | 1<br>⋮<br>$N_{\theta 1}$ | $N_{\theta D}+1$<br>⋮<br>$N_{\theta D}+N_{\theta 1}$ | ... | $(W-1)N_{\theta D}+1$<br>⋮<br>$(W-1)N_{\theta D}+N_{\theta 1}$ |
| 2 | $N_{\theta 1}+1$<br>⋮<br>$N_{\theta 1}+N_{\theta 2}$ | $N_{\theta D}+N_{\theta 1}+1$<br>⋮<br>$N_{\theta D}+N_{\theta 1}+N_{\theta 2}$ | ... | $(W-1)N_{\theta D}+N_{\theta 1}+1$<br>⋮<br>$(W-1)N_{\theta D}+N_{\theta 1}+N_{\theta 2}$ |
| ... | ... | ... | ... | ... |
| D | $N_{\theta D-1}+1$<br>⋮<br>$N_{\theta D-1}+N_{\theta D}$ | $N_{\theta D}+N_{\theta D-1}+1$<br>⋮<br>$N_{\theta D}+N_{\theta D-1}+N_{\theta D}$ | ... | $(W-1)N_{\theta D}+N_{\theta D-1}+1$<br>⋮<br>$WN_{\theta D}+N_{\theta D-1}$ |

FIG.38A

| DIRECTION / INCLINATION ANGLE | DIRECTION 1 ↑ | DIRECTION 2 ↗ | ... | DIRECTION 8 ↖ |
|---|---|---|---|---|
| 0 | 1 | 26 | ... | 176 |
| 14.0 | 2<br>⋮<br>4 | 27<br>⋮<br>29 | ... | 177<br>⋮<br>179 |
| 26.6 | 5<br>⋮<br>9 | 30<br>⋮<br>34 | ... | 180<br>⋮<br>184 |
| 36.9 | 10<br>⋮<br>16 | 35<br>⋮<br>41 | ... | 185<br>⋮<br>191 |
| 45 | 17<br>⋮<br>25 | 42<br>⋮<br>50 | ... | 192<br>⋮<br>200 |

FIG.38B

| DIRECTION / INCLINATION ANGLE | 1 | 2 | ... | W |
|---|---|---|---|---|
| 1 | 1<br>⋮<br>$N_{\theta 1}$ | 1<br>⋮<br>$N_{\theta 1}$ | ... | 1<br>⋮<br>$N_{\theta 1}$ |
| 2 | $N_{\theta 1}+1$<br>⋮<br>$N_{\theta 1}+N_{\theta 2}$ | $N_{\theta 1}+1$<br>⋮<br>$N_{\theta 1}+N_{\theta 2}$ | ... | $N_{\theta 1}+1$<br>⋮<br>$N_{\theta 1}+N_{\theta 2}$ |
| ... | ... | ... | ... | ... |
| D | $N_{\theta D-1}+1$<br>⋮<br>$N_{\theta D-1}+N_{\theta D}$ | $N_{\theta D-1}+1$<br>⋮<br>$N_{\theta D-1}+N_{\theta D}$ | ... | $N_{\theta D-1}+1$<br>⋮<br>$N_{\theta D-1}+N_{\theta D}$ |

FIG.42A

| DIRECTION / INCLINATION ANGLE | DIRECTION 1 ↑ | DIRECTION 2 ↗ | ... | DIRECTION 8 ↖ |
|---|---|---|---|---|
| 0 | 1 | 1 | ... | 1 |
| 14.0 | 2<br>⋮<br>4 | 2<br>⋮<br>4 | ... | 2<br>⋮<br>4 |
| 26.6 | 5<br>⋮<br>9 | 5<br>⋮<br>9 | ... | 5<br>⋮<br>9 |
| 36.9 | 10<br>⋮<br>16 | 10<br>⋮<br>16 | ... | 10<br>⋮<br>16 |
| 45 | 17<br>⋮<br>25 | 17<br>⋮<br>25 | ... | 17<br>⋮<br>25 |

FIG.42B

4002

| DIRECTION / INCLINATION ANGLE | DIRECTION 1 ↑ | DIRECTION 2 ↗ | ... | DIRECTION 8 ↖ | STRUCTURE |
|---|---|---|---|---|---|
| 0 | ○ | × | ... | × | |
| | × | ○ | ... | × | |
| | ○ | ○ | ... | × | |
| ... | ... | ... | ... | ... | ... |
| D | ○ | ○ | ... | ○ | |
| ... | ... | ... | ... | ... | ... |

FIG.43

IMAGE PROCESSING APPARATUS, IMAGE PROCESSING METHOD, AND STORAGE MEDIUM

TECHNICAL FIELD

The present invention relates to an image processing apparatus, an image processing method, and a non-transitory computer readable storage medium storing a program for forming structures on a print medium, the structures being configured to artificially express a metallic texture.

BACKGROUND ART

There has been a demand for a technique to artificially express metallic textures to be used for packages, catalogs, and samples of precious metal products and the like. A texture called a sense of sparkle is one of such metallic textures. The sense of sparkle is feeling induced when microscopic sparkle points less than 1 mm on each side and present on the surface of a metallic object change in position, size, number, and the like with change in illumination angle or observation angle. A person observing such a metallic object can visually recognize a texture peculiar to the sense of sparkle such as a glittering texture or a grainy texture when the sparkle points present on the surface of the object change in position, size, number, and the like with change in illumination angle or observation angle.

In order to form an image expressing the sense of sparkle as described above, a record apparatus described in Patent Literature 1 forms an image on which regions differing in glossiness are arranged in a checkered pattern. By arranging the regions differing in glossiness in the checkered pattern, regions with high glossiness and regions with low glossiness sit next to each other. Thus, an image exhibiting a design effect resembling the sense of sparkle can be obtained (Patent Literature 1).

CITATION LIST

Patent Literature

[PTL 1]
Japanese Patent Application Laid-Open No. 2012-051211

SUMMARY OF INVENTION

Technical Problem

The record apparatus described in Patent Literature 1 forms an image on which regions differing in glossiness are arranged in a checkered pattern. Here, regions with high glossiness (hereinafter, referred to as "high-glossiness regions") are visually recognized as sparkle points. However, on the print product outputted from this record apparatus, the positions of the high-glossiness regions do not change and thus are fixed even when the illumination angle or the observation angle is changed. For this reason, the print product cannot express a texture peculiar to the sense of sparkle such as a glittering texture or a grainy texture, which the object expresses by changing the positions and number of the sparkle points present on the surface of the object with change in illumination angle or observation angle.

The present invention has been made in view of the above problem, and an object thereof is to provide an image processing apparatus, an image processing method, and a program for forming structures for artificially expressing the sense of sparkle.

Solution to Problem

An image processing apparatus of the present invention is an image processing apparatus for forming structures on a print medium, the structures being configured to express such a characteristic that sparkle points change in position with change in angle of observation, the image processing apparatus including a generation unit configured to generate arrangement data based on information on a characteristic of sparkle points, the arrangement data specifying arrangement of the structures of two or more types that are capable of being formed on the print medium and at least include one or more first structures associated with a first inclination angle and one or more second structures associated with a second inclination angle different from the first inclination angle.

Advantageous Effects of Invention

Further features of the present invention will become apparent from the following description of exemplary embodiments (with reference to the attached drawings).

BRIEF DESCRIPTION OF DRAWINGS

FIG. 8A is a diagram showing an example of a structure characteristic table in Embodiment 1;

FIG. 8B is a diagram showing an example of a structure number table in Embodiment 1;

FIG. 31 is a diagram showing an example of a reflected-light-amount table in Embodiment 8;

FIG. 38A is a schematic diagram of numbers allocated to structures in Embodiment 9;

FIG. 38B is a specific example of numbers allocated to structures in Embodiment 9;

FIG. 42A is a schematic diagram of numbers allocated to structures in Embodiment 10;

FIG. 42B is a specific example of numbers allocated to structures in Embodiment 10;

FIG. 43 is a diagram showing an example of a structure reference table in Embodiment 10.

DESCRIPTION OF EMBODIMENTS

Embodiments of the present invention will be described below with reference to the drawings. It is to be noted that constituent components described in these embodiments are mere examples, and are not intended to limit the scope of the present invention.

Figures 1A, 1B, 1C:
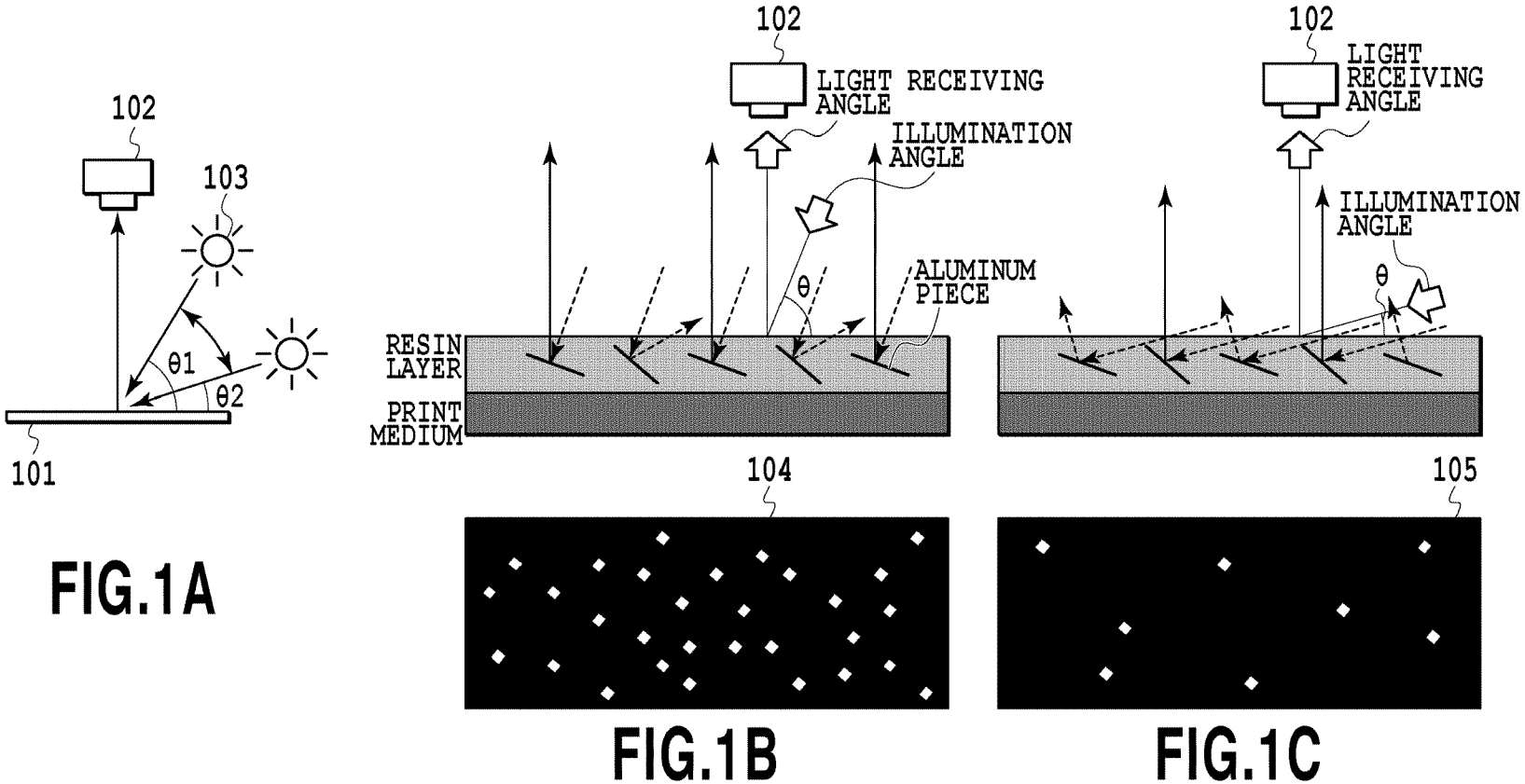
FIG. 1A is a schematic diagram showing a condition in which a sample having the sense of sparkle is observed.
FIG. 1B is diagram showing details of how the sample is observed in FIG. 1A.
FIG. 1C is diagram showing details of how the sample is observed in FIG. 1A.

First, the sense of sparkle to be reproduced in the following embodiments will be described with reference to schematic diagrams in FIG. 1A to FIG. 1C. FIG. 1A is a schematic diagram showing a condition in which a sample 101 as a target object having the sense of sparkle is observed. In FIG. 1A, the position of an observation unit 102 constructed of an imaging apparatus or the like is fixed such that the observation unit 102 faces the sample 101 in a normal direction thereto, for example. FIG. 1B and FIG. 1C are diagrams showing details of how the sample is observed in FIG. 1A. A target object obtained by laminating a resin ink containing aluminum pieces onto a print medium is shown as an example of the sample 101 in FIG. 1B and FIG. 1C. The aluminum pieces contained in the sample 101 are made in such a way as to specularly reflect light applied thereto at a predetermined illumination angle θ.

In a case where an illumination 103 illuminates the sample 101 at an illumination angle θ1, the observation unit 102 observes a captured image 104 containing sparkle points as shown in FIG. 1B. Similarly, in a case where the illumination 103 illuminates the sample 101 at an illumination angle θ2, the observation unit 102 observes a captured image 105 containing sparkle points as shown in FIG. 1C. In FIG. 1B and FIG. 1C, the white regions in the captured images 104 and 105 represents the sparkle points. As the illumination angle changes from θ1 to θ2 as shown in FIG. 1A, the sparkle points in the captured image 104 change in position to the sparkle points in the captured image 105. The sparkle points change also in area and/or number with change in illumination angle or observation angle in some cases. Feeling induced by the change in characteristic of sparkle points present on the surface of the target object with change in illumination angle or observation angle will be referred to as the sense of sparkle.

Embodiment 1

An embodiment for forming structures for artificially expressing the sense of sparkle will be described below. This embodiment focuses on the size of sparkle points on a target object, and description will be given of an example where characteristics of structures to be formed on a print medium are derived based on inputted information indicating a characteristic of the sparkle points.

(Schematic Configuration of Image Processing Apparatus)

Figure 2:
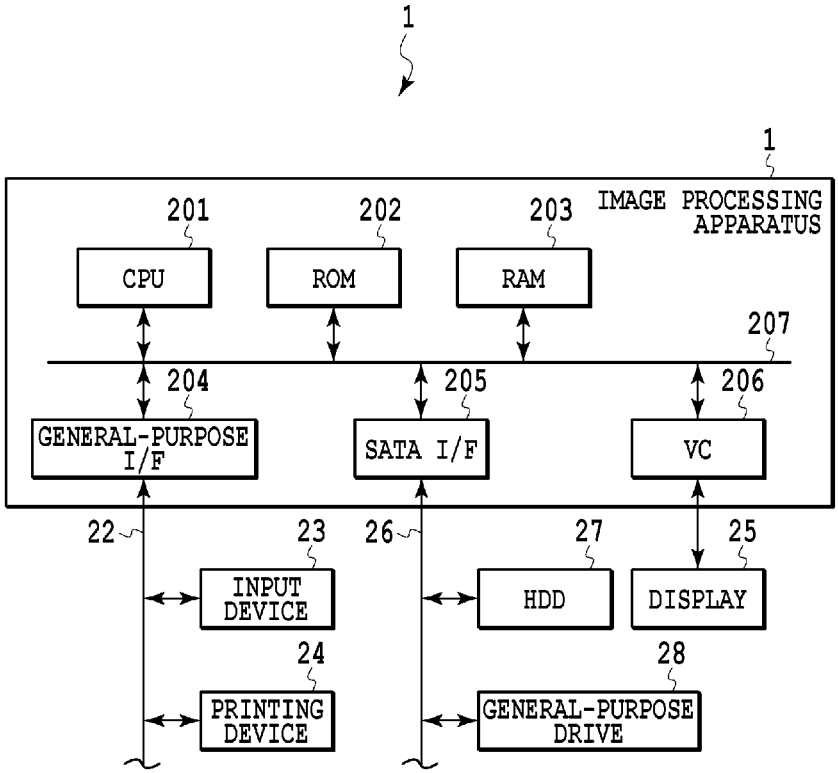
FIG. 2 is a block diagram showing the hardware configuration of an image processing apparatus in Embodiment 1.

FIG. 2 shows an example of the hardware configuration of an image processing apparatus 1 in this embodiment. The image processing apparatus 1 is constructed of a computer, for example, and a CPU 201 is configured to run an operating system (OS) and various programs stored in a ROM 202, a hard disk drive (HDD) 27, and the like by using a RAM 203 as a work memory. Also, the CPU 201 is configured to control components through a system bus 207. Note that, in processes in flowcharts to be described later, program codes stored in the ROM 202 or the HDD 27 are expanded onto the RAM 203 and executed by the CPU 201. A general-purpose interface (I/F) 204 is a serial bus interface such as a USB, for example, and an input device 23 such as a mouse and/or a keyboard, a printing device 24, and the like are connected thereto through a serial bus 22. A serial ATA (SATA) I/F 205 is a serial bus interface, and the HDD 27 and a general-purpose drive 28 for reading and writing data from and onto various types of record media are connected thereto through a serial bus 26. The CPU 201 uses the HDD 27 and various types of record media mounted in the general-purpose drive 28 as storage locations for various types of data. A video card (VC) 206 is a video interface, and a display 25 is connected thereto. The CPU 201 displays a user interface (UI) provided by a program on the display 25, and receives inputs such as user instructions received through the input device 23.

(Software Function Configuration of Image Processing Apparatus)

Figure 3:
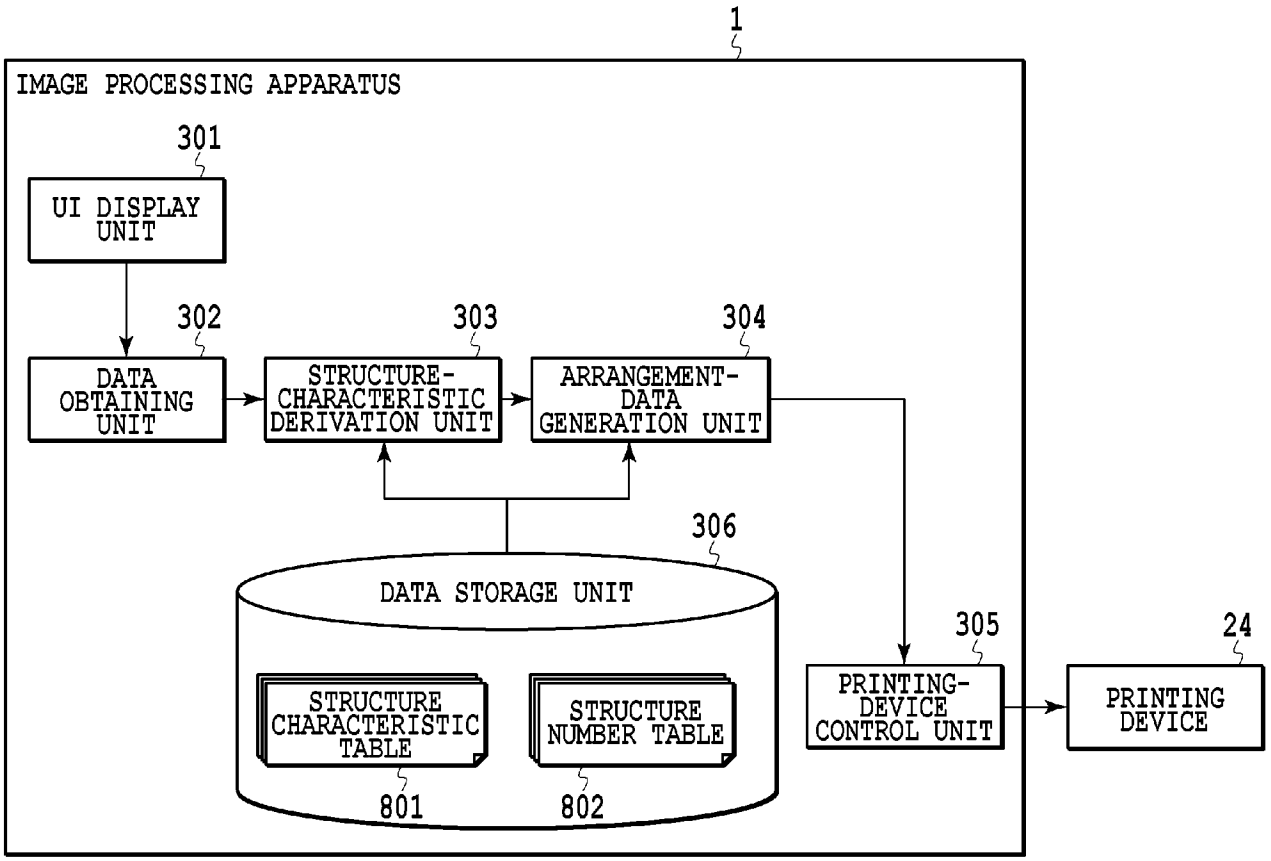
FIG. 3 is a block diagram showing the software function configuration of the image processing apparatus in Embodiment 1.

FIG. 3 is a block diagram showing the software function configuration of the image processing apparatus 1 in this embodiment. The procedure of processes performed by an image processing application in this embodiment based on instructions from the CPU 201 will be described with reference to FIG. 3. The image processing apparatus 1 includes a UI display unit 301, a data obtaining unit 302, a structure-characteristic derivation unit 303, an arrangement-data generation unit 304, a printing-device control unit 305, and a data storage unit 306 as its components for implementing the function of the image processing application. The UI display unit 301 is implemented by the display 25, and configured to display a graphical user interface (GUI) for receiving user input and the like on the display 25. The data obtaining unit 302 is configured to obtain data such as sparkle point information thus inputted. The structure-characteristic derivation unit 303 is configured to derive the characteristics of the structures based on the inputted sparkle point information. Here, the characteristics of the structures are: a structure size that can be formed on a print medium by the printing device 24; and a plurality of structure inclination angles that can be formed with that size by the printing device 24. Details will be described later with reference to FIG. 8A. The arrangement-data generation unit 304 is configured to generate structure arrangement data specifying the arrangement of the structures to be formed on the print medium. The printing-device control unit 305 is configured to determine the number of laminations at each coordinate for forming a structure based on the structure arrangement data, send that information to the printing device 24, and instruct the printing device 24 to perform image forming operation. In the data storage unit 306, information is stored in advance such as a structure characteristic table 801 that can be referred to for the structure characteristics and a structure number table 802 that can be referred to for the number of structures to be formed on the print medium.

(Operation of Image Processing Apparatus)

FIG. 4A to FIG. 4D are flowcharts showing the procedure of processes by the image processing apparatus 1 in this embodiment. Details of the procedure of the processes by the image processing apparatus 1 in this embodiment will be described below with reference to FIG. 4A to FIG. 4D. Note that, in the processes in the flowcharts shown in FIG. 4A to FIG. 4D, program codes stored in the ROM 202 are expanded onto the RAM 203 and executed by the CPU 201. The same applies to the flowcharts shown in figures subsequent to FIG. 4A to FIG. 4D. Note that reference sign S to be mentioned below means a step in the flowchart.

Figure 4A:
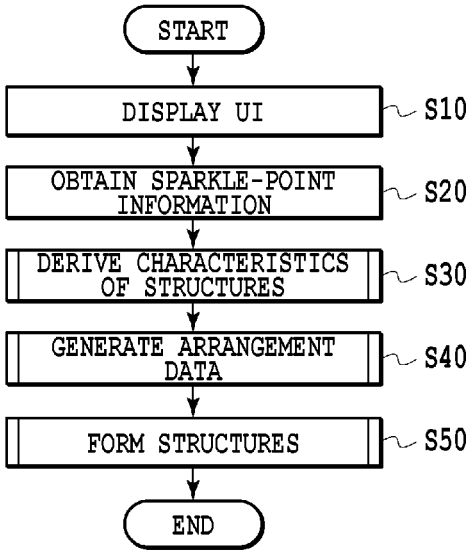
FIG. 4A is a flowchart showing the procedure of processes by the image processing apparatus in Embodiment 1.
Figure 5:
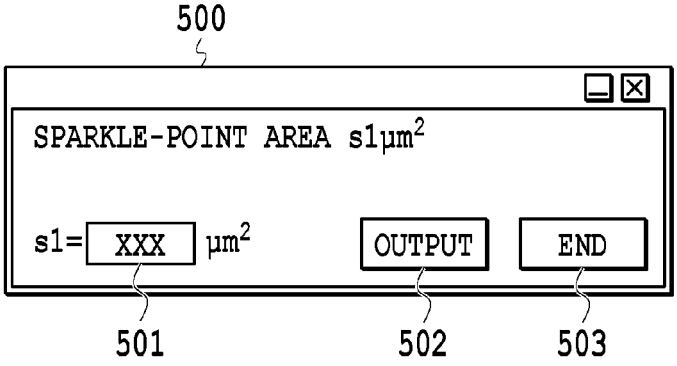
FIG. 5 is a diagram showing an example of a UI in Embodiment 1.

The flowchart shown in FIG. 4A starts after the user inputs a predetermined instruction by operating the input device 23 and the CPU 201 receives the inputted instruction. In S10, the UI display unit 301 displays a UI prompting the user to input necessary information on the display 25. FIG. 5 shows an example of an UI 500 prompting the user input in this embodiment. An input region 501 is a region to receive input of sparkle point information on a target object having the sense of sparkle.

Here, the size of sparkle points obtained by observing the target object can be used as the sparkle point information. The image processing apparatus 1 receives the sparkle point information inputted into the input region 501 by the user. Using the size of the sparkle points obtained by observing the target object, the image processing apparatus 1 in this embodiment performs control such that structures having only a small difference from the size of the sparkle points can be formed on the print medium. In this way, the image processing apparatus 1 in this embodiment can cause the printing device 24 to form structures that expresses the sense of sparkle reproducing the sense of sparkle of the target object with a certain level of quality.

In this embodiment, the area of the sparkle points present on the target object is preferably used as the size of the sparkle points. The area of the sparkle points can be obtained, for example, from a captured image of the target object illuminated from a predetermined angle and imaged from a normal direction thereto, as shown in FIG. 1A. Here, an instrument such as a digital camera can be used to image the target object and obtain a captured image thereof. An example of a method of obtaining the area of the sparkle points present on the target object from a captured image will be described in detail with reference to FIG. 6A to FIG. 6C.

Figure 6A:
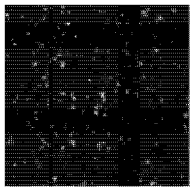
FIG. 6A is a diagram showing an example of a method of obtaining sparkle point information in Embodiment 1.
Figure 6B:
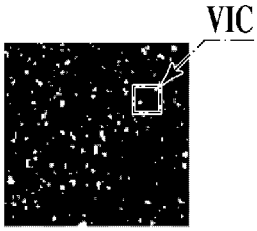
FIG. 6B is a diagram showing the example of the method of obtaining sparkle point information in Embodiment 1.
Figure 6C:
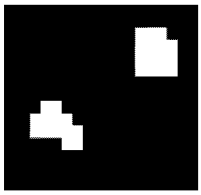
FIG. 6C is a diagram showing the example of the method of obtaining sparkle point information in Embodiment 1.

FIG. 6A is a captured image obtained by imaging the target object, and the pixel values are positively correlated to the luminance. First, the captured image shown in FIG. 6A is binarized based on a predetermined threshold to generate a binary image, in which white pixel regions correspond to sparkle points. FIG. 6B shows an example of the binary image thus generated. FIG. 6C is a partially enlarged view of the binary image shown in FIG. 6B. The sparkle points in the binary image shown in FIG. 6B are then subjected to labeling, and an average number N of sparkle point pixels is obtained. Lastly, area s1 of the sparkle points is calculated from a formula below with image resolution R dpi.

$$s1=N\times(25400/R)\hat{}2 \quad (1)$$

In this embodiment, the light receiving direction for obtaining a captured image has been described as the normal direction to the target object, but this is an example. The sparkle point area s1 can be calculated by the process using Mathematical Formula (1) from a captured image obtained by imaging from a different light receiving angle by performing perspective correction such as projective transformation on the captured image. Also, in this embodiment, the approach in which the user input region 501 receives input of the sparkle point area s1 (S10) has been described, but the type of data to be inputted into the user input region 501 is not limited to this. For example, assuming that the shape of the sparkle points present on the target object is square, the user input region 501 may receive input of the length of one side. The type of data to be inputted is not limited to the value indicating the area of the sparkle points, and may be any type as long as the area of the sparkle points present on the target object can be calculated with it. Note that, in this embodiment, the area of the sparkle points present on the target object is assumed not to vary by the illumination angle. However, in a case where the area of the sparkle points present on the target is assumed to vary by the illumination angle, the process using Mathematical Formula (1) may be performed for each angular condition. In this way, it is possible to calculate the area of the sparkle points present on the target object for each illumination angle.

Referring back to FIG. 5, an output button 502 is a region to receive an instruction to start printing on a print medium. An end button 503 is a region to receive an instruction to terminate the series of processes shown in FIG. 4A. The procedure proceeds to S20 after the user inputs the sparkle point information into the input region 501 and then presses the output button 502.

Referring back to FIG. 4A, in S20, the data obtaining unit 302 obtains the sparkle point information inputted by the user in S10. In S30, the structure-characteristic derivation unit 303 derives the characteristics of the structures to be formed on the print medium, based on the sparkle point information obtained in S20. The process of deriving the characteristics of the structures will be described later. In S40, the arrangement-data generation unit 304 generates data on the arrangement of the structures to be formed on the print medium, based on the characteristics of the structures derived in S30. The process of generating the structure arrangement data will be described later. In S50, the printing-device control unit 305 determines the number of laminations at each coordinate based on the structure arrangement data generated in S40, sends that information to the printing device 24, and instructs the printing device 24 to perform image forming operation. The process by the printing-device control unit 305 (S50) and the image forming operation by the printing device 24 will be described later.

(Content of Control of Structure-Characteristic Derivation Unit)

Figure 7A:
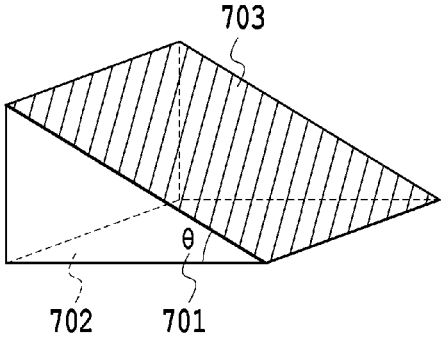
FIG. 7A is a diagram illustrating characteristics of one structure.
Figure 7B:
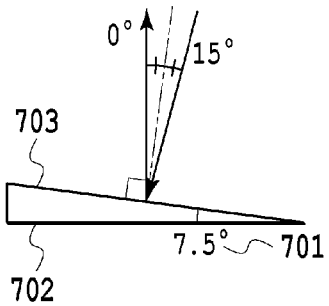
FIG. 7B is a diagram illustrating how one structure is visually recognized as a sparkle point.

First, the characteristics of a single structure in this embodiment will be described with reference to FIG. 7A and FIG. 7B. As shown in FIG. 7A, the characteristics of a structure in this embodiment are: a structure area that can be formed on a print medium by the printing device 24, and a structure inclination angle that can be formed with that area by the printing device 24. In this embodiment, base area 702 of the structure as its area and an inclination angle 701 that can be formed with the base area 702 represent the characteristics of the structure, but the area of the structure may be the area of its inclined surface 703. If the direction of specular reflection of applied light on the inclined surface 703 coincides with the direction of reception of light specularly reflected on the inclined surface 703, the region where the structure is arranged is visually recognized as a sparkle point under this angular condition of the structure.

More specific description will be given with reference to FIG. 7B. FIG. 7B is a diagram illustrating how a structure is visually recognized as a sparkle point. In a case where the angle at which the inclined surface 703 is illuminated is 15 degrees and the angle at which light is received from the inclined surface 703 is 0 degree, a region where a structure with an inclination angle 701 of 7.5 degrees is arranged is visually recognized as a sparkle point. Then, the structure-characteristic derivation unit 303 can derive a normal angle from the angular condition specified by the illumination angle and the light receiving angle. A structure with an inclination angle 701 equal to the derived normal angle is visually recognized as a sparkle point when observed from the light receiving angle. A structure with such an inclination angle is arranged on a print medium to reproduce a sparkle point observed from a predetermined angle. Further, in this embodiment, many structures with inclination angles corresponding to a plurality of angular conditions are arranged on the print medium. By arranging many structures with different inclination angles, the characteristic of sparkle points that vary in accordance with the angular condition can be reproduced on the print medium. Note that, in this embodiment, the bases of the structures to be formed on the print medium are rectangular, and their regions to be visually recognized as sparkle points are rectangular as well. The following description will be given on the assumption that the bases to be formed on the print medium are square, but the shape of the bases is not limited to square.

Figure 4B:
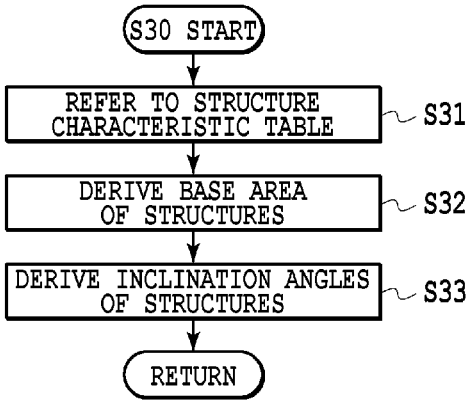
FIG. 4B is a flowchart showing the procedure of one of the processes by the image processing apparatus in Embodiment 1.

Now, details of the process of deriving the characteristics of the structures (S30) will be described with reference to FIG. 4B. In the process in S30, the structure-characteristic derivation unit 303 derives the characteristics of the structures for expressing the sense of sparkle. In S31, the structure-characteristic derivation unit 303 refers to the structure characteristic table 801, which is stored in the data storage unit 306. FIG. 8A shows an example of the structure characteristic table 801. In this embodiment, in the structure characteristic table 801, structure base areas s2 that can be formed by the printing device 24 are each associated with a plurality of inclination angles that can be formed on structures with that base area. In the structure characteristic table 801 shown in FIG. 8A, a base area of 60×60 μm^2, for example, is associated with a plurality of inclination angles of 0 degree, 14.0 degrees, 26.6 degrees, 36.9 degrees, and 45 degrees. As shown in FIG. 8A, one base area s2 is associated with two or more different inclination angles so that the structures formed on the print medium can express the sense of sparkle. While the inclination angles in the structure characteristic table 801 in this embodiment are angles in the range of 0 degree to 45 degrees, the embodiment is not limited only to this range. The possible range of inclination angles is dependent on the function of the printing device 24, and the structure characteristic table 801 may therefore include inclination angles outside the range of 0 degree to 45 degrees.

Figures 9A, 9B, 9C:
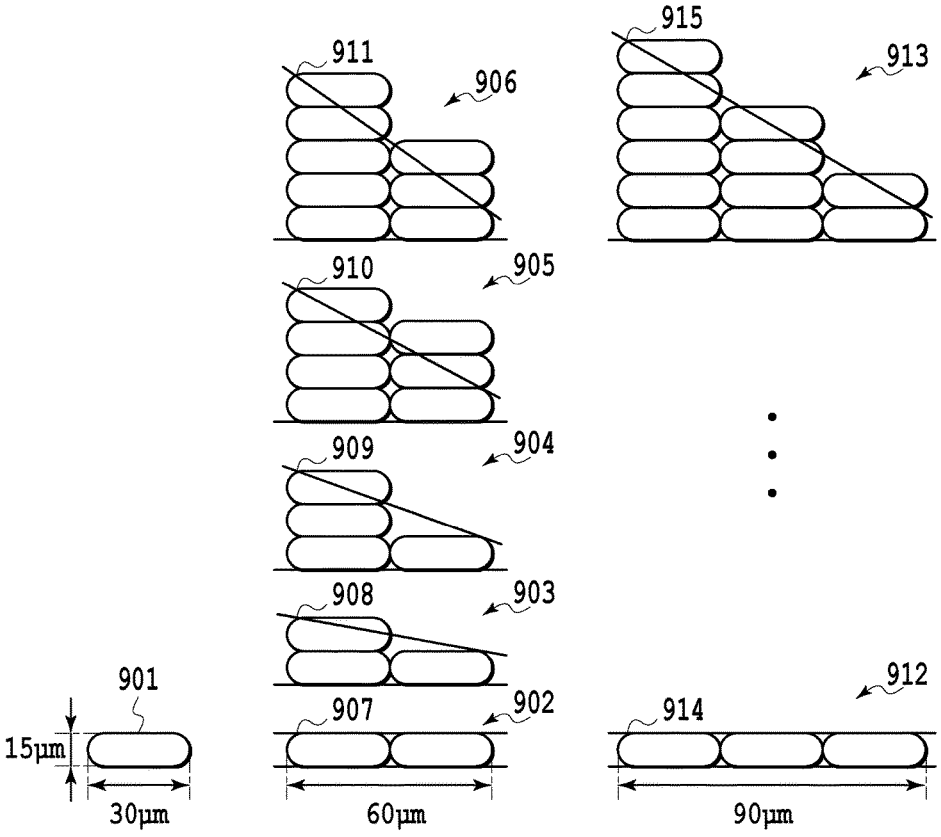
FIG. 9A is a schematic diagram showing ink ejected to a print medium.
FIG. 9B is a diagram showing laminates of ink ejected to a print medium and their inclined surfaces.
FIG. 9C is a diagram showing laminates of ink ejected to a print medium and their inclined surfaces.
Figure 10A:
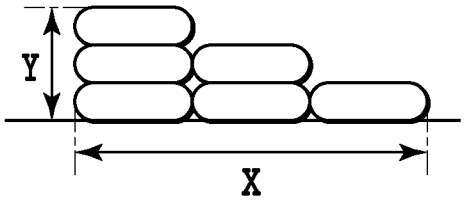
FIG. 10A is a schematic diagram showing a laminate of ink ejected to a print medium.
Figure 10B:
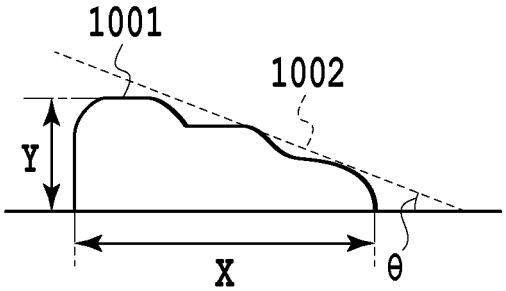
FIG. 10B is a schematic diagram showing a structure formed on the print medium.
Figure 10C:
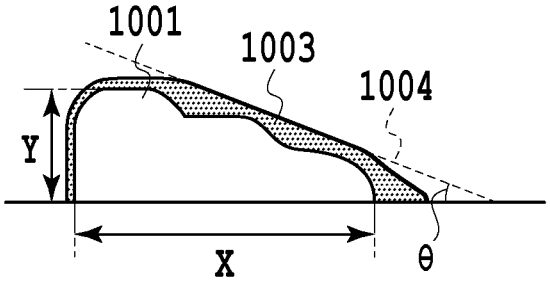
FIG. 10C is a schematic diagram showing a structure formed the print medium in a modification.

The relation between a structure base area and a plurality of inclination angles that can be formed on structures with that base area will be described with reference to FIG. 9A to FIG. 9C and FIG. 10A to FIG. 10C. FIG. 9A to FIG. 9C are schematic diagrams showing examples of ink ejected onto a print medium by the printing device 24. FIG. 10A to FIG. 10C are schematic diagrams showing examples of a structure formed on a print medium by the printing device 24.

FIG. 9A is a schematic diagram showing an example of a single ink dot 901 ejected by the printing device 24. In this embodiment, the single ink dot 901 measures 30 μm in horizontal length and 15 μm in vertical length. Here, the printing device 24 in this embodiment uses a UV curable ink having predetermined viscosity to form structures on a print medium. Generally, a UV curable ink is a printing material having such properties that it cures upon irradiation with UV light. A transparent UV curable ink is used in this embodiment.

FIG. 9B is a schematic diagram showing laminates 902 to 906 of ink ejected onto a print medium and their respective inclined surfaces 907 to 911. In this embodiment, the printing device 24 ejects dots successively in a horizontal direction of the surface of the print medium. Thus, the length of one side of an ink laminate is equal to an integer multiple of the width of an ink dot. For instance, in the example in FIG. 9B, the length of one side of each ink laminate is 30 μm×2=60 μm. In this embodiment, the printing device 24 can further eject dots vertically onto the ink dots successively ejected in the horizontal direction. In doing so, the number of dots to be vertically ejected is controlled such that an ink laminate with an inclined surface can be formed. For example, in the case of the ink laminate 906, five ink dots and three ink dots are vertically ejected next to each other, so that the ink laminate 906 with the inclined surface 911 is formed.

The inclined surfaces 907 to 911, which are shown in FIG. 9B, cannot be formed at arbitrary inclination angles, and their inclination angles are dependent on the performance of the printing device 24. Specifically, the size of a single ink dot that can be ejected by the printing device 24 determines the combination of the length of one side of each of the ink laminates 902 to 906 and the vertical height thereof. Then, the length of one side of each of the ink laminates 902 to 906 and the vertical height thereof naturally determines the inclination angle of each of the inclined surfaces 907 to 911. Moreover, the length of one side of each of the ink laminates 902 to 906 and the inclination angles of the inclined surfaces 907 to 911 correspond to the length of one side for s2 (60 μm) and the inclination angles (0 degree, 14.0 degrees, 26.6 degrees, 36.9 degrees, and 45 degrees) in the structure characteristic table 801 in FIG. 8A. Similarly, the size of a single ink dot that can be ejected by the printing device 24 determines the combination of the length of one side of each of ink laminates 912 to 913 shown in FIG. 9C (30 μm×3=90 μm) and the height thereof, and the combination naturally determines the inclination angles of inclined surfaces 914 to 915. Moreover, the length of one side of each of the ink laminates 912 to 913 and the inclination angles of the inclined surfaces 914 to 915 correspond to the length of one side for s2 (90 μm) and the inclination angles (0 degree 45 degrees) in the structure characteristic table 801.

Next, how the printing device 24 forms a structure on a print medium will be described with reference to FIG. 10A to FIG. 10C. FIG. 10A shows a laminate of ink ejected onto a print medium, and shows an example where three ink dots are ejected successively in the horizontal direction and three ink dots, two ink dots, and one ink dot are laminated in vertical direction next to each other. Here, horizontal length X in the horizontal direction is 30 μm×3 dots=90 μm, and vertical height Y at the highest point is 15 μm×3 dots=45 μm. As the printing device 24 irradiates the ink laminate with UV light, the ink laminate first melts and then cures, and a structure 1001 shown in FIG. 10B is finally formed. Similarly to the dimensions of the ink laminate in FIG. 10A, the length X of one side of the base of the structure 1001 is substantially 90 μm and the height Y at the highest point is substantially 45 μm.

Further, the formation of the ink laminate shown in FIG. 10A is controlled such that the ink dots arranged successively in the horizontal direction have mutually different numbers of laminated ink dots. The structure 1001 is formed such that its height varies in accordance with the number of laminated ink dots. Thus, an inclined surface is formed from the highest point to the lowest point of the ink laminate. On the structure 1001 in FIG. 10B, an inclined surface 1002 is formed which has a length X of substantially 90 μm along one side of the base, a height Y of substantially 45 μm at the highest point, and an inclination angle θ of substantially 26.6 degrees.

As an alternative embodiment, the printing device 24 may further laminate an ink different from the UV curable ink onto the structures. For example, the printing device 24 may be equipped with a metallic color ink containing a sparkly material in addition to the UV curable ink, and apply this metallic color ink on top of or under the structure 1001 to form a layer with high specular glossiness. The enhancement in specular glossiness of the structure makes it easier to visually recognize change in sparkle point characteristics such as the number of sparkle points, which are characteristic features of the sense of sparkle mentioned above, with change in angular condition. Alternatively, it is also possible to employ an approach in which the printing device 24 may use a high-viscosity UV curable ink to form the structure 1001 and additionally laminate a low-viscosity UV curable ink onto the structure 1001.

To describe this alternative embodiment with reference to FIG. 10C, the printing device 24 can form a structure by further ejecting a low-viscosity UV curable ink onto the structure 1001 made of a high-viscosity UV curable ink and irradiating the low-viscosity UV curable ink with UV light. As the printing device 24 ejects the low-viscosity UV curable ink onto the structure 1001, an upper layer 1003 is formed on the structure 1001. Since the low-viscosity UV curable ink has high wettability and easily adheres to the structure 1001, the low-viscosity UV curable ink can form a smoother inclined surface 1004.

Now, the process of deriving the characteristics of the structures (S30) will be described with reference to FIG. 4B. In S32, the structure-characteristic derivation unit 303 derives the base area s2 of the structures to be formed by the printing device 24, based on the inputted sparkle point information (S20) and the result of the reference to the structure characteristic table 801 (S31). In this embodiment, in a case where a sparkle point area s1 of 70×70 μm^2 is inputted as the sparkle point information, the structure-characteristic derivation unit 303 compares the sparkle point area s1 with structure base areas s2 and derives a structure area s2 that has the smallest difference from the sparkle point area s1. In the example of the structure characteristic table 801 shown in FIG. 8A, the structure-characteristic derivation unit 303 derives the structure area s2 such that s2=60×60 μm^2.

In S33, the structure-characteristic derivation unit 303 derives inclination angles θ of the structures to be formed by the printing device 24, based on the result of the reference to the structure characteristic table 801 (S31) and the result of the derivation of the structure base area s2 (S32). In this embodiment, the structure-characteristic derivation unit 303 derives, for example, values of 0 degree, 14.0 degrees, 26.6 degrees, 36.9 degrees, and 45 degrees which are associated with the structure base area s2 in the structure characteristic table 801. As described above, by the process in S30 in FIG. 4B, the structure-characteristic derivation unit 303 can derive the characteristics of the structures to be formed on the print medium (the base area and plurality of inclination angles of the structures).

(Content of Control of Arrangement-Data Generation Unit)

Figure 4C:
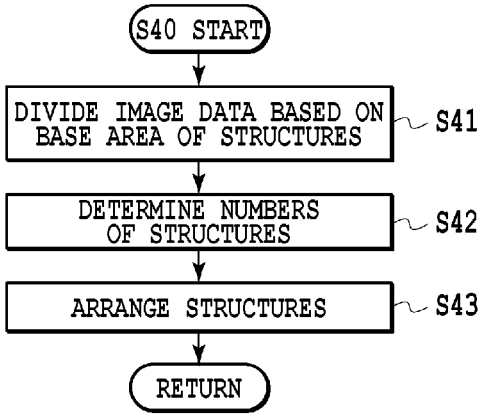
FIG. 4C is a flowchart showing the procedure of one of the processes by the image processing apparatus in Embodiment 1.
Figure 4D:
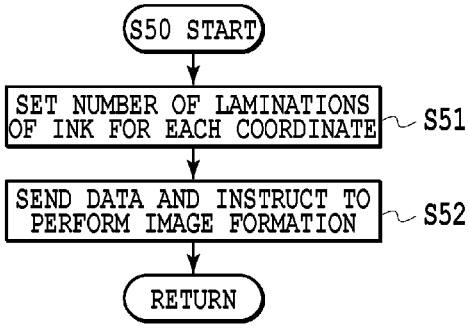
FIG. 4D is a flowchart showing the procedure of one of the processes by the image processing apparatus in Embodiment 1.

Next, the process of generating the structure arrangement data (S40) will be described with reference to FIG. 4C.

Figure 11A:
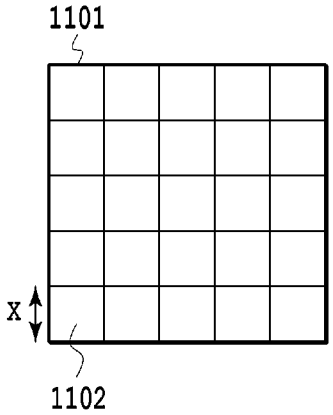
FIG. 11A is a schematic diagram of image data whose two-dimensional coordinates correspond to those on the surface of a print medium in Embodiment 1.

In S41, the arrangement-data generation unit 304 generates image data whose two-dimensional coordinates correspond to those on the surface of the print medium, and divides the image data into rectangular blocks each having the area s2 derived in S30. FIG. 11A is a schematic diagram showing part of image data 1101 generated by the arrangement-data generation unit 304 in S41. The arrangement-data generation unit 304 divides the generated image data 1101 into a plurality of rectangular blocks 1102 each having the area s2. In this embodiment, the length of one side of each rectangular block 1102 is equal to the length X of one side of the base. Then, the structures are arranged into the divided rectangular blocks on a one-to-one basis by a process to be described later. Note that it suffices for each rectangular block 1102 to have such a size that a structure with the base area s2 derived in S30 can be arranged therein, and the rectangular block 1102 may therefore be larger than the base area s2.

In S42, the arrangement-data generation unit 304 determines the numbers of structures with the inclination angles derived in S30. In this embodiment, the arrangement-data generation unit 304 determines the numbers of structures with the inclination angles by referring to the structure number table 802, which is stored in the data storage unit 306 in advance.

The content of the structure number table 802 will now be described with reference to FIG. 8B. In the structure number table 802 in this embodiment, inclination angles are associated with numbers of structures on a one-to-one basis. For example, in the structure number table 802 shown in FIG. 8B, inclination angles that can be formed on structures with a base area s2 of 60×60 μm^2 are associated with 4%, 12%, 20%, 28%, and 36%, which represent the proportions of such structures to be arranged into the structure arrangement data. Note that the values in the structure number table 802 are not limited to those shown in FIG. 8B, and any values can be used to express the desired the sense of sparkle. For example, it is also possible to use the value of each angle at which light is applied to a standard sample provided by the Japan Industrial Designers' Association (JIDA), and the number of sparkle points in a captured image of that sample imaged from a normal direction, or the like. Alternatively, it is also possible to form structures that express the desired the sense of sparkle by providing the data storage unit 306 with a plurality of structure number tables 802 in advance that differ from each other in number of structures, and selecting one of the structure number tables 802 as appropriate.

Figure 11B:
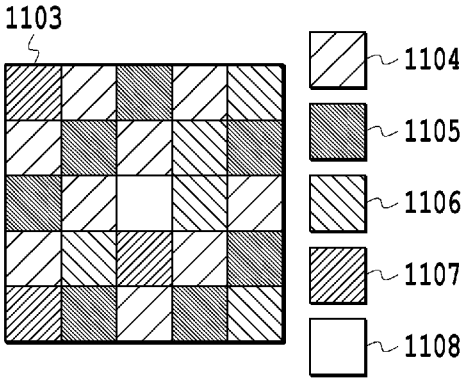
FIG. 11B is a schematic diagram of structure arrangement data specifying the arrangement of structures in Embodiment 1.

In S43, the arrangement-data generation unit 304 allocates the structures associated with the given inclination angles to the rectangular blocks in the image data divided in S41, to thereby generate structure arrangement data specifying the arrangement of the structures. In this embodiment, the arrangement-data generation unit 304 generates structure arrangement data specifying the arrangement of a combination of the two or more types of structures with the different inclination angles derived in S30. FIG. 11B is a schematic diagram of structure arrangement data 1103 in which the structures are allocated to the rectangular blocks. The structures associated with the mutually different inclination angles are allocated to the blocks 1104 to 1108, respectively. In the structure arrangement data 1103, a combination of five types of structures with different inclination angles of 0 degree, 14.0 degrees, 26.6 degrees, 36.9 degrees, and 45 degrees is arranged.

Specifically, the arrangement-data generation unit 304 arranges the structures by the following method. In this embodiment, an example of arranging the structures into the image data 1101 divided in 25 blocks (5×5) will be described. First, the arrangement-data generation unit 304 numbers all the 25 blocks from 1 to 25 based on random numbers. Then, with N1 to Nm denoting the numbers of structures corresponding to inclination angles θ1 to θm, the arrangement-data generation unit 304 arranges the structures associated with the inclination angle θ1 into the blocks numbered from 1 to N1. In the example in FIG. 11B, the number of structures corresponding to an inclination angle of 45.0 degrees is nine. The structures associated with an inclination angle of 45.0 degrees are arranged into the blocks numbered from 1 to 9 among the 25 blocks in the image data 1101. In the structure arrangement data 1103 in FIG. 11B, those are the regions where the blocks 1104 are arranged. The arrangement-data generation unit 304 then arranges the structures associated with the inclination angle θ2 into the blocks numbered from (N1+1) to (N1+N2). By determining the arrangement of the structures associated with the inclination angles θ1 to θm in the manner described above, the arrangement-data generation unit 304 can specify the arrangement of the combination of the two or more types of structures associated with the different inclination angles. Note that, while the method of arranging the structures is not limited to the above method, the structures are desirably arranged to be distributed such that the structures with the same inclination angle do not sit adjacent to each other. For example, the arrangement-data generation unit 304 may perform an iteration process involving: performing the series of sub-processes from the numbering of the blocks to the arrangement of the structures; checking whether or not there are any structures with the same inclination angle sitting adjacent to each other; and repeating the sub-processes if there are structures with the same inclination angle sitting adjacent to each other. Further, structures with inclination angles that are different from but close to each other are desirably arranged at more distant positions from each other so that the shift of sparkle points with change in observation condition can be visually recognized more noticeably. To do so, the arrangement-data generation unit 304 may calculate, as an evaluation index, the sum of the differences in inclination angle between the adjacent structures, which can be calculated by the following Formula, for example, repeat this arrangement-candidate determination process a predetermined number of times, and select the arrangement with the greatest evaluation value.

$$\Sigma\Sigma|\theta(x,t)-\theta(x+1,y+1)| \quad (2)$$

Meanwhile, the arrangement-data generation unit 304 may redefine the numbers of structures to be arranged into the image data 1101, in a case where the total number of structures to be arranged is greater than the number of blocks into which the image data 1101 is divided and not all the structures obtained in S42 can be arranged into the image data 1101. In this case, the arrangement-data generation unit 304 can redefine the numbers of structures to be arranged by calculating the proportions of the numbers of structures to be arranged, and multiplying the number of blocks in the image data 1101 by the calculated proportions of the numbers of structures. As described above, the arrangement-data generation unit 304 can generate structure arrangement data by the process in S40 in FIG. 4C.

(Content of Control of Printing-Apparatus Control Unit)

Then in S50, the printing-device control unit 305 determines the number of laminations at each coordinate based on the structure arrangement data, sends that information to the printing device 24, and instructs the printing device 24 to perform image forming operation. The process performed by the printing-apparatus control unit (S50) will be described with reference to FIG. 4D.

In S51, based on the structure arrangement data derived in S40, the printing-device control unit 305 generates data in which the number of laminations of the UV curable ink is set for each coordinate in each block in the image data 1101 in accordance with the inclination angle of the structure to be arranged in the block. For example, in a case of forming a structure based on the UV-curable ink laminate 906 in FIG. 10A, the printing-device control unit 305 can set a value of 3 as the greatest number of laminations of the ink and set values obtained by decrementing the value of 3, or the greatest number of laminations, for the following coordinates in the structure arrangement data 1103 along the x direction.

In S52, the printing-device control unit 305 sends the printing device 24 the data in which the number of laminations of the UV curable ink is set for each pixel in S51, and instructs the printing apparatus to perform image forming operation to be described later. Note that it is also possible to employ an approach in which the sub-process described in S51 is performed inside the printing device 24, and the structure arrangement data derived in S40 is sent directly thereto. Alternatively, in a case where the printing device 24 is equipped with a different ink in addition to the transparent UV curable ink mentioned above, and the ink to be used for the structure formation can be changed, it is also possible to employ an approach in which information specifying the type of ink is additionally sent to the printing device 24 along with the data mentioned above.

(Image Forming Operation by Printing Apparatus)

Figure 12:
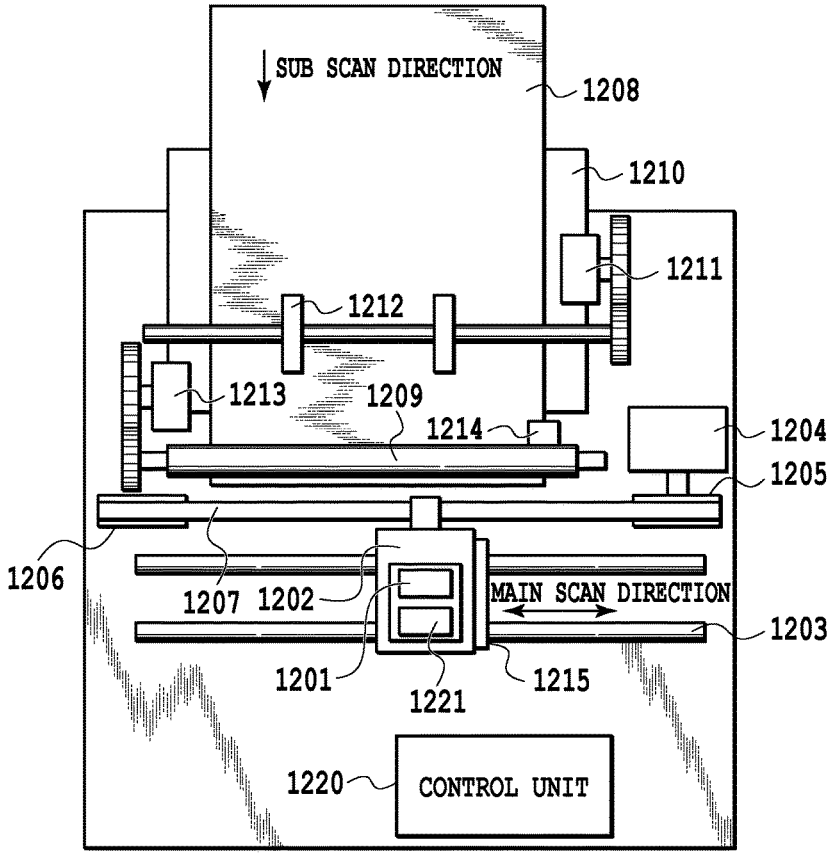
FIG. 12 is a diagram showing the configuration of a printing apparatus in Embodiment 1.

The image forming operation by the printing device 24 based on the information determined by the printing-device control unit 305 will be described. First, the configuration of the printing device 24 will be described by using FIG. 12. Ahead cartridge 1201 is provided with a record head formed of a plurality of ejection ports, an ink tank for feeding ink to the record head, and a connector for receiving signals for driving the ejection ports of the record head. The UV curable ink for the structure formation is provided in the ink tank. The head cartridge 1201 and a UV lamp 1221 are replaceably mounted at predetermined positions on a carriage 1202. The carriage 1202 is provided with a connector holder for transferring drive signals and the like to the head cartridge 1201 and the UV lamp 1221 through the connector. The carriage 1202 is capable of reciprocating movement along guide shafts 1203. Specifically, the carriage 1202 is configured to be driven and its position and movement are controlled by a main scan motor 1204 as a drive source through a drive mechanism such as a motor pulley 1205, a driven pulley 1206, and a timing belt 1207. Note that the movement of this carriage 1202 along the guide shafts 1203 will be referred to as "main scan" and the direction of this movement will be referred to as the "main scan direction."

Print medium materials 1208 for printing are placed on an automatic sheet feeder (ASF) 1210. In forming an image on a print medium 1208, pickup rollers 1212 are rotated by driving of a sheet feed motor 1211, so that the print mediums 1208 are separately fed one by one from the ASF 1210. Further, each print medium material 1208 is conveyed by rotation of a conveyance roller 1209 to a record start position at which the print medium 1208 faces the ejection-port face of the head cartridge 1201 on the carriage 1202. The conveyance roller 1209 is configured to be driven by a line feed motor 1213 as a driven source through gears. Whether or not the print medium 1208 is fed is determined and whether or not the print medium 1208 is at a fed position is confirmed when the print medium 1208 passes an end sensor 1214. The head cartridge 1201, which is mounted on the carriage 1202, is held such that its ejection-port face projects downward from the carriage 1202 and is in parallel to the print medium 1208. A control unit 1220 is configured to control the operation of each part of the printing device 24 based on the number of laminations of the transparent UV curable ink at each coordinate derived in S50. The printing device 24 in this embodiment will be described as a bilevel printing apparatus configured to control whether or not to eject the ink at a predetermined resolution, for the sake of simple description. It is of course possible to use a method capable of changing the size of each ink droplet to be ejected.

Next, the image forming operation by the printing device 24 will be described. After a print medium 1208 is conveyed to the predetermined record start position, the carriage 1202 is moved over the print medium 1208 along the guide shafts 1203. While the carriage 1202 is moved, the ink is ejected from the ejection ports of the record head. Immediately after the ink ejection, the UV lamp 1221 is turned on, thereby curing the UV curable ink. After the carriage 1202 is moved to one end of the guide shafts 1203, the conveyance roller 1209 conveys the print medium 1208 by a predetermined amount in a direction perpendicular to the scan direction of the carriage 1202. This conveyance of the print medium 1208 will be referred to as "paper feed" or "sub scan," and the direction of this conveyance will be referred to as the "paper feed direction" or "sub scan direction." After the print medium 1208 finishes being conveyed by the predetermined amount in the sub scan direction, the carriage 1202 is moved along the guide shafts 1203 again. By repeating the scan of the record head by the carriage 1202 and the paper feed as described above, structures for expressing the sense of sparkle are formed over the print medium 1208. Note that the print medium used in this embodiment may be a medium other than record paper as long as the record head can form structures thereon. Also, although the example where an inkjet method is employed has been presented in this embodiment, a different recording method such as a xerographic method may be used instead. The scan of the carriage 1202 described above is repeated the number of times equal to the number of laminations set in S51, so that the UV curable ink is laminated and the structures are formed on the print medium 1208. Note that, although the image data 1101 is generated in S30 to have the same resolution as the resolution of the printing device 24, a resolution conversion process may be performed as appropriate on the image data 1101 if they have different resolutions. Also, it is also possible to employ an approach in which the printing device 24 is further equipped with a metallic color ink containing a sparkly material in addition to the UV curable ink. In this modification, the printing-device control unit 305 may apply the metallic color ink on top of or under each of the formed structures to form a high gloss layer. In this way, the metallic texture of the structures can be further enhanced. Alternatively, after the process in S50, the printing-device control unit 305 may eject an ink having high wettability onto each of the formed structures to form a smoother inclined surface on top of the structure. With the ink with high wettability ejected onto each of the structures, sparkle points with higher luminance can be expressed on the print medium.

(Example of Formation of Structures Artificially for Expressing the Sense of Sparkle)

Figure 13B:
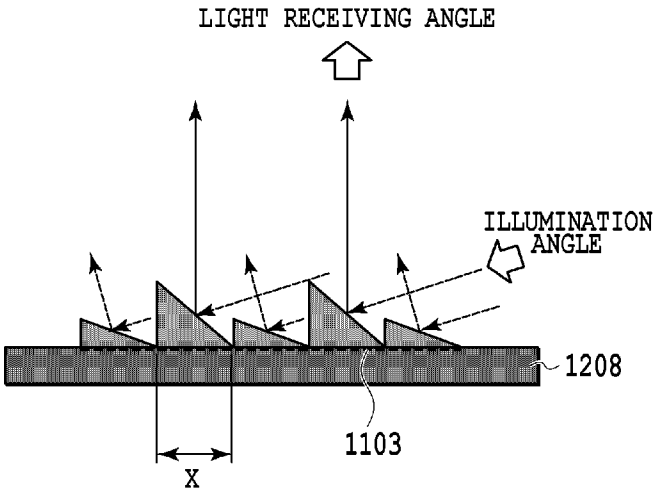
FIG. 13B is a schematic view showing the structures formed on the print medium.
Figure 13A:
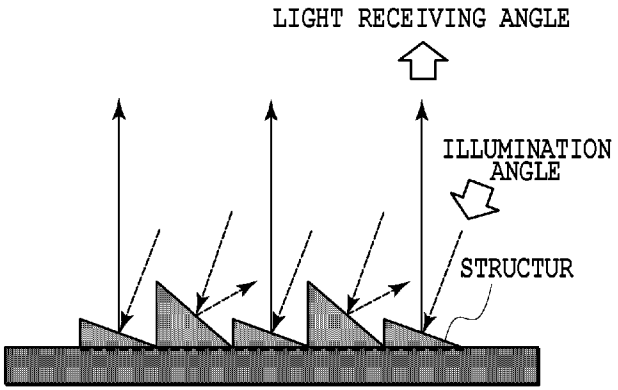
FIG. 13A is a schematic view showing structures formed on a print medium.

Next, an example of structures for artificially expressing the sense of sparkle will be described with reference to FIG. 13A and FIG. 13B. Each of FIG. 13A and FIG. 13B is a diagram schematically showing a cross section of the structures formed on the print medium 1208 by the processes by the image processing apparatus 1 described above. As shown in FIG. 13A and FIG. 13B, a combination of two types of structures with different inclination angles is arranged on the print medium 1208, and each of the structures has a base area calculated from its base having a length of X on one side. Moreover, the arrangement of the structures formed on the print medium 1208 is the same between FIG. 13A and FIG. 13B.

However, if light is applied to the print medium 1208, on which the structures are formed, from different illumination angles, the light is specularly reflected at the same light receiving angle but by structures at different positions. Thus, if one observes the print medium 1208 from a single observation point, he or she will visually recognize change in position of sparkle points as the illumination angle is changed from FIG. 13A to FIG. 13B or from FIG. 13B to FIG. 13A. Since the characteristics of sparkle points present on the surface of the object change with change in illumination angle or observation point, the observer can visually recognize a texture peculiar to the sense of sparkle such as a glittering texture or a grainy texture.

As described above, the image processing apparatus 1 in this embodiment can artificially express the sense of sparkle by forming a combination of two or more types of structures associated with different inclination angles on a print medium. Moreover, using the size of sparkle points present on the target object as an input parameter, the image processing apparatus 1 in this embodiment performs control such that structures having only a small difference in size from the sparkle points can be formed on the print medium. In this way, the image processing apparatus 1 in this embodiment can form structures that express the sense of sparkle reproducing the sense of sparkle of the target object with a certain level of quality. Embodiment 1 has been described by taking as an example the system in which the image processing apparatus 1 is constructed as an apparatus independent of the printing device 24, which actually forms the structures. Note, however, that the image processing apparatus 1 may be incorporated in the printing device 24. In the case of this configuration, the image processing apparatus 1 can be implemented as a dedicated image processing circuit and its functions can be implemented by means of circuits.

Embodiment 2

Embodiment 1 focuses on the size of sparkle points present on a target object, and the characteristics of structures to be formed on a print medium are derived based on the area of the sparkle points on the target object inputted. This embodiment focuses on the condition for observing the target object, and description will be given of an approach in which the characteristics of the structures to be formed on the print medium are derived based on the angular condition for observing the sparkle points. Note that the hardware configuration and software function configuration of an image processing apparatus 1 in Embodiment 2 are the same as those in Embodiment 1. The differences in processing between this embodiment and Embodiment 1 are a process of displaying a UI by a UI display unit 301 (S10) and a process of deriving the characteristics of the structures by a structure-characteristic derivation unit 303 (S30). Hence, only the contents of these processes will be described below.

Figure 14B:
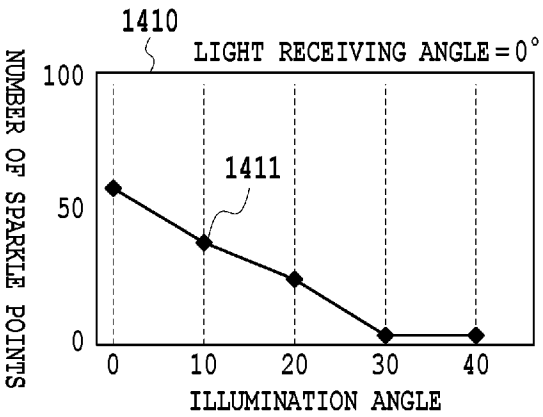
FIG. 14B is a diagram showing an example of a UI in Embodiment 2.
Figure 14A:
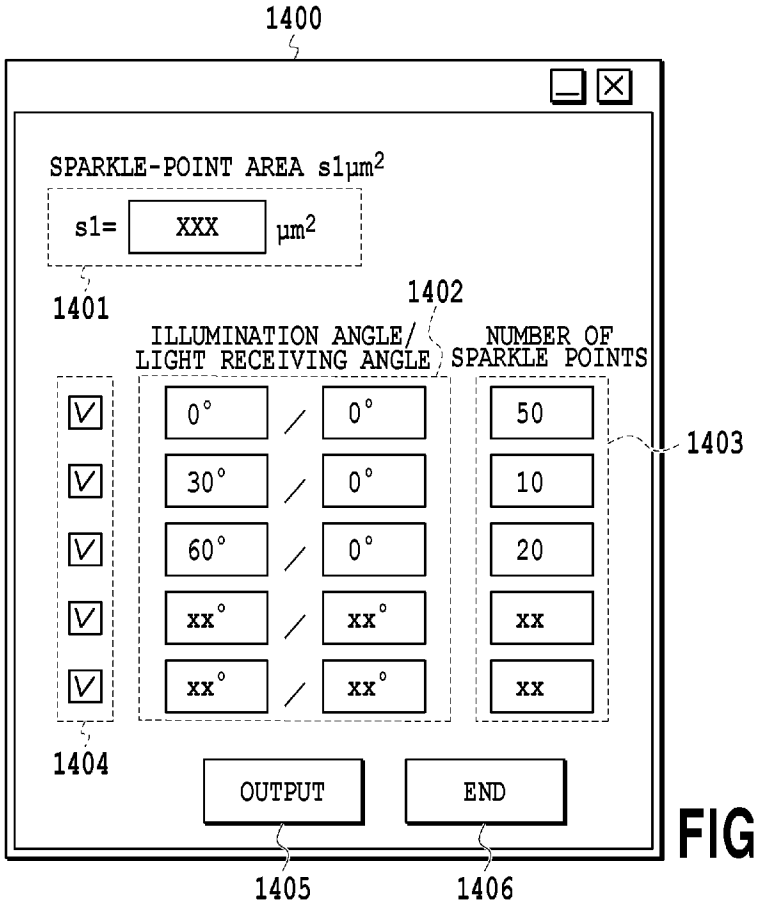
FIG. 14A is a diagram showing an example of a UI in Embodiment 2.

In S10, in order that an image processing apparatus 1 can receive input of necessary information, the UI display unit 301 displays a UI prompting the user to input the necessary information on a display 25. FIG. 14A shows an example of a UI 1400 prompting the user input in this embodiment. In the UI 1400 in FIG. 14A, input regions 1401 to 1404 are regions to receive input of sparkle point information on a target object. In this embodiment, the image processing apparatus 1 receives the sparkle point information inputted into the input regions 1401 to 1404 by the user. An output button 1405 is a region to receive an instruction to start printing on a print medium. An end button 1406 is a region to receive an instruction to terminate the series of processes shown in FIG. 4A. The procedure proceeds to S20 after the user inputs the sparkle point information into the input regions 1401 to 1404 and then presses the output button 1405. The processes in and after S20 are the same as those in Embodiment 1, and description thereof will therefore be omitted.

The UI 1400 in this embodiment includes: the input region 1401 to receive input of area s1 of the sparkle points; the input region 1402 to receive input of angular conditions of the sparkle points; and the input region 1403 to receive input of the numbers of sparkle points under the angular conditions. The UI 1400 further includes the input regions 1404 to receive input of instructions as to whether or not the values inputted in the input regions 1402 and 1403 are to be used in the processes in and after S30. Here, the angular conditions in this embodiment refer to the angular conditions for observing the target object, i.e. the angles of illumination to the target object and the angle of light reception at the observation point during the observation of the target object. The number of sparkle points under each angular condition is the number of sparkle points that can be obtained by observing the target object in a state where the angular condition, namely, the illumination angle and the light receiving angle are satisfied. At least some of the sparkle points differ in position from one angular condition to another as a matter of course. In this embodiment, using the angular conditions for observing the sparkle points on the target object, the image processing apparatus 1 performs control such that the difference between the angular conditions for observing the sparkle points on the target object and the angular conditions for visually recognizing the structures formed on the print medium as sparkle points will be small. In this way, the image processing apparatus 1 in this embodiment can form structures that express the sense of sparkle reproducing the sense of sparkle of the target object with a certain level of quality. Note that it is not necessary to employ the approach in which the numbers of sparkle points under the angular conditions are directly inputted numerical values as in the UI 1400 in FIG. 14A. For example, as in an UI 1410 in FIG. 14B, it is also possible to receive input of the numbers of sparkle points by having the user vertically slide plot points 1411 in a graph indicating illumination angles θ set along the horizontal axis and numbers of sparkle points set along the vertical axis.

(Content of Control of Structure-Characteristic Derivation Unit)

Figure 15:
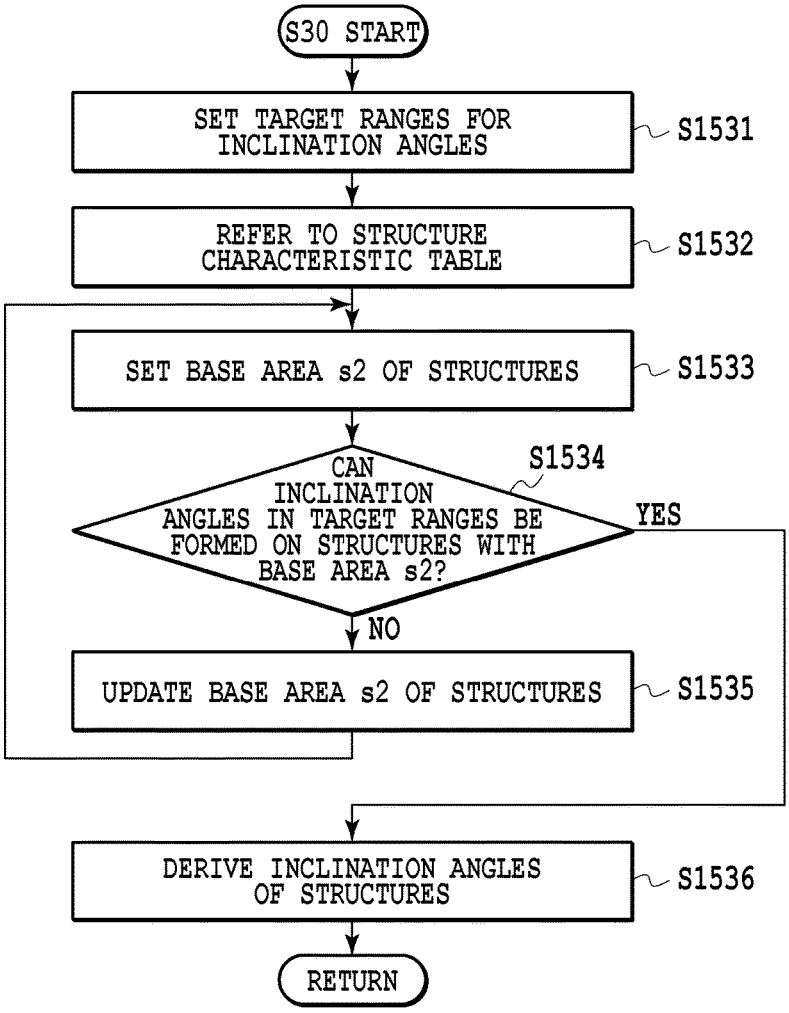
FIG. 15 is a flowchart showing the procedure of a process of deriving characteristics of structures in Embodiment 2.

Next, the process of deriving the characteristics of the structures (S30) in this embodiment will be described with reference to FIG. 15. In S1531, the structure-characteristic derivation unit 303 sets target ranges for a plurality of inclination angles to be formed on the print medium, from the angular conditions inputted through the UI 1400. The target ranges set in S1531 for the plurality of inclination angles can each be obtained by calculating a target angle θ at which the observation point and the direction of specular reflection of applied light coincide with each other, and setting a range covering an allowable error θd from the target angle θ. For example, in a case where the target angles θ are calculated to be 0 degree, 10 degrees, 20 degrees, and 25 degrees and the allowable error θd is ±2 degrees, ranges of ±2 degrees from the target angles θ of 0 degree, 10 degrees, 20 degrees, and 25 degrees are set as the target ranges. The above example has shown the case where the allowable error θd is set as a fixed value. Note, however, that the allowable error θd may be set based on ratio. For example, it is also possible to employ an approach in which the allowable error θd is adaptively varied by setting 10% of the difference between the target angles θ as the allowable error θd.

In S1532, the structure-characteristic derivation unit 303 refers to a structure characteristic table 801, which is stored in a data storage unit 306. The data structure of the structure characteristic table 801 is the same as that in Embodiment 1 (FIG. 8A).

In S1533, the structure-characteristic derivation unit 303 sets structure base area s2 from the inputted angular conditions (S1531) and the result of the reference to the structure characteristic table 801 (S1532).

In S1534, the structure-characteristic derivation unit 303 determines whether or not the inclination angles in the target ranges set in S1531 can be formed on structures with the area s2 set in S1533. Description will be given based on a specific example where the target ranges are set to be 0±2 degrees, 10±2 degrees, 20±2 degrees, and 25±2 degrees and the structure area s2 is set to be 90×90 μm^2 in S1533, for instance. The structure-characteristic derivation unit 303 refers to the structure characteristic table 801 and selects values of 0 degree, 9.5 degrees, 18.4 degree, 26.6 degrees, 33.7 degrees, 39.8 degrees, and 45 degrees as structure inclination angles θ that may be able to be formed with the structure base area s2 of 90×90 μm^2. In this case, the structure-characteristic derivation unit 303 can form the inclination angles of 10±2 degrees, 20±2 degrees, and 25±2 degrees among the target ranges. The structure-characteristic derivation unit 303 proceeds to S1536 if determining that there are an inclination angle in any target range that can be formed on a structure with the area s2 (S1534: YES). On the other hand, the structure-characteristic derivation unit 303 proceeds to S1535 if determining that the inclination angles in the target ranges cannot be formed on structures with the area s2 (S1534: NO). If determining in S1534 that the inclination angles in the target ranges can be formed, the structure-characteristic derivation unit 303 refers to the structure characteristic table 801 and derives also the structure area s2 associated with the plurality of inclination angles determined to be formable. In this case, the structure-characteristic derivation unit 303 can derive such structure characteristics that the difference between the angular conditions for observing the sparkle points on the target object and the angular conditions for visually recognizing the structures formed on the print medium as sparkle points will be small.

In S1535, the structure-characteristic derivation unit 303 updates the structure base area s2. In this embodiment, as shown in the structure characteristic table 801, the number of structure inclination angles that can be formed by the printing device 24 increases the larger the structure base area s2. Thus, the structure-characteristic derivation unit 303 updates the structure base area s2 set in S1533 to an area that is one size larger, e.g. from a base area s2 of 90×90 μm^2 to a base area s2 of 120×120 μm^2.

In S1536, the structure-characteristic derivation unit 303 derives the inclination angles θ of the structures to be formed by the printing device 24, from the result of the reference to the structure characteristic table 801 (S1532) and the result of the determination (S1534).

As described above, the image processing apparatus 1 in this embodiment can artificially express the sense of sparkle by forming a combination of two or more types of structures with different inclination angles onto a print medium. Moreover, using the angular conditions for observing the sparkle points on the target object as input parameters, the image processing apparatus 1 in this embodiment performs control such that the difference between the angular conditions for observing the sparkle points on the target object and the angular conditions for visually recognizing the structures formed on the print medium as sparkle points will be small. In this way, the image processing apparatus 1 in this embodiment can form structures that express the sense of sparkle reproducing the sense of sparkle of the target object with a certain level of quality.

Embodiment 3

In Embodiment 1, the arrangement-data generation unit 304 derives the numbers of structures corresponding to different inclination angles by referring to the structure number table 802 (FIG. 8B), which is stored in the data storage unit 306 in advance. In this embodiment, the numbers of structures corresponding to different inclination angles are derived based on the correlations between the angular conditions for observing sparkle points and the numbers of sparkle points observed under these angular conditions. Note that the hardware configuration and software function configuration of an image processing apparatus 1 in this embodiment are the same as those in Embodiment 1. Further, a process of displaying a UI by a UI display unit 301 (S10) in this embodiment is the same as that in Embodiment 2. The difference between this embodiment and the foregoing embodiments is a process of deriving the arrangement of structures by an arrangement-data generation unit 304 (S40). Hence, only the content of this process will be described below.

(Content of Control of Arrangement-Data Generation Unit)

Figure 16:
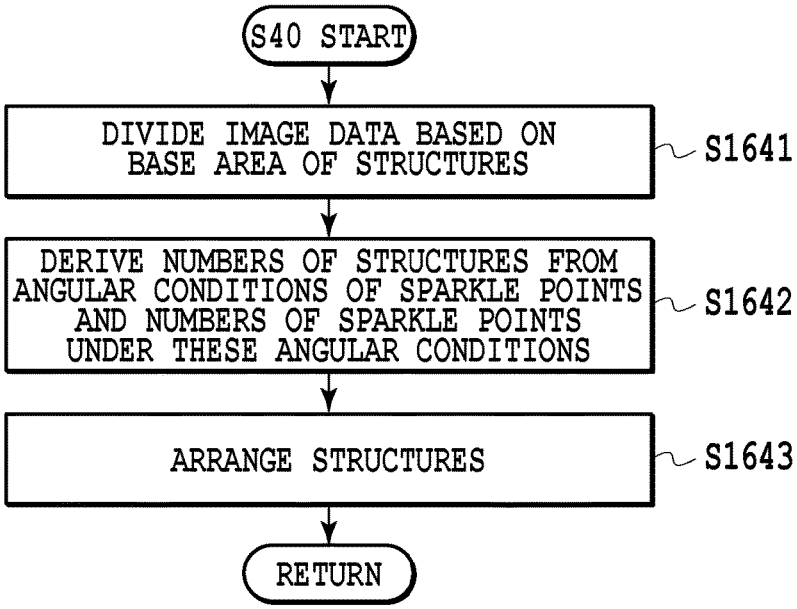
FIG. 16 is a flowchart showing the procedure of a process of generating structure arrangement data in Embodiment 3.

The process of deriving the arrangement of structures (S40) in this embodiment will be described with reference to FIG. 16. In S1641, the arrangement-data generation unit 304 generates image data whose two-dimensional coordinates correspond to those on the surface of a print medium, and divides the image data into rectangular blocks each having an area s2 derived in S30.

In S1642, the arrangement-data generation unit 304 derives the numbers of structures corresponding to different inclination angles from inputted angular conditions of sparkle points and numbers Mx of sparkle points under these angular conditions. Note that, in this embodiment, too, it is possible to receive the values of the angular conditions for observing sparkle points and the numbers of sparkle points observed under these angular conditions through input regions 1402 and 1403 in a UI 1400 (FIG. 14A) and use these values.

First, from each of the inputted angular conditions, the arrangement-data generation unit 304 derives a structure inclination angle θx at which the observation point and the direction of specular reflection of applied light coincide with each other. In the following description, θx represents a target angle. In this embodiment, as shown in FIG. 7B, for example, in a case where the illumination angle and the light receiving angle are 15 degrees and 0 degree, respectively, the target angle of a structure is 7.5 degrees in order that the region where the structure is arranged is to be visually recognized as a sparkle point. Then, the arrangement-data generation unit 304 derives a number My of structures corresponding to the target angle θx. The number My of structures with the inclination angle θx can be derived by calculation using the values of target angles θx1 and θx2 and numbers M1 and M2 of sparkle points corresponding to the target angles θx1 and θx2, respectively, in the following mathematical formula, where θx1≤θx≤θx2.

$$My=M1+(M2-M1)\times(\theta x-\theta x1)/(\theta x2-\theta x1) \quad (3)$$

Besides the method of estimating the number My of structures by the linear interpolation using Mathematical Formula 3 above, it is also possible to use a different method in which, for example, the difference between each of the inclination angles derived in S30 and the target angle θx is figured out, and the number of sparkle points corresponding to the inclination angle with the smallest difference is estimated as My.

In S1643, the arrangement-data generation unit 304 allocates the structures associated with the given inclination angles to the rectangular blocks in the image data divided in S1641, to thereby generate structure arrangement data specifying the arrangement of the structures. In this embodiment, the arrangement-data generation unit 304 generates structure arrangement data specifying the arrangement of a combination of the two or more types of structures with the different inclination angles derived in S30.

As described above, in this embodiment, the correlations between the angular conditions for observing sparkle points and the numbers of sparkle points observed under these angular conditions is used to perform control such that the numbers of structures corresponding to different inclination angles are formed on a print medium. In this way, the image processing apparatus 1 can form structures that express the sense of sparkle reproducing the sense of sparkle of the target object with a high level of quality.

Embodiment 4

Embodiment 1 focuses on the size of sparkle points on a target object, and the characteristics of structures to be formed on a print medium are derived based on the area of sparkle points inputted. On the other hand, Embodiment 2 focuses on the conditions for observing the target object, and the characteristics of the structures to be formed on the print medium are derived based on the angular conditions for observing the sparkle points. In this embodiment, description will be given of an example where the method of deriving the characteristics of the structures is switched by determining which one of the area of the sparkle points and the angular conditions for observing the sparkle points has priority over the other. The differences in processing between this embodiment and Embodiments 1 to 3 are a process of displaying a UI by a UI display unit 301 (S1810) and a process of determining priority by a priority determination unit 1701. Hence, only the contents of these processes will be described below.

Figure 17:
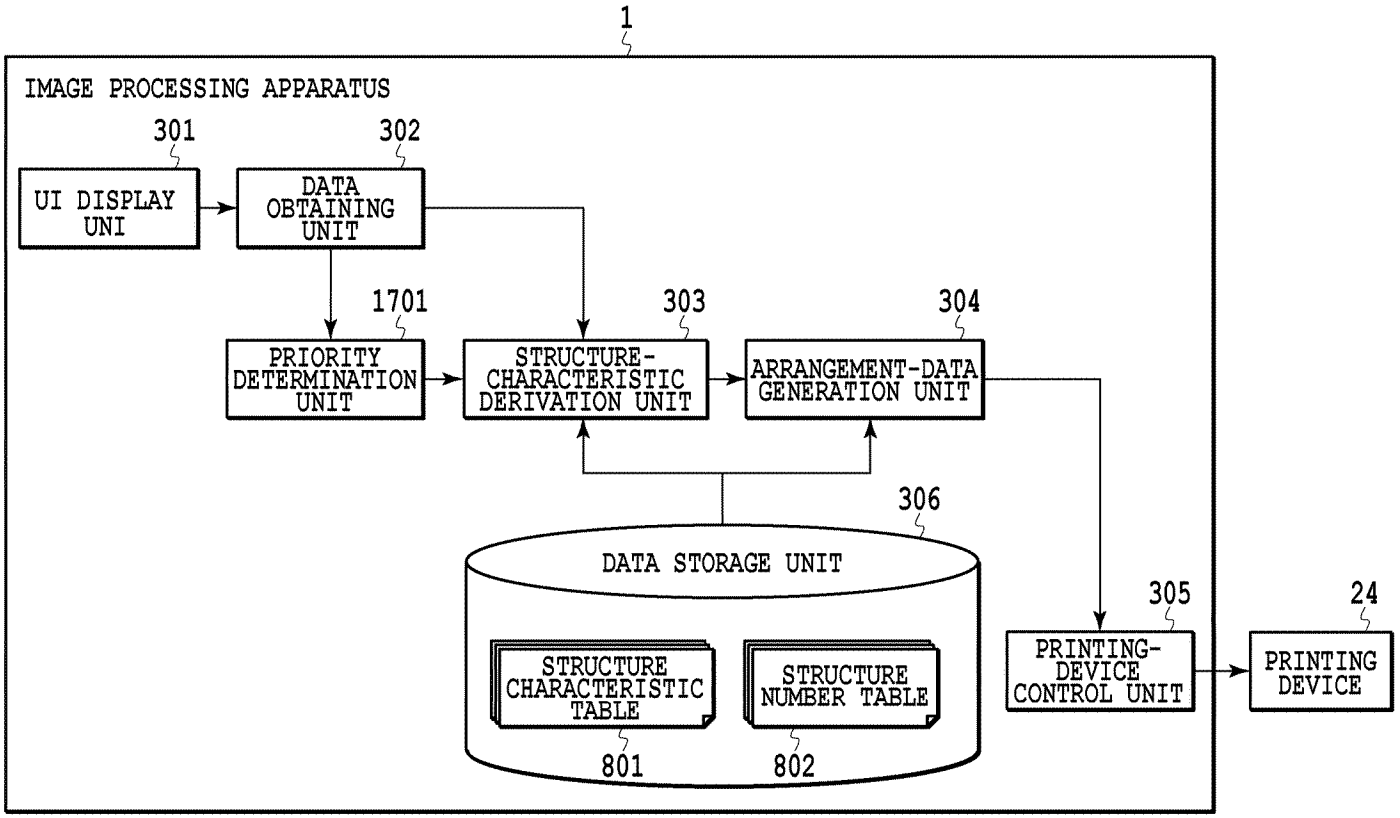
FIG. 17 is a block diagram showing the software function configuration of an image processing apparatus in Embodiment 4.

FIG. 17 is a block diagram showing the software function configuration of an image processing apparatus 1 in this embodiment. The only difference from the software function configurations of the image processing apparatuses 1 in Embodiments 1 to 3 is the configuration of the priority determination unit 1701. The priority determination unit 1701 is configured to determine which one of a plurality of types of sparkle point information has priority over the other, when the characteristics of the structures are to be derived. In this embodiment, the priority determination unit 1701 determines which one of the size and the angular conditions of sparkle points has priority.

(Operation of Image Processing Apparatus)

Figure 18:
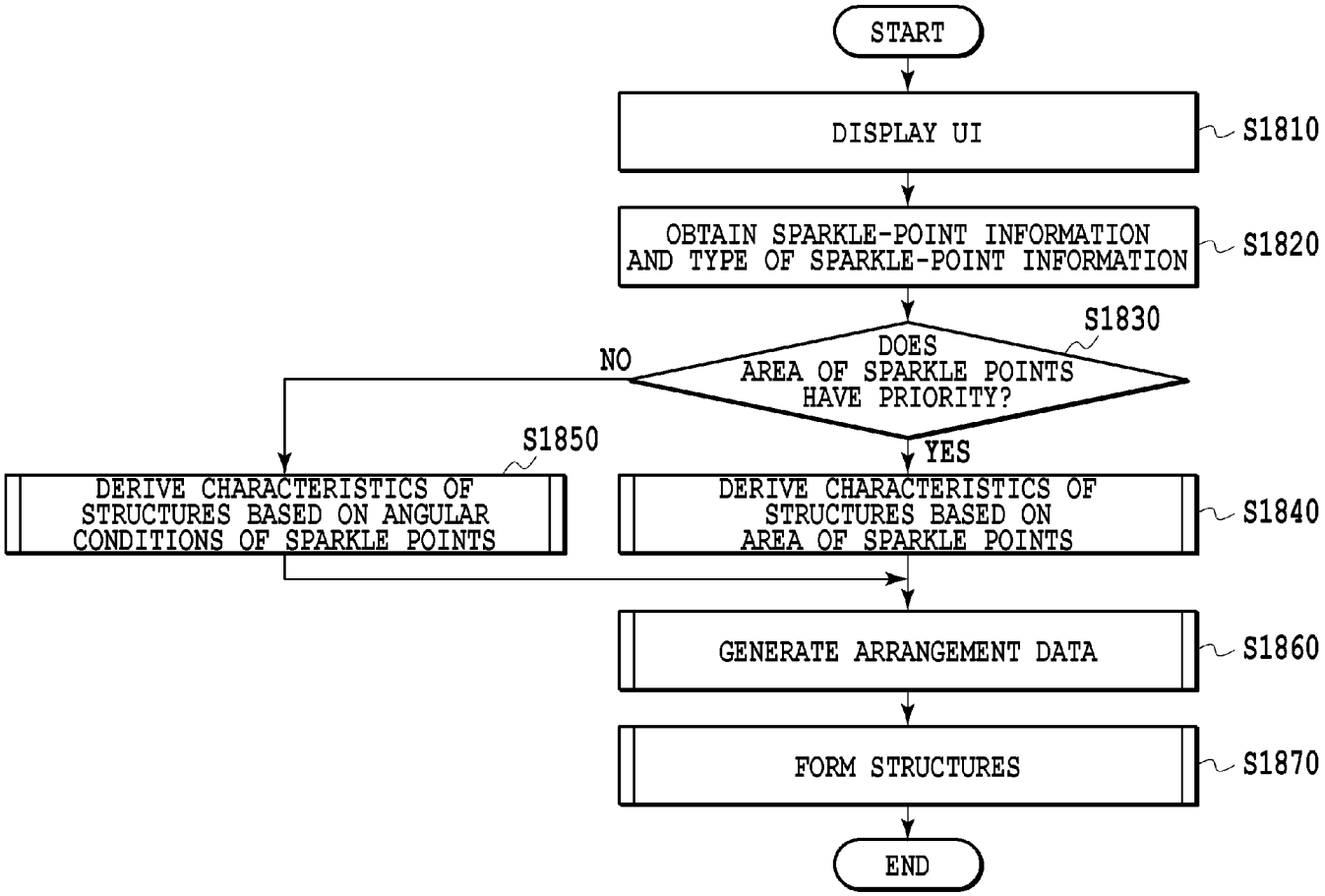
FIG. 18 is a flowchart showing the procedure of processes by the image processing apparatus in Embodiment 4.
Figure 19:
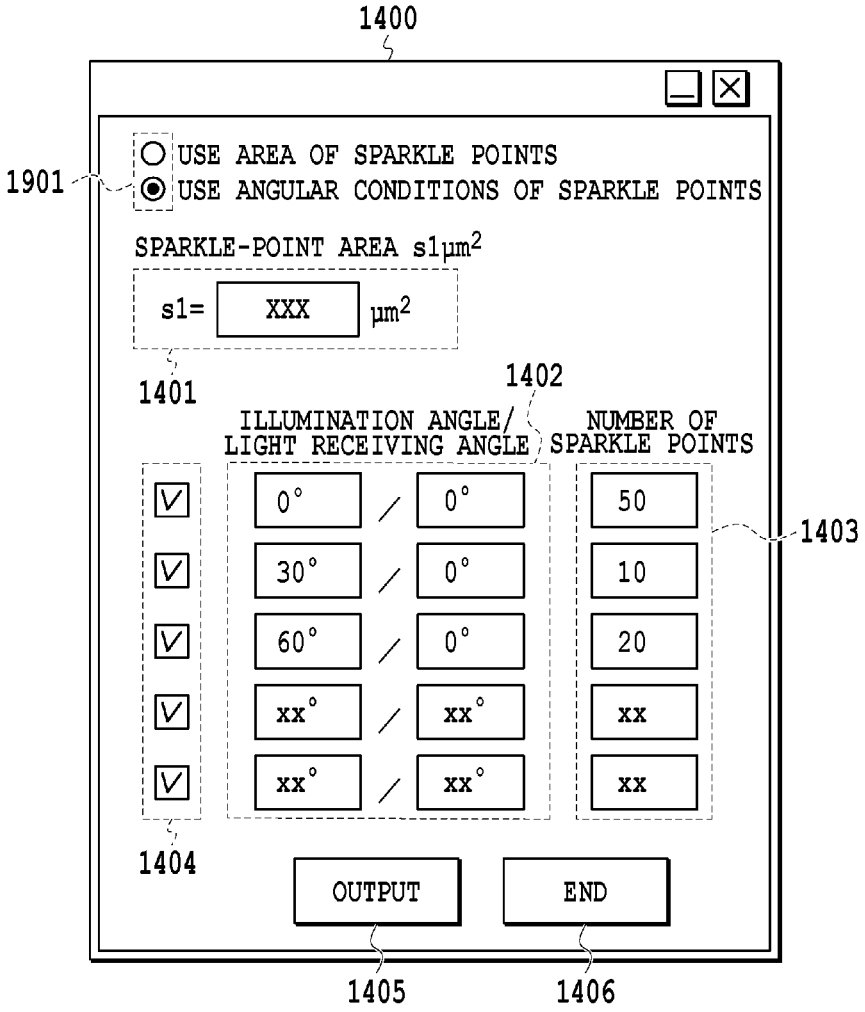
FIG. 19 is a diagram showing an example of a UI in Embodiment 4.

FIG. 18 is a flowchart showing the procedure of processes by the image processing apparatus 1 in this embodiment. Details of the procedure of the processes by the image processing apparatus 1 in this embodiment will be described below with reference to FIG. 18. In S1810, in order that the image processing apparatus 1 can receive input of necessary information, the UI display unit 301 displays a UI prompting the user to input the necessary information on a display 25. FIG. 19 shows an example of a UI 1400 prompting the user input in this embodiment. The UI 1400 in Embodiment 4 is the same as that shown in FIG. 14A except the configuration of an input region 1901. Since the input region 1901 is the difference between the UI 1400 in this embodiment and those in Embodiments 2 and 3, only its content will be described. The input region 1901 is a region to receive input of the type of sparkle point information to be preferentially used from the user. An output button 1405 is a region to receive an instruction to start printing on a print medium. An end button 1406 is a region to receive an instruction to terminate the series of processes shown in FIG. 18. The procedure proceeds to S1820 after the user inputs the sparkle point information into input regions 1401 to 1404, further inputs the type of sparkle point information into the input region 1901, and then presses the output button 1405.

In S1820, a data obtaining unit 302 obtains the sparkle point information and the type of sparkle point information inputted in S1810.

In S1830, the priority determination unit 1701 determines the type of sparkle point information to be preferentially used in deriving the characteristics of the structures, from the type of sparkle point information obtained in S1820.

As shown in FIG. 9, the inclination angles of the structures to be formed on a print medium are dependent on the size of a dot of ink that can be ejected by a printing device 24 and the combination of such ink dots. For this reason, using the size of sparkle points on the target object as an input parameter, the image processing apparatus 1 may perform control such that structures with only a small difference in size from the sparkle points on the target object are formed on the print medium. However, there is a possibility that the differences between the angular conditions for observing the sparkle points on the target object and the angular conditions for visually recognizing the structures as sparkle points may be large. On the other hand, using the angular conditions for observing the sparkle points on the target object as input parameters, the image processing apparatus 1 may perform control such that the differences between the angular conditions for observing the sparkle points on the target object and the angular conditions for visually recognizing the structure as sparkle points will be small. However, there is a possibility that the difference between the size of the sparkle points on the target object and the area of the structures may be large. In this embodiment, in S1830, the priority determination unit 1701 determines the type of sparkle point information to be preferentially used in the presence of the trade-off relation between the two types of sparkle point information resulting from the number of ink dots to be laminated and the combination of ink dots. Note that the embodiment is not limited to the approach in which the image processing apparatus 1 receives input of the type of sparkle point information. For example, it is also possible to employ an approach in which the image processing apparatus 1 uses a UI with a slide bar or the like to receive the degree of priority of each type of sparkle point information. In this case, a conceivable approach may involve a process of variably setting an allowable error for the accuracy of the structures to be expressed on a print medium in accordance with the degree of priority of each type of sparkle point information.

If it is determined in S1830 that the area of the sparkle points has priority (S1830: YES), the procedure proceeds to S1840, in which a structure-characteristic derivation unit 303 derives the characteristics of the structures to be formed on the print medium, based on the sparkle point area obtained in S1820. Note that details of the process in S1840 are the same as those in S30, and description thereof will therefore be omitted.

If it is determined in S1830 that the angular conditions have priority (S1830: NO), the procedure proceeds to S1850, in which the structure-characteristic derivation unit 303 derives the characteristics of the structures to be formed on the print medium, based on the angular conditions obtained in S1820. Note that details of the process in S1850 are the same as those in S1531 to S1536, and description thereof will therefore be omitted.

In S1860, an arrangement-data generation unit 304 derives the arrangement of the structures to be formed on the print medium, in accordance with the characteristics of the structures derived in S1840 or S1850. The arrangement-data generation unit 304 allocates structures associated with the given inclination angles to rectangular blocks in divided image data, to thereby generate structure arrangement data specifying the arrangement of the structures. Note that details of the process in S1860 are the same as those in S40, and description thereof will therefore be omitted.

In S1870, a printing-device control unit 305 instructs the printing device 24 to perform image forming operation, based on the structure arrangement data generated in S1860. Upon receipt of the instruction, the printing device 24 forms the structures on the print medium. Note that details of the process in S1870 are the same as those in S50, and description thereof will therefore be omitted.

As described above, in this embodiment, the method of deriving the characteristics of the structures is switched by determining which one of the area of the sparkle points and the angular conditions for observing the sparkle points has priority. With this configuration, it is possible to determine whether to give priority to reproduction focusing on the size of the sparkle points in the formation of the structures or to give priority to reproduction focusing on the angular conditions for observing the sparkle points in the formation of the structures, while reflecting the user's intension.

Embodiment 5

In each of Embodiments 1 to 4, the description has been given of the approach in which the sparkle point information is received as a parameter (s) of a quantitative value (s) inputted into a UI. Description will now be given of an approach in which an image processing apparatus 1 in this embodiment receives input of reference images instead of a parameter (s) of a quantitative value (s) inputted into a UI, extracts sparkle point information from the received reference images, and performs processes based on the extracted sparkle point information. This embodiment will be described by using the captured image shown in FIG. 6A as an example of the reference images to be received. However, it is also possible to employ an approach in which the reference images are images generated by a CAD system or the like, for example. The differences in processing between this embodiment and Embodiments 1 to 3 are a process of displaying a UI by a UI display unit 301 (S2110), a process of obtaining reference images by a data obtaining unit 302 (S2120), and a process of extracting sparkle point information by a sparkle point-information extraction unit 2001 (S2130). Only the contents of these processes will be described below.

Figure 20:
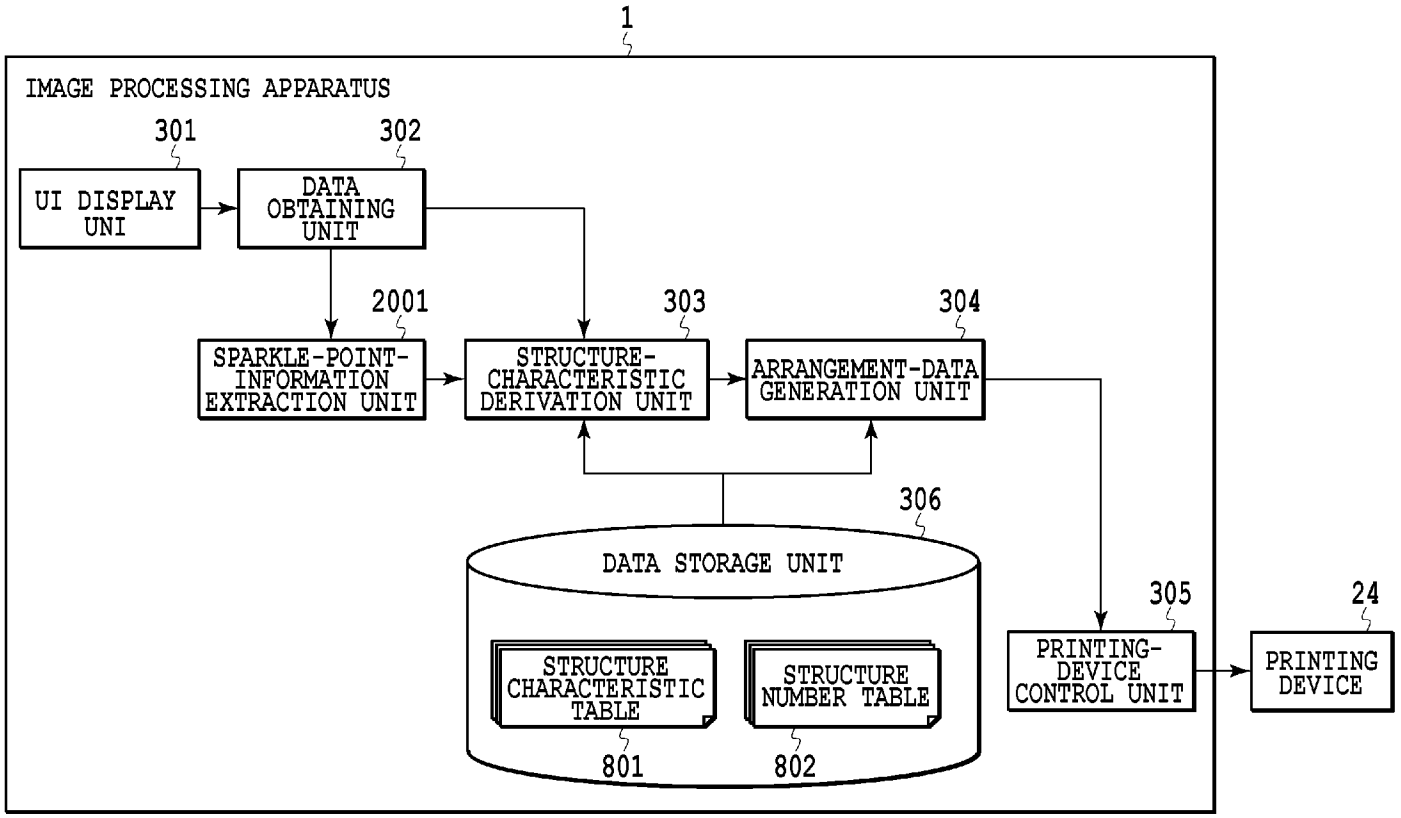
FIG. 20 is a block diagram showing the software function configuration of an image processing apparatus in Embodiment 5.

FIG. 20 is a block diagram showing the software function configuration of the image processing apparatus 1 in this embodiment. The only difference from the software function configurations of the image processing apparatuses 1 in Embodiments 1 to 3 is the configuration of the sparkle point-information extraction unit 2001. The sparkle point-information extraction unit 2001 in this embodiment is configured to extract sparkle point information from inputted reference images.

(Operation of Image Processing Apparatus)

Figure 21A:
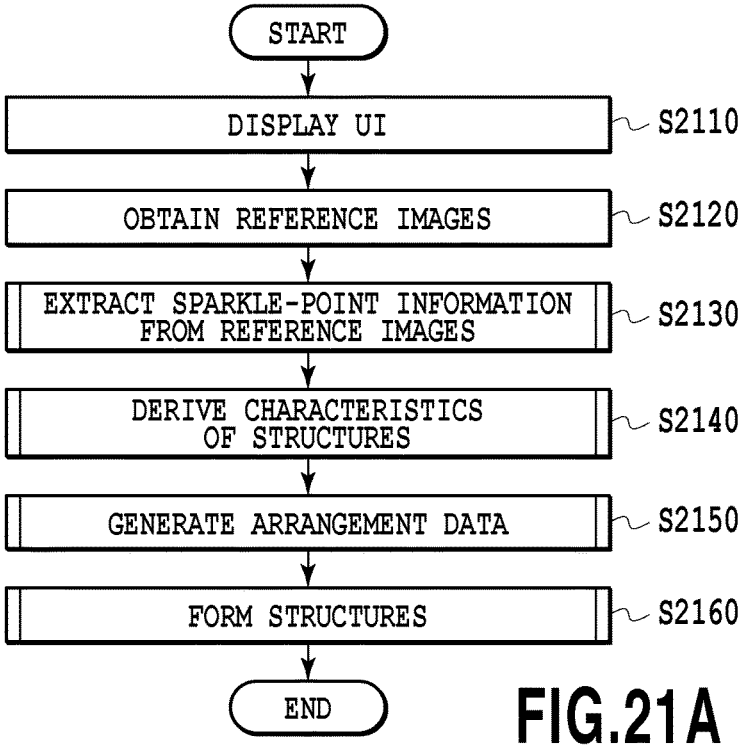
FIG. 21A is a flowchart showing the procedure of processes by the image processing apparatus in Embodiment 5.
Figure 22:
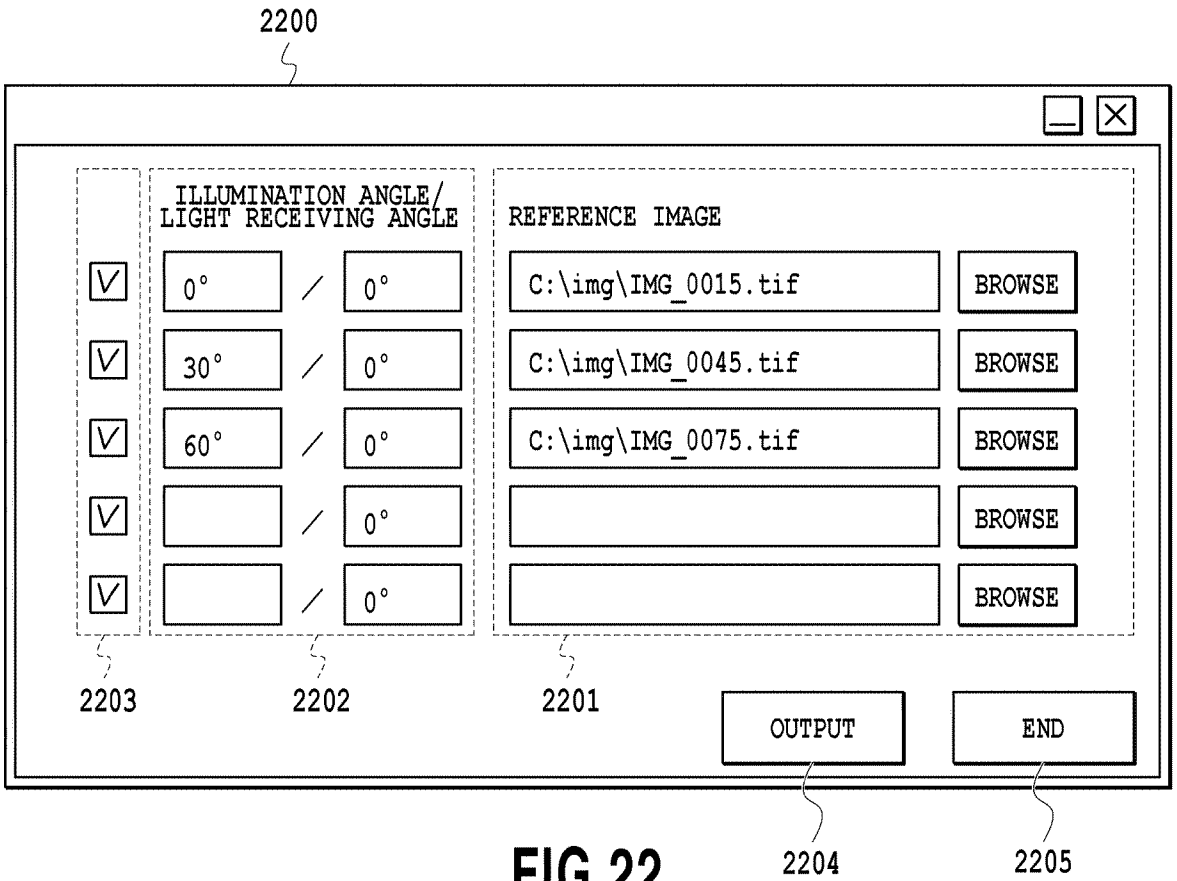
FIG. 22 is a diagram showing an example of a UI in Embodiment 5.

FIG. 21A is a flowchart showing the procedure of processes by the image processing apparatus 1 in this embodiment. Details of the procedure of the processes by the image processing apparatus 1 in this embodiment will be described below with reference to FIG. 21A. In S2110, in order that the image processing apparatus 1 can receive input of necessary information, the UI display unit 301 displays a UI prompting the user to input the necessary information on a display 25. FIG. 22 shows an example of a UI 2200 in this embodiment. In the UI 2200 in FIG. 22, an input region 2201 is a region to receive input of the storage locations of reference images. File paths and the like are examples of the storage locations of the reference images. An input region 2202 is a region to receive input of angular conditions under which the corresponding reference images are obtained. An output button 2204 is a region to receive an instruction to start printing on a print medium. An end button 2205 is a region to receive an instruction to terminate the series of processes shown in FIG. 21A. The procedure proceeds to S2120 after the user inputs information into the input regions 2201 to 2203 and then presses the output button 2204. The UI 2200 in this embodiment further includes the input region 2203 to receive input of instructions as to whether or not the values inputted in the input regions 2201 and 2202 are to be used in the processes in and after S2140.

In S2120, the data obtaining unit 302 obtains reference images from which to extract sparkle point information, from the storage locations inputted in S2110. In S2120, the data obtaining unit 302 obtains image data of each reference image from its storage location or converts each obtained reference image into image data. In doing so, the data obtaining unit 302 also obtains the angular conditions of the reference images. In this embodiment, in a case where each reference image is an image captured by a digital camera or the like, for example, its angular condition is, for example, a capturing condition such as the illumination angle and the light receiving angle in capturing the image.

In S2130, the sparkle point-information extraction unit 2001 extracts the sparkle point information on the target object based on the reference images and the angular conditions of the reference images obtained in S2120. Note that, as in the foregoing embodiments, the sparkle point information indicates the area of sparkle points obtained by observing the target object, the angular conditions for observing the target object, and the numbers of sparkle points under these angular conditions. Details of the process of extracting the sparkle point information will be described later.

In S2140, a structure-characteristic derivation unit 303 derives the characteristics of structures to be formed on a print medium, based on the sparkle point information extracted in S2130. Note that details of the process in S2140 are the same as those in S30 or S1531 to S1536, and description thereof will therefore be omitted.

In S2150, an arrangement-data generation unit 304 derives the arrangement of the structures to be formed on the print medium, in accordance with the characteristics of the structures derived in S2140. The arrangement-data generation unit 304 allocates structures associated with the given inclination angles to rectangular blocks in divided image data, to thereby generate structure arrangement data specifying the arrangement of the structures. Note that details of the process in S2150 are the same as those in S40, and description thereof will therefore be omitted.

In S2160, a printing-device control unit 305 instructs a printing device 24 to perform image forming operation, based on the structure arrangement data generated in S2150. Upon receipt of the instruction, the printing device 24 forms the structures on the print medium. Note that details of the process in S2160 are the same as those in S50, and description thereof will therefore be omitted.

(Content of Control of Sparkle Point-Information Extraction Unit)

Figure 21B:
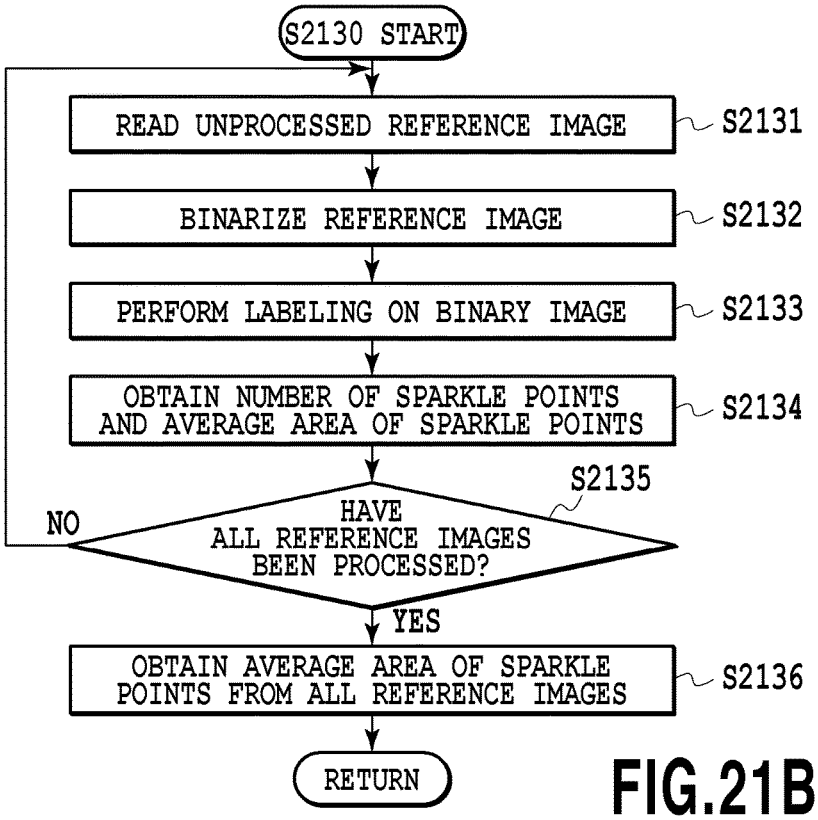
FIG. 21B is a flowchart showing the procedure of a process of extracting sparkle point information in Embodiment 5.

Next, the process of extracting the sparkle point information (S2130) in this embodiment will be described with reference to FIG. 21B. In S2131, the sparkle point-information extraction unit 2001 reads a reference image that has not yet been subjected to sub-processes in S2132 to S2134 among the reference images obtained in S2120. In this embodiment, the reference images from which to extract the sparkle point information are single-channel grayscale images, and preferably used are such images holding 8-bit (0 to 255) pixel values positively correlated to the luminance values. Meanwhile, these reference images are in an image information record format such as Exif, and the image resolution is held in the data of the reference images.

In S2132, the sparkle point-information extraction unit 2001 generates a binary image by binarizing the reference image read in S2131. The sparkle point-information extraction unit 2001 performs threshold processing on each pixel of the reference image to replace the pixel values of those pixels at and above a threshold with 255 and replace the pixel values of those pixels below the threshold with 0. The threshold is adaptively determined based on a histogram of the pixel values of the reference image. For example, the threshold can be determined using discriminant analysis. Note that there are many publicly-known binarization techniques such as a mode method in which a pixel value at a valley in a histogram is set as a threshold, and the binarization method is not limited to the above method. In the binary image obtained by the binarization, those regions with a pixel value of 255 correspond to sparkle points.

In S2133, the sparkle point-information extraction unit 2001 performs labeling on the binary image generated in S2132. The sparkle point-information extraction unit 2001 performs 4-connected-component labeling on those pixels with a pixel value of 255 in the binary image. As a result, the same label is given to a pixel having a pixel value of 255 and neighboring pixels being adjacent thereto in the top-bottom direction or the right-left direction and having a pixel value of 255. Note that the labeling may be 8-connected-component labeling, in which the same label is given to a pixel having a pixel value of 255 and neighboring pixels adjacent thereto diagonally and having a pixel value of 255, in addition to the neighboring pixels adjacent in the top-bottom direction or the right-left direction.

In S2134, from the result of the labeling in S2133, the sparkle point-information extraction unit 2001 obtains the number of sparkle points in the binary image and the average area of the sparkle points, and associates the number of sparkle points and the average area of the sparkle points thus obtained with the corresponding angular condition inputted in S2110. More specifically, assuming that the shape of the sparkle points obtained in S2133 is square, the sparkle point-information extraction unit 2001 obtains the area of the sparkle points based on the length of one side thereof. From the result of the labeling in S2133, the sparkle point-information extraction unit 2001 obtains the number of labels given to the sparkle points and the average number of pixels among the labeled groups of pixels. Here, the number of labels given to the sparkle points is equal to the number of sparkle points. Moreover, the sparkle point-information extraction unit 2001 performs calculation with Mathematical Formula (1) by using the average number of pixels among the labeled groups of pixels and the resolution of the reference image, to thereby obtain the area sparkle point corresponding to the reference image. Then, the sparkle point-information extraction unit 2001 stores the number of sparkle points and the sparkle point area thus obtained into a data storage unit 306 in association with the corresponding angular condition received in S2110.

In S2135, the sparkle point-information extraction unit 2001 determines whether or not all the reference images have been processed. The sparkle point-information extraction unit 2001 proceeds to S2136 if determining that all the reference images have been processed (S2135: YES). The sparkle point-information extraction unit 2001 returns to the sub-process in S2131 if determining that not all the reference images have been processed (S2135: NO).

In S2136, the sparkle point-information extraction unit 2001 reads the sparkle point areas corresponding to the reference images stored in S2134 out of the data storage unit 306 and obtains the average sparkle point area for all the reference images. The sparkle point-information extraction unit 2001 stores the obtained average sparkle point area for all the reference images into the data storage unit 306. After the sub-process in S2136, the procedure returns to the processing in the flowchart in FIG. 21A. Then, based on the average sparkle point area extracted in S2130, the characteristics of the structures to be formed on the print medium are derived.

As described above, in this embodiment, sparkle point information is extracted from inputted reference images, and the characteristics of the structures are derived based on the extracted sparkle point information. With this configuration, the image processing apparatus 1 in this embodiment can easily extract sparkle point information from captured images obtained by imaging the target object or the like, without having the user spend time for complicated work. In this way, the image processing apparatus 1 in this embodiment can form structures that express the sense of sparkle reproducing the sense of sparkle of the target object with a certain level of quality.

Embodiment 6

In the foregoing embodiments, sparkle point information is obtained, and image processing for forming structures on a print medium is performed. In this embodiment, description will be given of an example where color information is obtained in addition to sparkle point information, and a color image and structures are formed. The differences in processing between this embodiment and Embodiments 1 to 5 are a process of displaying a UI by a UI display unit 301 (S2401) to a process of determining the amounts of color inks by a color-ink-amount determination unit 2301 (S2403). Hence, only the contents of these processes will be described below. Note that a printing device 24 is equipped with CMYK inks as the color inks.

Figure 23:
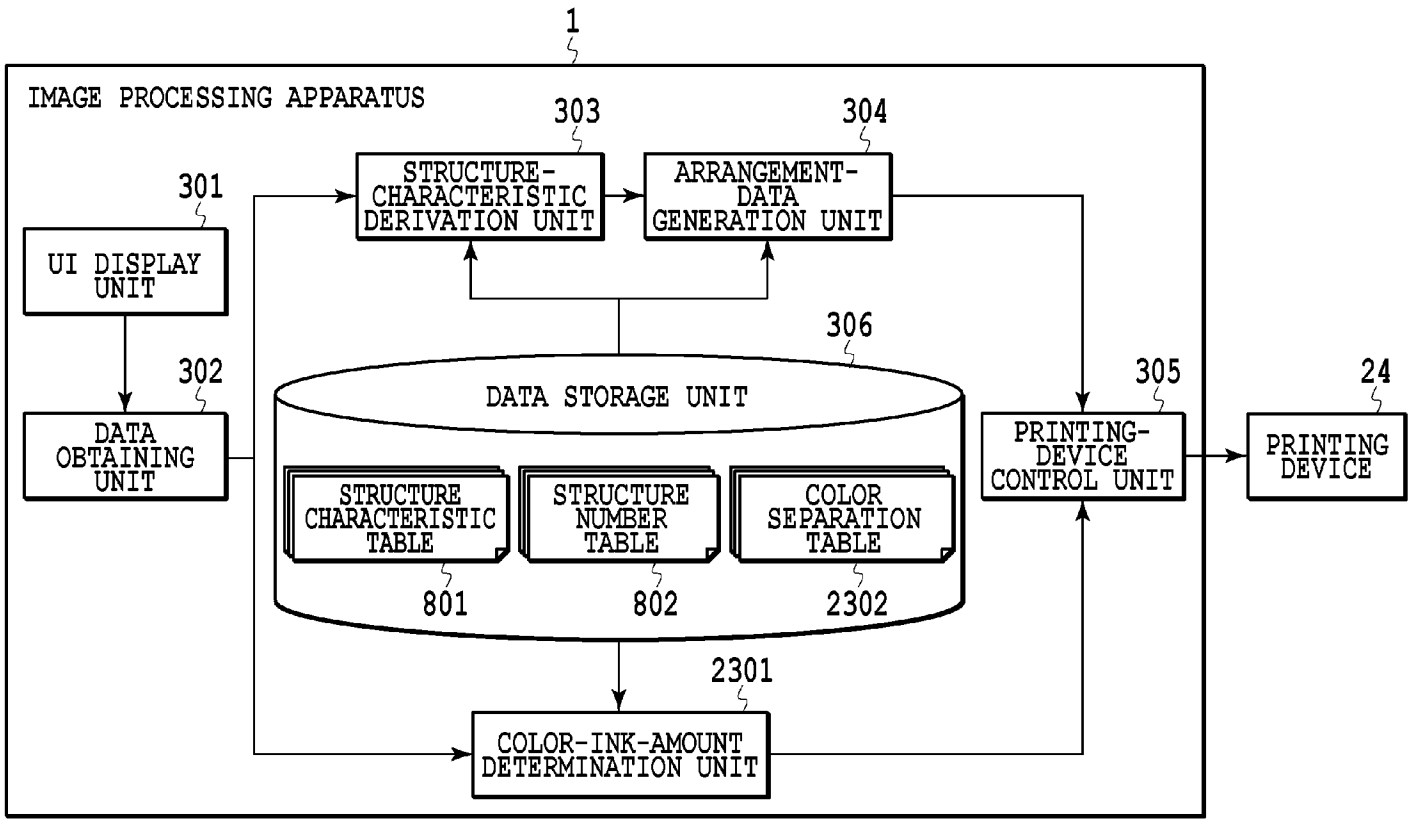
FIG. 23 is a block diagram showing the software function configuration of an image processing apparatus in Embodiment 6.

FIG. 23 is a block diagram showing the software function configuration of an image processing apparatus 1 in this embodiment. The difference from the software function configurations of the image processing apparatuses 1 in Embodiments 1 to 5 is the configuration of the color-ink-amount determination unit 2301 color separation table 2302. The color-ink-amount determination unit 2301 is configured to determine the amounts of inks for a color image to be formed under structures.

(Operation of Image Processing Apparatus)

Figure 24:
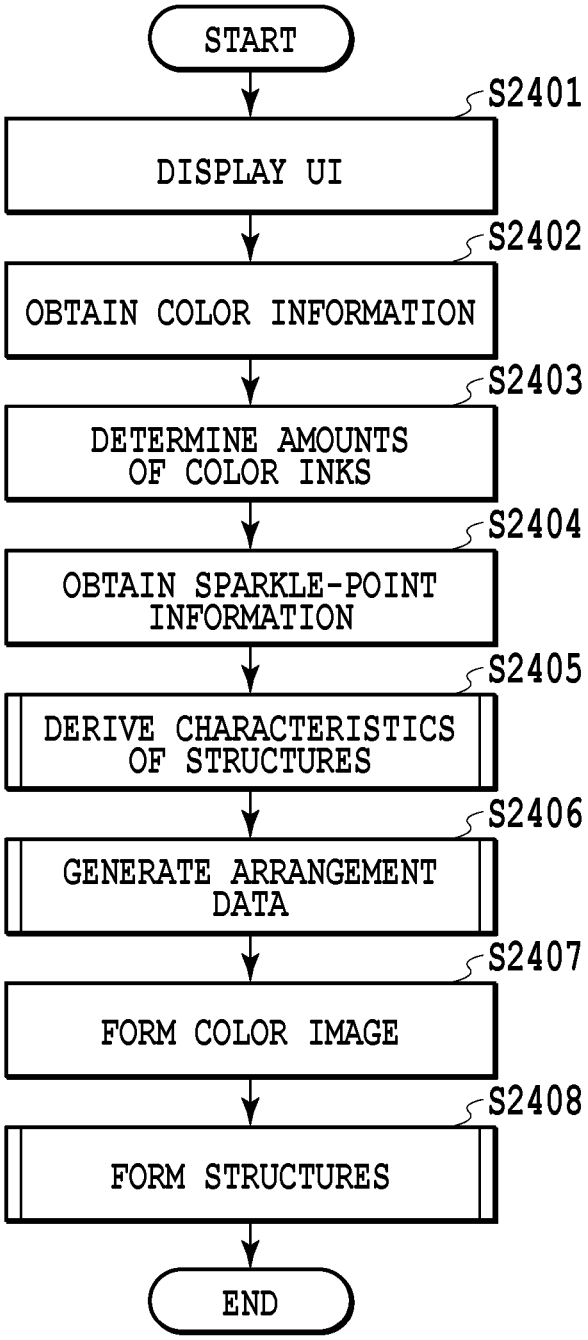
FIG. 24 is a flowchart showing the procedure of processes by the image processing apparatus in Embodiment 6.

FIG. 24 is a flowchart showing the procedure of processes by the image processing apparatus 1 in this embodiment. Details of the procedure of the processes by the image processing apparatus 1 in this embodiment will be described below with reference to FIG. 24.

Figure 25:
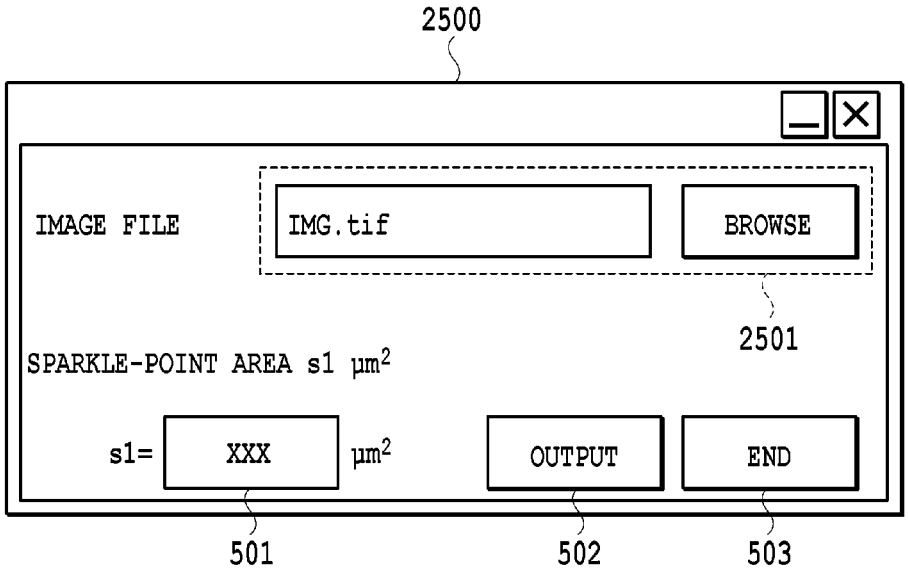
FIG. 25 is a diagram showing an example of a UI in Embodiment 6.

In S2401, in order that the image processing apparatus 1 can receive input of necessary information, the UI display unit 301 displays a UI prompting the user to input the necessary information on a display 25. FIG. 25 shows an example of a UI 2500 prompting the user input in this embodiment. The UI 2500 in Embodiment 6 is the same as the UI shown in FIG. 5 except the configuration of an input region 2501. The input region 2501 is a region to receive input of the storage location of a reference image containing color information. A file path and the like are examples of the storage location of the reference image. The procedure proceeds to S2402 after the storage location of the reference image is inputted into the input region 2501 and, as in Embodiment 1, the sparkle point information is inputted into an input region 501, and then an output button 502 is pressed.

In S2402, a data obtaining unit 302 obtains the reference image, from which to form a color image, from the storage location inputted in S2401. In S2402, the data obtaining unit 302 obtains image data of the reference image from the storage location or converts the obtained reference image into image data. The reference image used in this embodiment is an image of four channels in total in which are recorded RGB values indicating the color information and binary information identifying regions to form structures and regions not to form the structures. Note that the image format is not limited to this format. For example, an image holding CIELab values instead of RGB values may be used. Also, in a case where the regions to form the structures are not set adaptively, a normal image holding only RGB values and not containing the above binary information may be used. Further, in a case where the color information to be expressed is uniform irrespective of the coordinate, such color information can be obtained by inputting a single combination of RGB values into a UI.

In S2403, the color-ink-amount determination unit 2301 reads a color separation table 2302 out of a data storage unit 306 and determines the amounts of color inks corresponding to the RGB values at each coordinate on the reference image. In the color separation table 2302, amounts of CMYK inks are associated with 729 colors in total obtained by slicing RGB into 9 slices, for example. The amounts of CMYK inks corresponding to any RGB values are calculated using a publicly-known interpolation process. Note that the color separation table 2302 is held in the data storage unit 306 in advance.

In S2404, the data obtaining unit 302 obtains the sparkle point information inputted in S2401. Note that details of the process in S2404 are the same as those in S20, and description thereof will therefore be omitted.

In S2405, a structure-characteristic derivation unit 303 derives the characteristics of the structures from the sparkle point information obtained in S2404. Note that details of the process in S2405 are the same as those in S30, and description thereof will therefore be omitted.

In S2406, an arrangement-data generation unit 304 generates structure arrangement data in accordance with the characteristics of the structures derived in S2405. Note that details of the process in S2406 are the same as those in S40, and description thereof will therefore be omitted. Here, the image data generated in S41 in this embodiment covers only the regions to form the structures, which are identified by the binary information contained in the color image obtained in S2402.

In S2407, a printing-device control unit 305 sends the printing device 24 the amounts of color inks at each pixel calculated in S2403 and instructs the printing device 24 to perform image forming operation. As mentioned above, CMYK inks are used as the color inks. The printing device 24 forms the color image on a print medium 1208 by controlling the ejection of a record head in accordance with the received amounts of color inks at each pixel.

In S2408, the printing-device control unit 305 determines the number of laminations at each coordinate based on the structure arrangement data generated in S2406, sends the printing device 24 that information and the regions to form the structures, and instructs the printing device 24 to perform image forming operation. Note that details of the process in S2408 and the image forming operation by the printing device 24 are the same as those in S50 and the operation described in Embodiment 1, and description thereof will therefore be omitted.

As described above, in this embodiment, a color image is formed, and structures are formed on top of the color image. With this configuration, an image having any metallic color and the sense of sparkle can be formed.

Embodiment 7

In the foregoing embodiments, the user directly inputs sparkle point information, and the image processing apparatus 1 determines the characteristics of the structures based on the inputted sparkle point information. In this embodiment, description will be given of an approach in which names representing textures differing in the sense of sparkle (hereinafter, referred to as "modes") are displayed, and the user optionally selects one of these modes to indirectly specify and input sparkle point information. The differences between this embodiment and the foregoing embodiments are a process of displaying a UI by a UI display unit 301 (S10) and a process of obtaining sparkle point information by a data obtaining unit 302 (S20). Hence, only the contents of these processes will be described below.

(Operation of Image Processing Apparatus)

Figure 26:
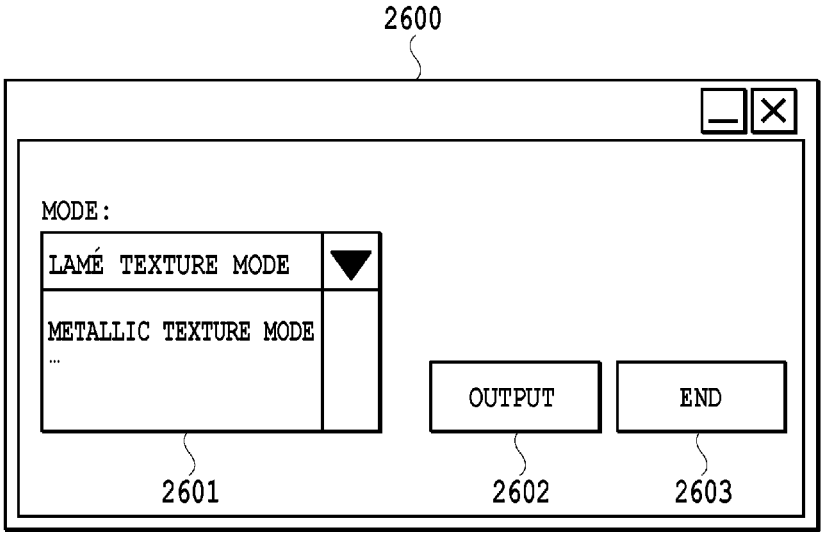
FIG. 26 is a diagram showing an example of a UI in Embodiment 7.

In S10, in order that an image processing apparatus 1 can receive input of necessary information, the UI display unit 301 displays a UI prompting the user to input the necessary information on a display 25. FIG. 26 shows an example of a UI 2600 prompting the user input in this embodiment. An input region 2601 is a region to receive a mode selected by the user from preset modes. A combo box or the like can be used for the input region 2601, for example. The procedure proceeds to S20 after the user selects the mode in the input region 2601 and then presses an output button 2602. Thus, in other words, the UI 2600, which is displayed on the display 25 by the UI display unit 301, can be said to function as a selection receiving unit configured to receive a selected mode.

In S20, the data obtaining unit 302 refers to a table in which the modes and pieces of sparkle point information are associated with each other, and obtains the sparkle point information corresponding to the mode received from the user in S10. In a conceivable example of the correspondence between the modes and the pieces of sparkle point information, the table may hold a lame texture mode and a metallic texture mode, for example, and a larger sparkle point area is set for the lame texture mode than for the metallic texture mode. In an alternative conceivable example of the correspondence between the modes and the pieces of sparkle point information, the table may hold a glaring mode and a glittering mode, and in the glaring mode the degree of variance in a frequency distribution of the inclination angles of the structures to be arranged is high, and change of sparkle points with change in angular condition is visually recognized from structures with a wide range of inclination angles, whereas in the glittering mode the degree of variance is low, and change of sparkle points is visually recognized from structures with a limited, narrow range of inclination angles. Note that the data storage unit 306 or the like holds the table in which the modes and the pieces of sparkle point information are associated with each other.

In S30, a structure-characteristic derivation unit 303 derives the characteristics of structures to be formed on a print medium, based on the sparkle point information obtained in S20. In S40, an arrangement-data generation unit 304 generates data on the arrangement of the structures to be formed on the print medium, in accordance with the characteristics of the structures derived in S30. In S50, a printing-device control unit 305 determines the number of laminations at each coordinate based on the structure arrangement data generated in S40, sends that information to a printing device 24, and instructs the printing device 24 to perform image forming operation.

As described above, the image processing apparatus 1 in this embodiment holds names representing different textures and corresponding pieces of sparkle point information in advance. The user can easily select between the textures differing in the sense of sparkle by selecting its name, and the texture will be reproduced.

Embodiment 8

In the foregoing embodiments, the structures for expressing the sense of sparkle are formed based on the size of sparkle points or the angular conditions for observing the sparkle points. In this embodiment, description will be given of an approach in which characteristics of structures to be formed on a print medium are derived by using sparkle point intensity indicating the strength of reflected light from sparkle points. In the following, description will be simplified or omitted for parts that are common to Embodiments 1 to 7 above, and features unique to this embodiment will be mainly described.

Figure 27:
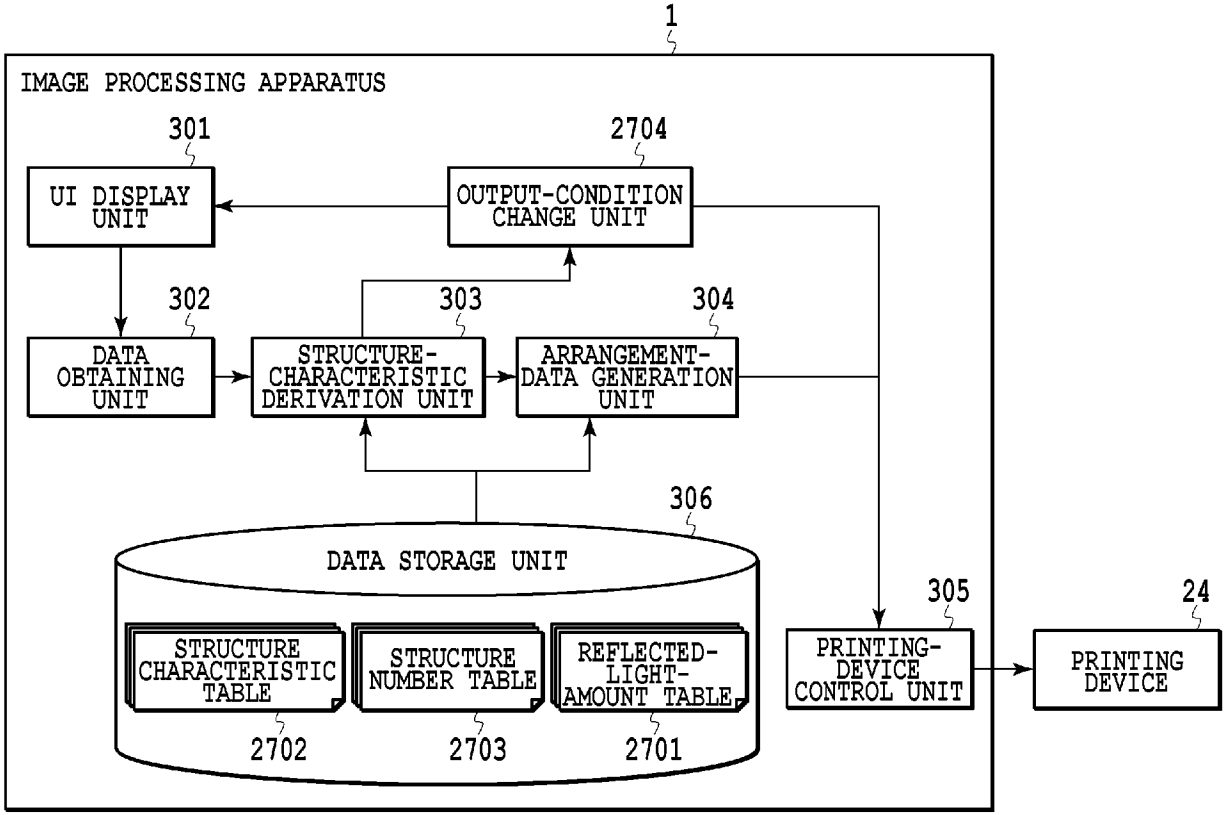
FIG. 27 is a block diagram showing the software function configuration of an image processing apparatus in Embodiment 8.

FIG. 27 is a block diagram showing the software function configuration of an image processing apparatus 1 in this embodiment. The differences from the software function configuration of the image processing apparatus 1 in Embodiment 1 are that a data obtaining unit 302 obtains sparkle point intensity as sparkle point information, as well as the configurations of a reflected-light-amount table 2701 and an output-condition change unit 2704. In the reflected-light-amount table 2701, which is held in a data storage unit 306, pieces of print medium material information and amounts of reflected light per unit area are associated with each other. The output-condition change unit 2704 is configured to prompt the user to input an output condition for controlling the appearance of sparkle points or to change such an output condition in a case where it is impossible to form structures corresponding to the obtained sparkle point intensity.

(Operation of Image Processing Apparatus)

Figure 28B:
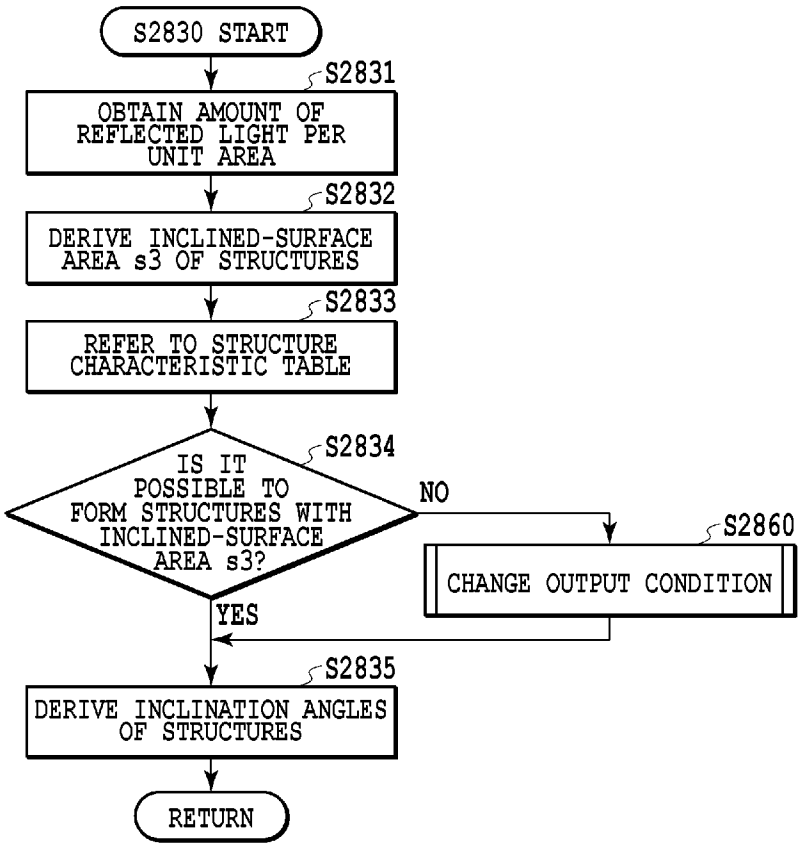
FIG. 28B is a flowchart showing the procedure of a process of deriving characteristics of structures in Embodiment 8.
Figure 28A:
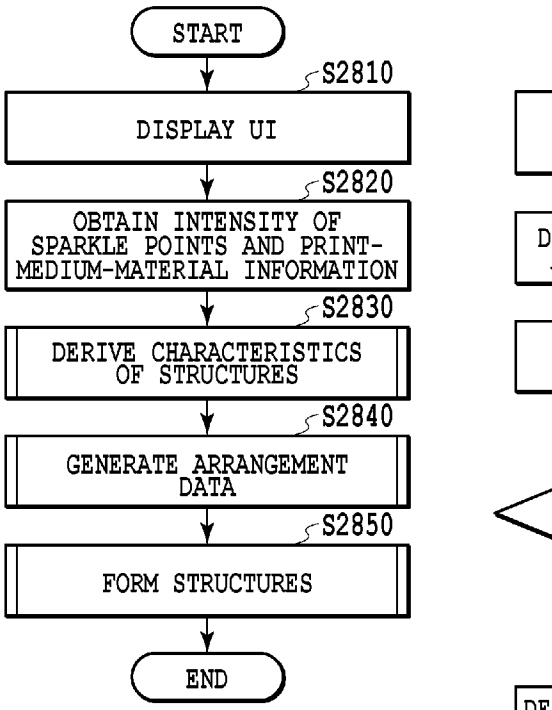
FIG. 28A is a flowchart showing the procedure of processes by the image processing apparatus in Embodiment 8.
Figure 29:
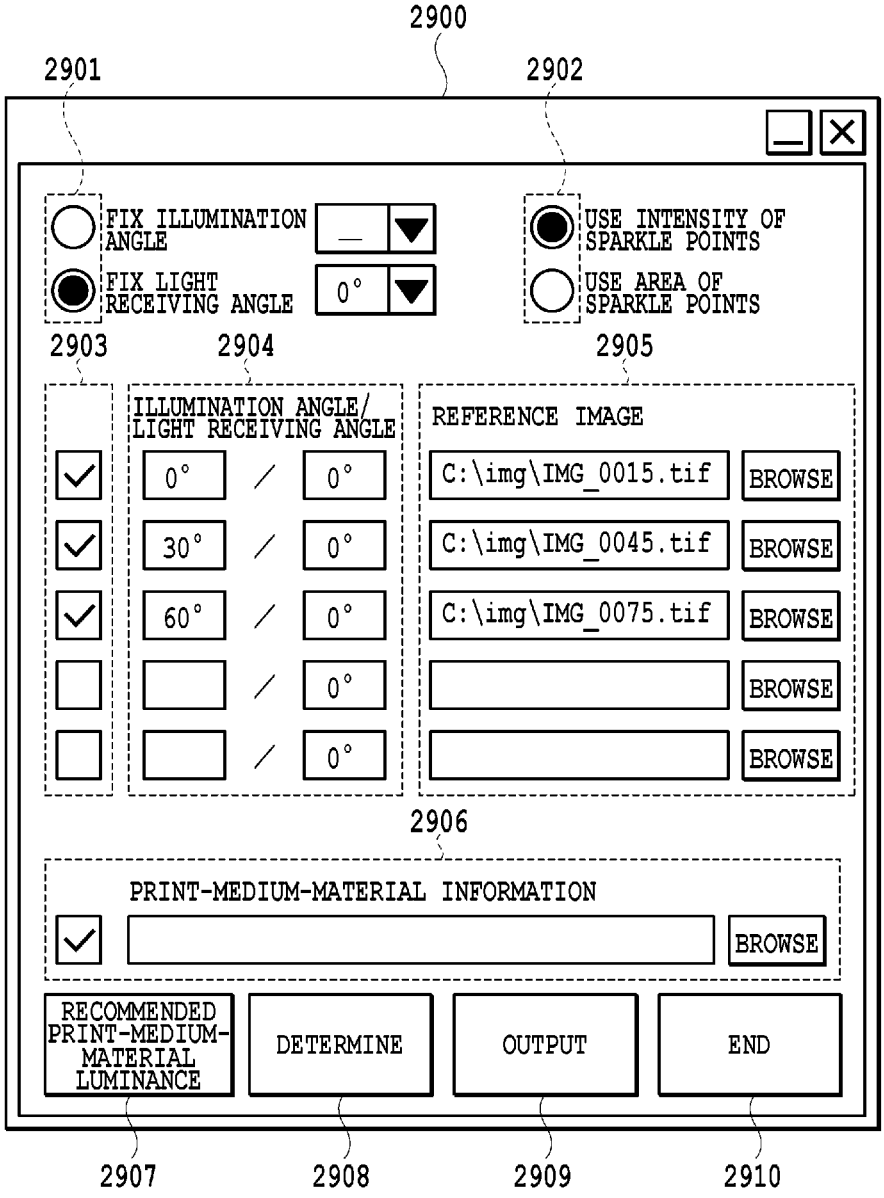
FIG. 29 is a diagram showing an example of a UI in Embodiment 8.

FIG. 28A is a flowchart showing the procedure of processes by the image processing apparatus 1 in this embodiment. Detail of the procedure of the processes by the image processing apparatus 1 in this embodiment will be described below with reference FIG. 28A. In S2810, a UI display unit 301 displays a UI prompting the user to input necessary information on a display 25. FIG. 29 shows an example of a UI 2900 in this embodiment. The UI 2900 in FIG. 29 includes input regions described in the foregoing embodiments such as an input region 2902 to receive input of the type of sparkle point information to be preferentially used and an input region 2905 to receive input of the storage locations of reference images. The UI 2900 in this embodiment further includes an input region 2906 to receive print-medium-material information indicating the type of print medium material.

In S2820, the data obtaining unit 302 obtains the reference images from the storage locations inputted in S2810. The data obtaining unit 302 extracts the sparkle point intensity in the obtained reference images. Instead of extracting the sparkle point intensity in the reference images, the data obtaining unit 302 may receive input of a value indicating sparkle point intensity through the UI 2900. Moreover, as in the foregoing embodiments, the data obtaining unit 302 can also obtain the sparkle point area. In S2820, the data obtaining unit 302 further obtains the print medium information inputted in S2810.

In S2830, a structure-characteristic derivation unit 303 derives the characteristics of the structures to be formed on the print medium, based on the sparkle point intensity and the print medium information obtained in S2820. Note that details of the process in S2830 will be described later.

In S2840, an arrangement-data generation unit 304 generates structure arrangement data in accordance with the characteristics of the structures derived in S2830. The arrangement-data generation unit 304 allocates structures associated with given inclination angles to rectangular blocks in divided image data, to thereby generate structure arrangement data specifying the arrangement of the structures.

Note that details of the process in S2840 are the same as those in S40, and description thereof will therefore be omitted.

In S2850, a printing-device control unit 305 instructs a printing device 24 to perform image forming operation, based on the structure arrangement data generated in S2840. Upon receipt of the instruction, the printing device 24 forms the structures on the print medium. Note that details of the process in S2850 are the same as those in S50, and description thereof will therefore be omitted.

(Content of Control of Structure-Characteristic Derivation Unit)

FIG. 28B is a flowchart showing the procedure of the process by the structure-characteristic derivation unit 303 in this embodiment. Details of the procedure of the process by the structure-characteristic derivation unit 303 in this embodiment will be described below with reference to FIG. 28B.

In S2831, the structure-characteristic derivation unit 303 refers to the reflected-light-amount table 2701, which is stored in the data storage unit 306, and obtains the amount of reflected light per unit area corresponding to the print medium specified in S2820. The amount of reflected light per unit area in this embodiment will now be described with reference to FIG. 30A and FIG. 30B. As described in Embodiment 1, the printing device 24 in this embodiment forms structures by laminating a transparent UV curable ink onto a print medium. Thus, light applied to a transparent structure 3001 travels through the structure 3001 and reaches a print medium 1208. Further, the light having reached the print medium 1208 is reflected on the print medium 1208 and emitted from the inclined surface of the structure 3001. Here, the amount of the reflected light emitted from the inclined surface of the structure 3001 is dependent on the reflection characteristic of the print medium 1208 and the area of the inclined surface of the structure 3001.

Figure 30A:
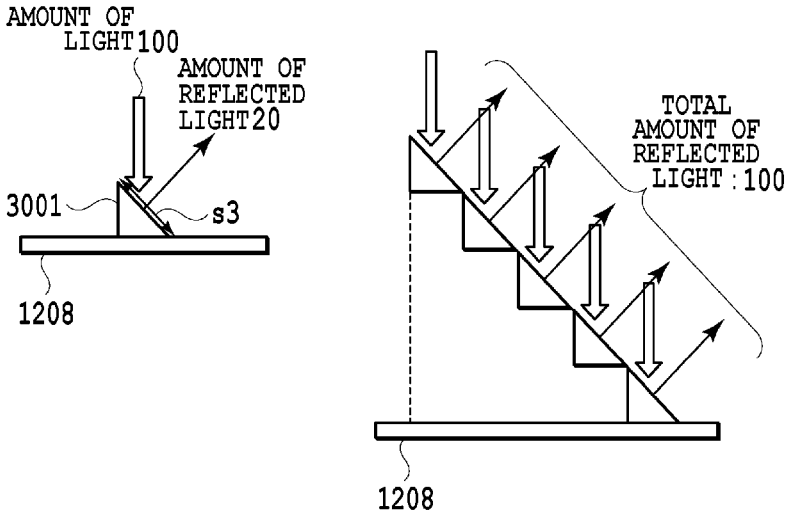
FIG. 30A is a conceptual diagram illustrating the amount of reflected light from a structure.
Figure 30B:
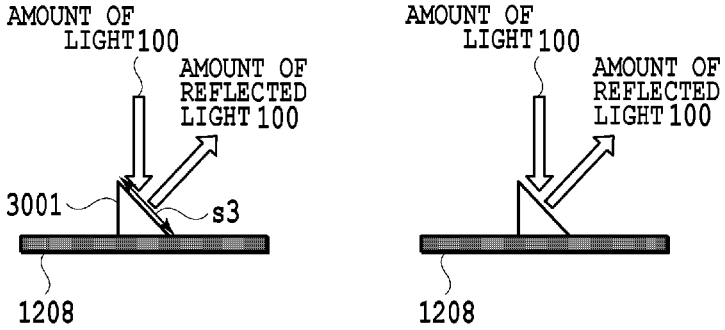
FIG. 30B is a conceptual diagram illustrating the amount of reflected light from the structure.

For example, referring to FIG. 30A, consider a case where the amount of reflected light per unit area (e.g. 1 mm^2) is 20 on the print medium 1208, and the structure 3001, including an inclined surface with an area of 1 mm^2, is formed on the print medium 1208. In this case, if the amount of light applied to the structure 3001 is 100, the amount of reflected light emitted from the inclined surface of the structure 3001 is 20. If the structure 3001 is the smallest structure that can be formed by the printing device 24, it means that a structure including an inclined surface with an area of 5 mm^2 needs to be on the print medium 1208 in order to reproduce a sparkle point intensity of 100 (an amount of reflected light of 100). Now, referring to FIG. 30B, consider a case where the amount of reflected light per unit area is 100 on the print medium 1208, and the structure 3001, including an inclined surface with an area of 1 mm^2, is formed on the print medium 1208. In this case, if the amount of light applied to the structure 3001 is 100, then the amount of reflected light emitted from the inclined surface of the structure 3001 is 100. If the structure 3001 is the smallest structure that can be formed by the printing device 24, it means that a structure including an inclined surface with an area of 1 mm^2 may only be formed on the print medium 1208 in order to reproduce a sparkle point intensity of 100 (an amount of reflected light of 100). As described above, the amount of reflected light per unit area in this embodiment is equal to the amount of reflected light emitted from a structure's inclined surface with a predetermined area (e.g. 1 mm^2).

Next, FIG. 31 shows an example of the reflected-light-amount table 2701. In the reflected-light-amount table 2701 in this embodiment, which is stored in the data storage unit 306, print medium materials on which to form structures and amounts of reflected light per unit area (e.g. 1 mm^2), which is equal to the area of the inclined surface of a structure, are associated with each other. The values of these amounts of reflected light are preset in the data storage unit 306 as the result of measurement performed in advance on the amounts of reflected light from structures formed on basically white print medium materials such as photo glossy paper, print medium materials produced by vapor deposition of metal such as aluminum, and the like.

Referring back to FIG. 28B, in S2832, the structure-characteristic derivation unit 303 derives a structure inclined-surface area s3 necessary for reproducing the desired sparkle point intensity, from the sparkle point intensity obtained in S2820 and the amount of reflected light per unit area obtained in S2831. In this embodiment, the structure inclined-surface area s3 necessary for reproducing the sparkle point intensity obtained in S2820 can be calculated by the following formula.

$$\text{Inclined-surface area } s3 = \text{Sparkle point intensity} + \text{Amount of reflected light per unit area} \quad (4)$$

Figure 32:
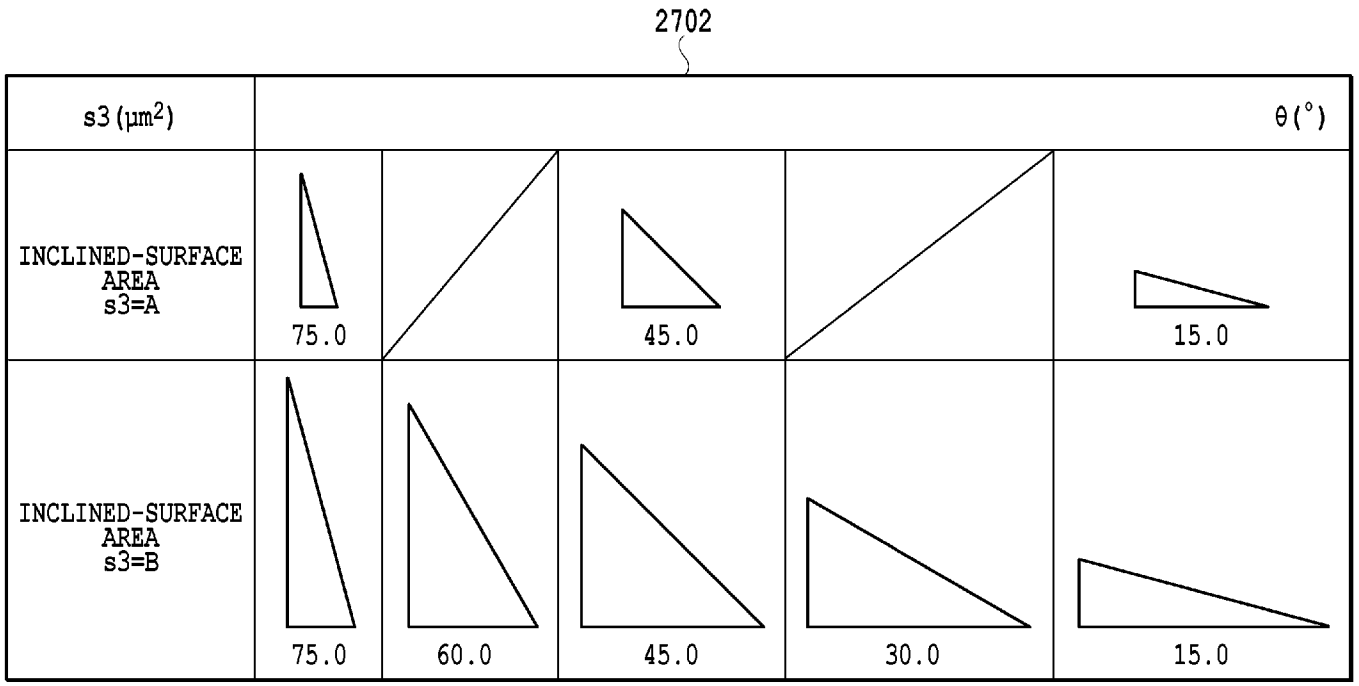
FIG. 32 is a diagram showing an example of a structure characteristic table in Embodiment 8.

In S2833, the structure-characteristic derivation unit 303 refers a structure characteristic table 2702 stored in the data storage unit 306. FIG. 32 shows an example of the structure characteristic table 2702 in this embodiment. In the structure characteristic table 2702 in this embodiment, structure inclined-surface areas s3 that can be formed by the printing device 24 are each associated with a plurality of inclination angles that can be formed on structures with that inclined-surface area. In the structure characteristic table 2702 shown in FIG. 32, an inclined-surface area s3 of A μm^2, for example, is associated with a plurality of inclination angles of 75.0 degrees, 45.0 degrees, and 15 degrees. As shown in FIG. 32, one inclined-surface area s3 is associated with two or more different inclination angles so that the structures formed on the print medium can express the sense of sparkle. Note that the inclination angles in the structure characteristic table 2702 are not limited to the angles shown in FIG. 32.

In S2834, the structure-characteristic derivation unit 303 determines whether or not it is possible to form the structures associated with the inclined-surface area s3. In this embodiment, the larger the inputted sparkle point intensity, the larger the inclined-surface area s3. Here, in a case where the number of structures to be arranged in the structure arrangement data is large, the required number of structures cannot be arranged in the structure arrangement data if the size (base area) of the structures associated with the inclined-surface area s3 is too large. In view of this, the structure-characteristic derivation unit 303 is capable of the determination in S2834 by using, as an upper limit, the inclined-surface area s3 of a structure that can be arranged within a predetermined area. The predetermined area can be an area obtained by dividing image data by the number of structures to be arranged, for example. On the other hand, if the size (base area) of the structures associated with the inclined-surface area s3 is small, there is a possibility that the structures cannot be formed in the required size depending on the performance of the printing device 24. In view of this, the structure-characteristic derivation unit 303 is capable of the determination in S2834 by using, as a lower limit, the inclined-surface area s3 associated with the smallest structure that can be outputted by the printing device 24.

If determining that it is possible to form the structures (S2834: YES), the structure-characteristic derivation unit 303 in S2835 derives structure inclination angles θ from the inclined-surface area s3 (S2832) and the result of the reference to the structure characteristic table 2702 (S2833). In this embodiment, the structure-characteristic derivation unit 303 derives values of 75.0 degrees, 45.0 degrees, and 15.0 degrees associated with a structure inclined-surface area s3 of A μm^2 in the structure characteristic table 2702. The structure inclination angles θ derived in S2835 are allocated to the blocks in the structure arrangement data in accordance with proportions set in a structure number table 2703. The subsequent processes are the same as the processes in Embodiment 1, and description thereof will therefore be omitted.

Figure 33:
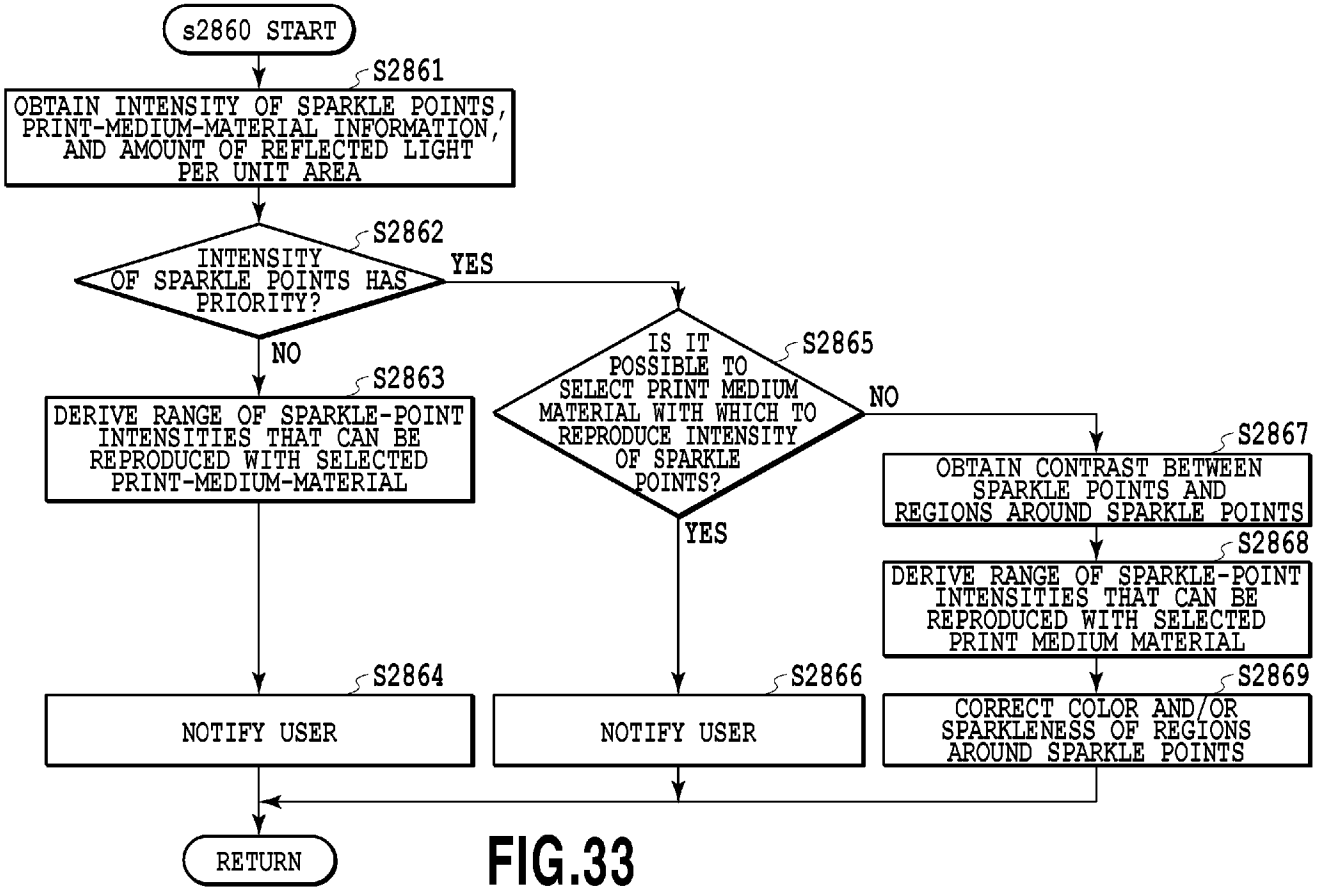
FIG. 33 is a flowchart showing the procedure of a process of changing an output condition in Embodiment 8.

If it is determined that it is impossible to form the structures (S2834: NO), the output-condition change unit 2704 prompts the user to input an output condition for controlling the appearance of sparkle points or changes such an output condition. FIG. 33 is a flowchart showing the procedure of the process by the output-condition change unit 2704 in this embodiment. Details of the procedure of the process by the output-condition change unit 2704 in this embodiment will be described below with reference to FIG. 33.

In S2861, the output-condition change unit 2704 obtains the sparkle point intensity (S2820), the print medium information (S2820), and the amount of reflected light per unit area (S2831).

In S2862, the output-condition change unit 2704 determines the type of sparkle point information to be preferentially used in deriving the characteristics of the structures, from the type of sparkle point information obtained in S2820. In this embodiment, the output-condition change unit 2704 determines the type of sparkle point information to be preferentially used out of the sparkle point intensity and the sparkle point area. The method described above in Embodiment 4 can be used in the sub-process in S2862.

If determining that the sparkle point intensity does not have priority, that is, if using the selected type of print medium material has priority (S2862: NO), the output-condition change unit 2704 in S2863 derives the range of sparkle point intensities that can be reproduced with the selected print medium material. The range of sparkle point intensities can be figured out from the range between the amount of reflected light emitted from the inclined-surface area s3 of the smallest structure (S2834) and the amount of reflected light emitted from the inclined-surface area s3 of the largest structure (S2834).

In S2864, the output-condition change unit 2704 notifies the user of the result derived in S2863 by means of the display 25 or the like through the UI display unit 301. In this embodiment, after S2864, the subsequent processes (S2840, S2850) are skipped, and the procedure in FIG. 28A is restarted. In S2810 in the restarted procedure, too, the result derived in S2863 is displayed on the display 25 or the like through the UI display unit 301. By doing so, it is possible to prompt the user to input a sparkle point intensity that can be reproduced with the selected print medium material.

On the other hand, if determining that the sparkle point intensity has priority (S2862: YES), the output-condition change unit 2704 determines in S2865 whether or not it is possible to select a print medium with which to reproduce the sparkle point intensity.

If it is possible to select a print medium (S2865: YES), the output-condition change unit 2704 proceeds to S2866, in which it notifies the user of the result of S2865 and selectable types of print medium materials by means of the display 25 or the like through the UI display unit 301. In this embodiment, after S2866, the subsequent processes (S2840, S2850) are skipped, and the procedure in FIG. 28A is restarted. In S2810 in the restarted procedure, too, the selectable types of print medium materials are displayed on the display 25 or the like through the UI display unit 301. By doing so, it is possible to prompt the user to perform input operation to specify a print medium.

If it is impossible to select a print medium (S2865: NO), the output-condition change unit 2704 proceeds to S2867. In S2867, from the reference images received in S2810, the output-condition change unit 2704 figures out the ratio (contrast) between the intensity of the sparkle points and the intensity of the reflected light at the regions around the sparkle points.

In S2868, the output-condition change unit 2704 derives the range of sparkle point intensities that can be reproduced with the selected print medium material. The range of sparkle point intensities can be figured out from the range between the amount of reflected light emitted from the inclined-surface area s3 of the smallest structure (S2834) and the amount of reflected light emitted from the inclined-surface area s3 of the largest structure (S2834).

In S2869, the output-condition change unit 2704 corrects the color and/or brightness at the regions around the structures to be formed on the print medium 1208, based on the ratio (contrast) figured out in S2867. Specifically, using the upper- or lower-limit sparkle point intensity in the range of sparkle point intensities figured out in S2868 as a reference, the output-condition change unit 2704 applies the ratio (contrast) figured out in S2867 to the regions around the structures for expressing sparkle points. Note that a correction method widely known in the field of image processing is applicable to the correction of the color and/or brightness mentioned above. Meanwhile, as described in Embodiment 1, the printing device 24 in this embodiment forms structures by laminating a transparent UV curable ink onto a print medium. For this reason, the output-condition change unit 2704 can perform the above correction process on a color image formed under the structures by the method in Embodiment 6. After S2860, the structure-characteristic derivation unit 303 proceeds to S2835, in which it derives the structure inclination angles θ corresponding to the inclined-surface area s3, based on the upper- or lower-limit sparkle point intensity obtained in S2869.

Figure 34:
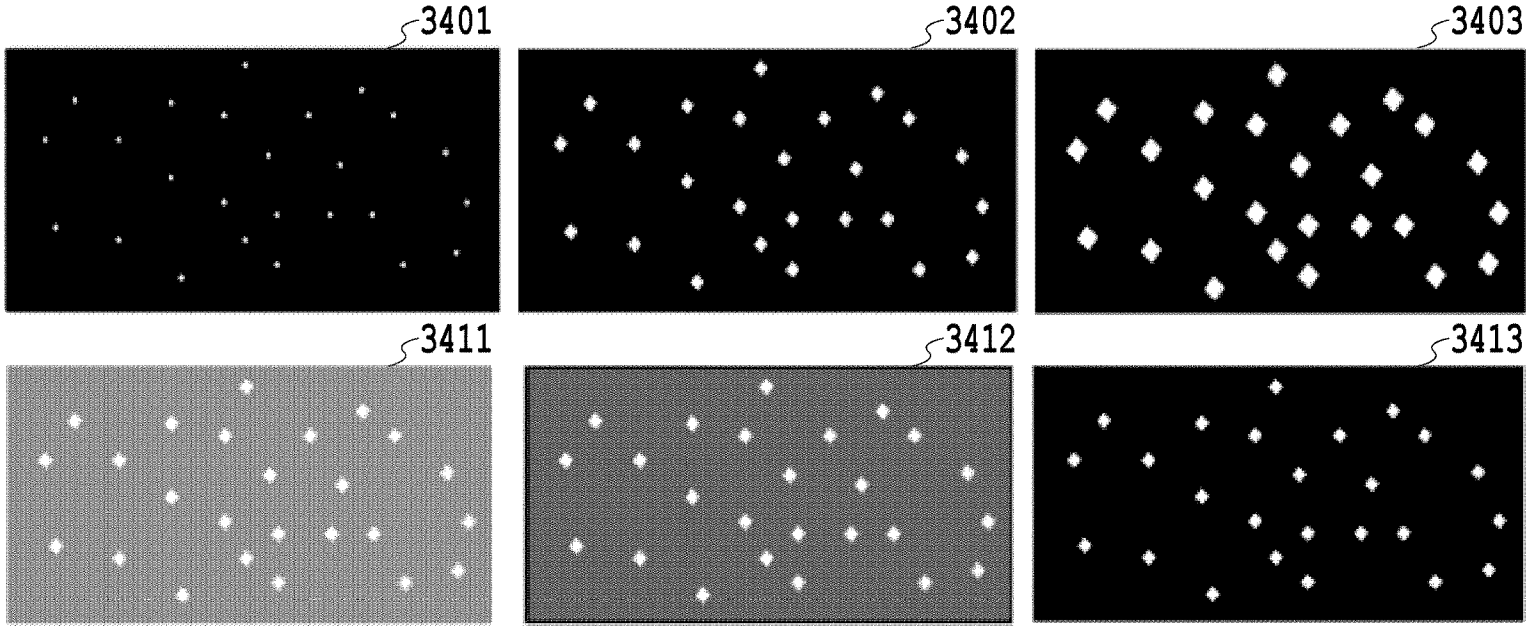
FIG. 34 is a diagram showing an example of output samples in Embodiment 8.

FIG. 34 is a diagram showing output samples 3401 to 3413 from the printing device 24. The output samples 3401 to 3403 show the correlation between change in inclined-surface area s3 and change in appearance of sparkle points. As shown in FIG. 34, the larger the inclined-surface area s3, the higher the intensity of the sparkle points reproduced, if the type of print medium material is the same.

Further, the output samples 3411 to 3413 show the correlation between change in color and/or brightness of the regions around the sparkle points and change in appearance of the sparkle points. As shown in FIG. 34, the darker the regions around the sparkle points, the higher the intensity of the sparkle points reproduced, if the inclined-surface area s3 is the same.

As described above, the image processing apparatus 1 in this embodiment can derive the characteristics of the structures to be formed on the print medium (the inclined-surface area and plurality of inclination angles of the structures) by the process in S2830 in FIG. 28A. Further, the image processing apparatus 1 in this embodiment can reproduce the sparkle point intensity not only by changing the structure inclined-surface area s3 but also by prompting the user to change the sparkle point intensity or the type of print medium material. Furthermore, the image processing apparatus 1 in this embodiment can reproduce the sparkle point intensity by adjusting the contrast of color and/or brightness.

Embodiment 9

In the foregoing embodiments, structures for expressing the sense of sparkle are formed based on the size of sparkle points or the angular conditions for observing the sparkle points. However, the foregoing embodiments do not taken into consideration the relation between the direction in which the inclined surfaces of the structures emits reflected light and the observation direction in which the observer observes the structures. For this reason, the observer might not be able to experience the sense of sparkle if changing the direction of observation of the structures. In this embodiment, description will be given of an approach in which the structures are arranged with the direction of observation of the structures taken into consideration. In the following, description will be simplified or omitted for parts that are common to Embodiments 1 to 8 above, and features unique to this embodiment will be mainly described.

Figure 35:
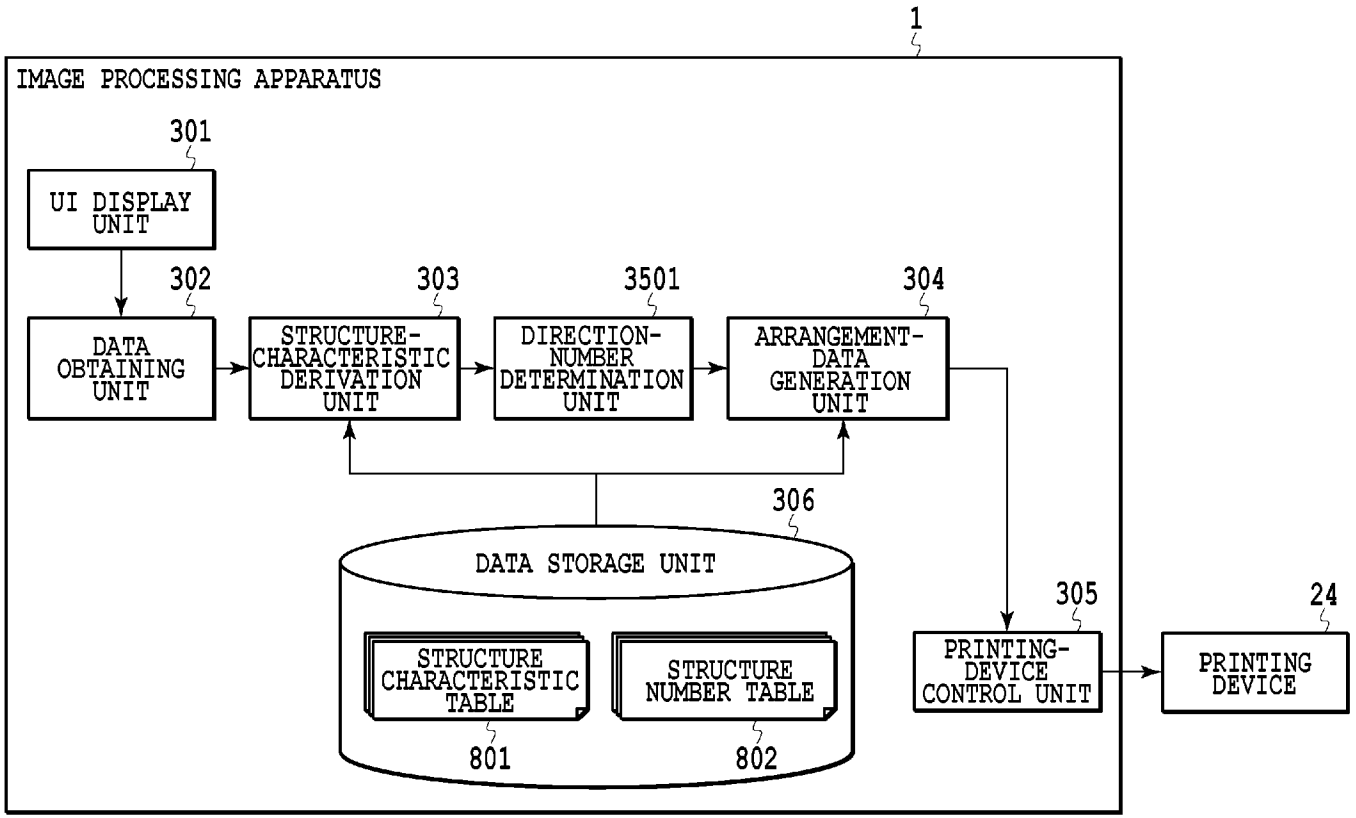
FIG. 35 is a block diagram showing the software function configuration of an image processing apparatus in Embodiment 9.

FIG. 35 is a block diagram showing the software function configuration of an image processing apparatus 1 in this embodiment. The difference from the software function configuration of the image processing apparatus 1 in Embodiment 1 is the configuration of a direction-number determination unit 3501. The direction-number determination unit 3501 is configured to determine the number of reproducible directions based on one of characteristics of the structures.

(Operation of Image Processing Apparatus)

Figure 36A:
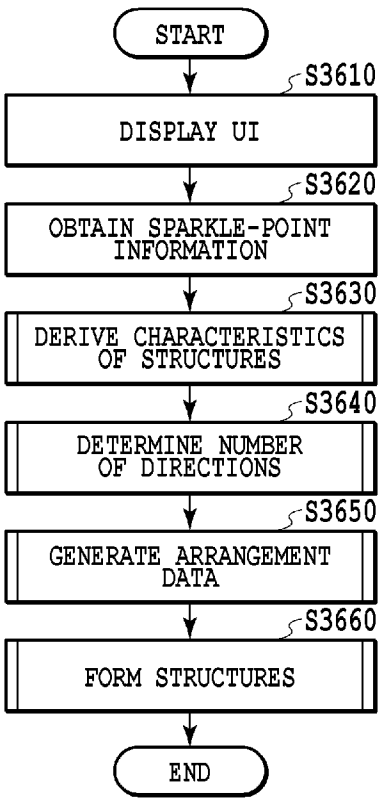
FIG. 36A is a flowchart showing the procedure of processes by the image processing apparatus in Embodiment 9.

FIG. 36A is a flowchart showing the procedure of processes by the image processing apparatus 1 in this embodiment. Details of the procedure of the processes by the image processing apparatus 1 in this embodiment will be described below with reference to FIG. 36A. Processes in S3610 to S3630 are the same as the processes in S10 to S30 in Embodiment 1, and description thereof will therefore be omitted. In S3640, based on one of the characteristics of the structures derived in S3630, the direction-number determination unit 3501 determines the number of directions in which the structures can be formed, by a process to be described later. In S3650, an arrangement-data generation unit 304 generates data on the arrangement of the structures to be formed on a print medium, in accordance with the characteristics of the structures derived in S3630 and the number of structure directions determined in S3640. The process of generating the structure arrangement data will be described later. In S3660, a printing-device control unit 305 determines the number of laminations at each coordinate based on the structure arrangement data generated in S3650, sends that information to a printing device 24, and instructs the printing device 24 to perform image forming operation.

(Content of Control of Direction-Number Determination Unit)

Figure 36B:
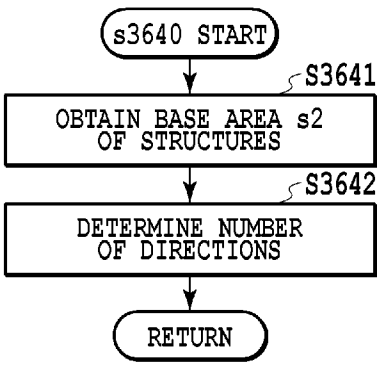
FIG. 36B is a flowchart showing the procedure of a process of determining the number of directions in Embodiment 9.

FIG. 36B is a flowchart showing the procedure of the process by the direction-number determination unit 3501 in this embodiment. Details of the procedure of the process by the direction-number determination unit 3501 in this embodiment will be described below with reference to FIG. 36B. In S3641, the direction-number determination unit 3501 obtains structure base area s2, which is one of the characteristics of the structures derived in S3630. In S3642, the direction-number determination unit 3501 determines the number of directions in which the structures can be formed on a print medium 1208, from the structure base area s2 obtained in S3641. In this embodiment, an example is shown in which the number of directions is determined using the following calculation formula. Note that in Formula 5 below, W denotes the number of directions, and Ndot denotes the number of dots on one side of the base of a structure.

[Math. 1]

$$W=8\times(N_{dot}-1) \tag{5}$$

Figure 37:
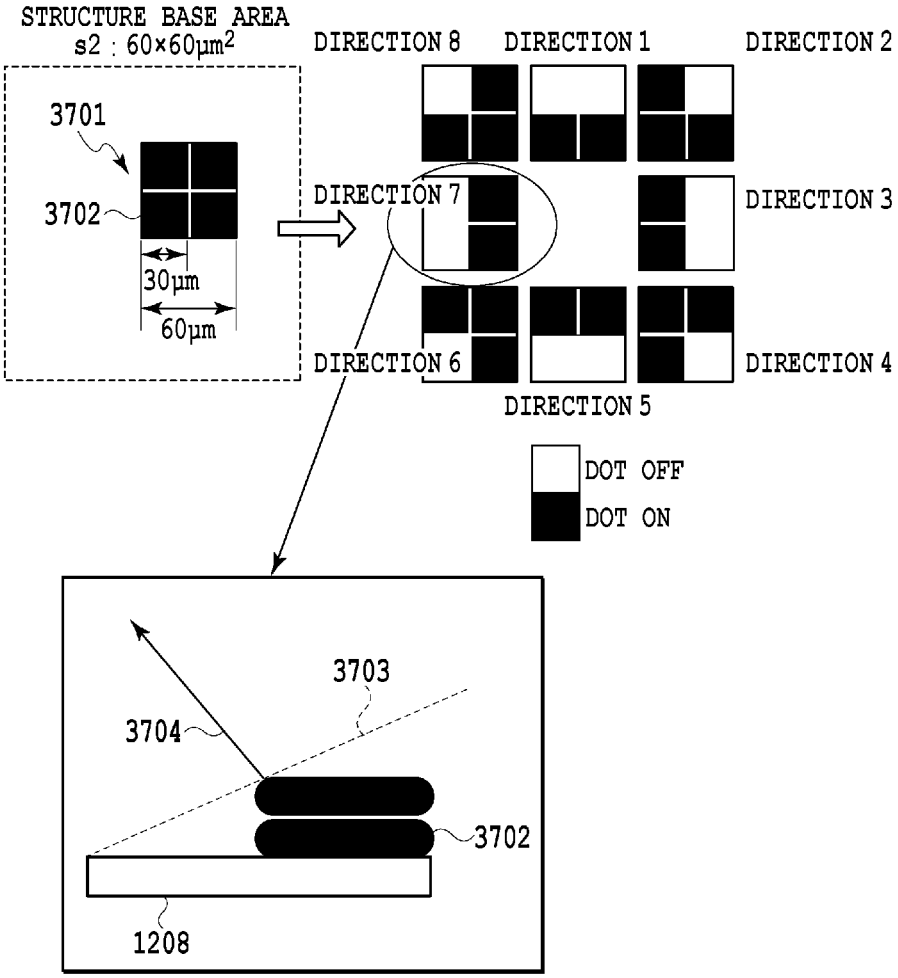
FIG. 37 is a diagram illustrating a method of determining the number of directions in Embodiment 9.

Now, a method of determining the number of directions in this embodiment will be described with reference to FIG. 37. FIG. 37 shows an example where the number of structure directions is determined from a group 3701 of ink dots that has a base area s2 of 60×60 μm^2. The base area s2 in this embodiment is defined by a cluster of ink dots 3702. The length of one side of the cluster is approximately 60 μm, and the length of each single dot is 30 μm. In this case, the number of dots on one side of the base of a structure is "2," and the number of directions is calculated to be "8" from Formula 5 above. By causing the printing device 24 to selectively eject ink dots, the image processing apparatus 1 in this embodiment can form structures each including an inclined surface 3703 in one of directions 1 to 8. Light applied to such a structure is emitted as reflected light from the inclined surface 3703 in a reflection direction 3704.

(Content of Control of Arrangement-Data Generation Unit)

Figure 36C:
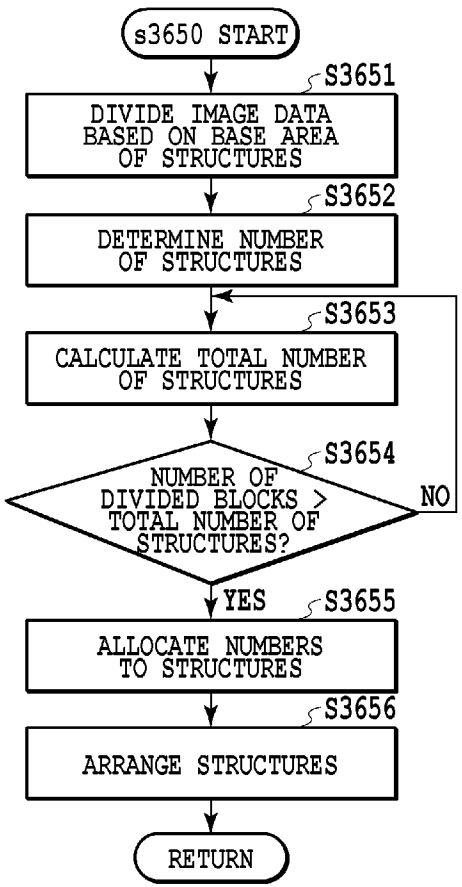
FIG. 36C is a flowchart showing the procedure of a process of generating arrangement data in Embodiment 9.

FIG. 36C is a flowchart showing the procedure of the process by the arrangement-data generation unit 304 in this embodiment. Details of the procedure of the process by the arrangement-data generation unit 304 in this embodiment will be described below with reference to FIG. 36C. Subprocesses in S3651 and S3652 are the same as the subprocesses in S41 and S42 in Embodiment 1, and description thereof will therefore be omitted. In S3653, the arrangement-data generation unit 304 calculates the total number of structures. In this embodiment, an example is shown in which the following calculation formula is used to calculate the total number of structures. Note that, in Formula 6 below, Nsum denotes the total number of structures, Nθn denotes the number of structures with an inclination angle θn, and W denotes the number of directions.

[Math. 2]

$$N_{sum}=\sum_{n=1}^{m} N_{\theta n}\times W \tag{6}$$

In S3654, the arrangement-data generation unit 304 compares the total number of rectangular blocks in the image data generated in S3651 and the total number of structures calculated in S3653. If the total number of rectangular blocks is smaller (S3654: NO), the arrangement-data generation unit 304 changes Nθn by using Formula 7 below and returns to S3653.

[Math. 3]

$$N_{\theta n}=N_{\theta n}\times 1/2 \quad (7)$$

On the other hand, if the total number of rectangular blocks is larger (S3654: YES), the arrangement-data generation unit 304 allocates numbers to all the structures whose total number is calculated in S3653.

FIG. 38A is a diagram schematically showing a list of numbers allocated to the structures. In FIG. 38A, D denotes an inclination angle, Nθn denotes the number of structures associated with the inclination angle θn, and W denotes the number of directions. As shown in FIG. 38A, successive numbers are allocated to the structures across the plurality of directions, such as the direction 1, direction 2, . . . , and direction W.

FIG. 38B is a diagram showing a specific example of numbers allocated to structures that are associated with inclination angles of 0 degree, 14.0 degrees, 26.6 degrees, 36.9 degrees, and 45 degrees and are to be formed in each of the directions 1 to 8. Successive numbers 1 to 25 are allocated to the structures to be formed in the direction 1. Then, successive numbers 26 to 50 are allocated to the structures to be formed in the direction 2. Subsequently, successive numbers are likewise allocated to the structures to be formed in the direction 3, . . . , and the direction W. As a result, the structures are given their own unique numbers.

In S3655, the arrangement-data generation unit 304 allocates the structures to rectangular blocks i in the image data divided in S3651, by using a mask pattern defining the arrangement of the structures. On the mask pattern in this embodiment, numbers are given in advance in accordance with how the structures are to be arranged. The arrangement-data generation unit 304 can allocate the structures to the rectangular blocks i based on which numbers allocated to the structures match which numbers given to the mask pattern.

Figure 39:
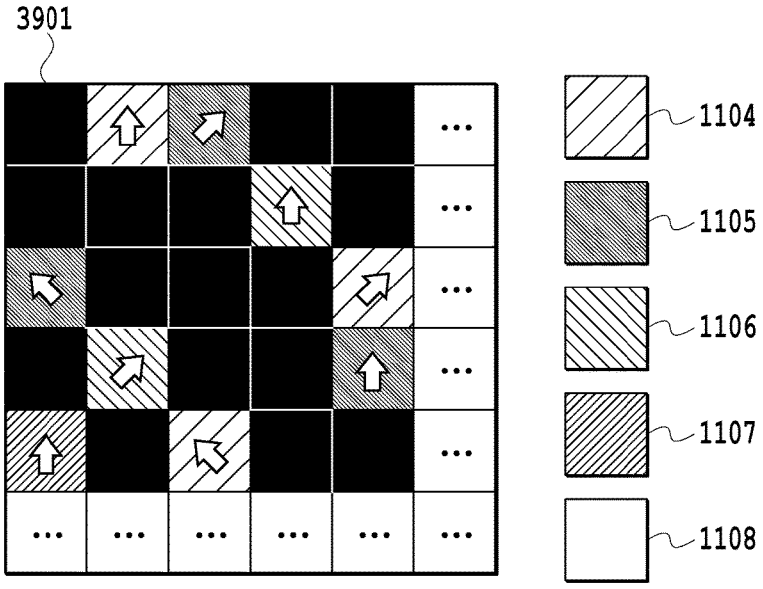
FIG. 39 is a schematic diagram of structure arrangement data specifying the arrangement and directions of structures in Embodiment 9.

FIG. 39 is a schematic diagram showing part of image data 3901 generated by the arrangement-data generation unit 304 in S3655. As in FIG. 11A, 11B in Embodiment 1, in the image data 3901, five types of structures associated with different inclination angles of 0 degree, 14.0 degrees, 26.6 degrees, 36.9 degrees, and 45 degrees are arranged in blocks 1104 to 1108, respectively. Further, in this embodiment, the structures arranged in the blocks are each associated with a direction. In FIG. 39, the arrows show the directions of the structures. As shown in FIG. 39, it can be seen that, in each direction, structures associated with different inclination angles are arranged in the blocks 1104 to 1108.

As described above, the image processing apparatus 1 in this embodiment figures out the directions of the structures in accordance with one of the characteristics of the structures and allocates the structures which are associated with a plurality of inclination angles for each direction. With this configuration, the image processing apparatus 1 in this embodiment can reproduce the sense of sparkle even if the observation direction changes. In this embodiment, the description has been given of the example where the maximum number of directions is figured out in accordance with one of the characteristics of the structures. However, as a modification, the image processing apparatus 1 may display a UI on a display 25 and receive specified directions through the UI. Further, the image processing apparatus 1 may receive a specified number of sparkle points to be reproduced, i.e., a specified number of structures for each inclination angle, through the UI.

Embodiment 10

In Embodiment 9 above, the description has been given of the example where the directions of the structures are figured out in accordance with one of the characteristics of the structures, and structures associated with a plurality of inclination angles are allocated for each direction. Here, the structures are allocated evenly among the directions in Embodiment 9. Thus, if the numbers of directions and inclination angles increase, some structures necessary for reproducing the sense of sparkle cannot be allocated on a print medium in some cases. In view of this, in this embodiment, description will be given of an example where the structures necessary for reproducing the sense of sparkle can be allocated even if the numbers of directions and inclination angles increase. In the following, description will be simplified or omitted for parts that are common to Embodiments 1 to 9 above, and features unique to this embodiment will be mainly described.

Figure 40:
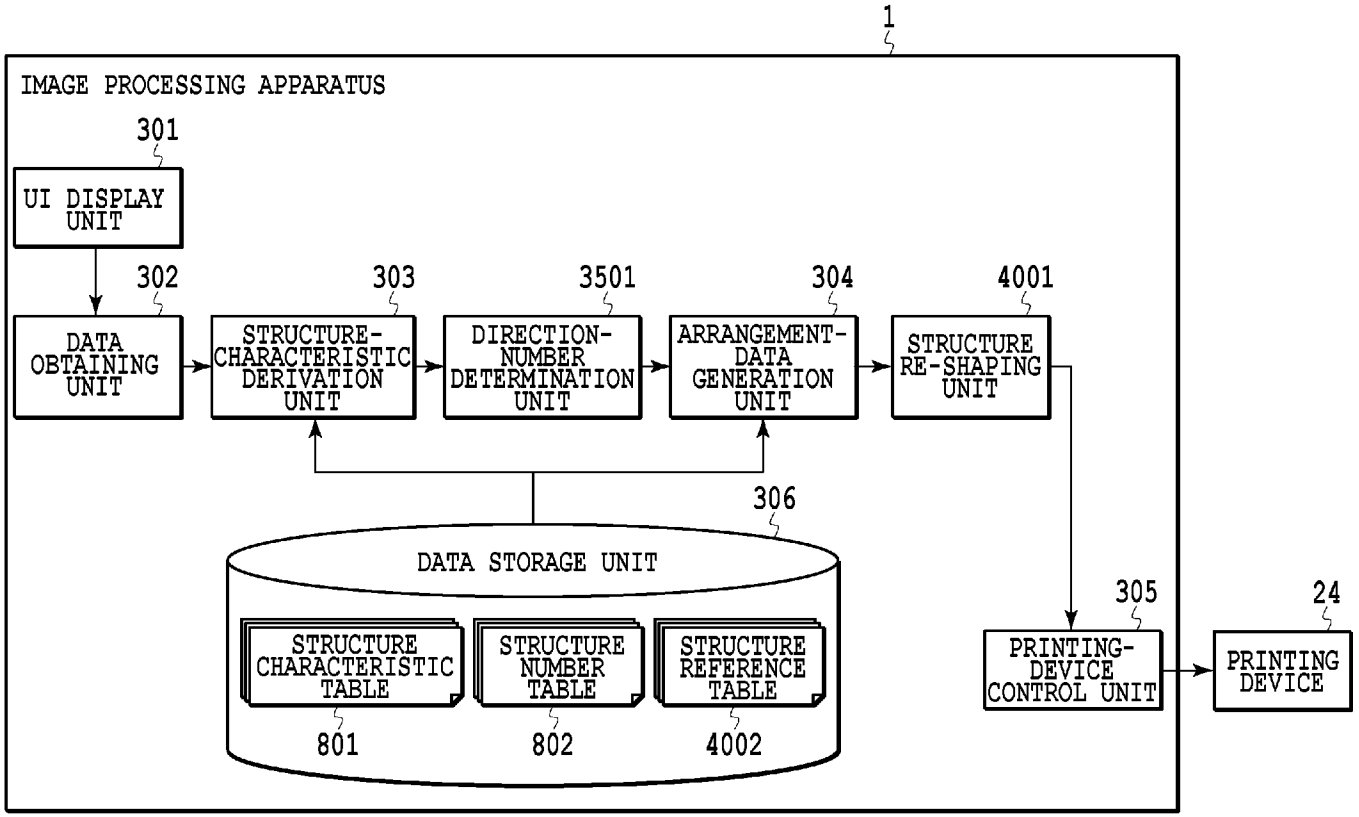
FIG. 40 is a block diagram showing the software function configuration of an image processing apparatus in Embodiment 10.

FIG. 40 is a block diagram showing the software function configuration of an image processing apparatus 1 in this embodiment. The differences from the software function configuration of the image processing apparatus 1 in Embodiment 9 are the configurations of a structure re-shaping unit 4001 and a structure reference table 4002. The structure re-shaping unit 4001 is configured to re-shape a structure at the i-th rectangular block in a case where a plurality of directions are allocated to the i-th rectangular block. In the structure reference table 4002, which is stored in a data storage unit 306, combinations of directions allocated by an arrangement-data generation unit 304 and structure shapes are associated with each other.

(Operation of Arrangement-Data Generation Unit)

Figure 41:
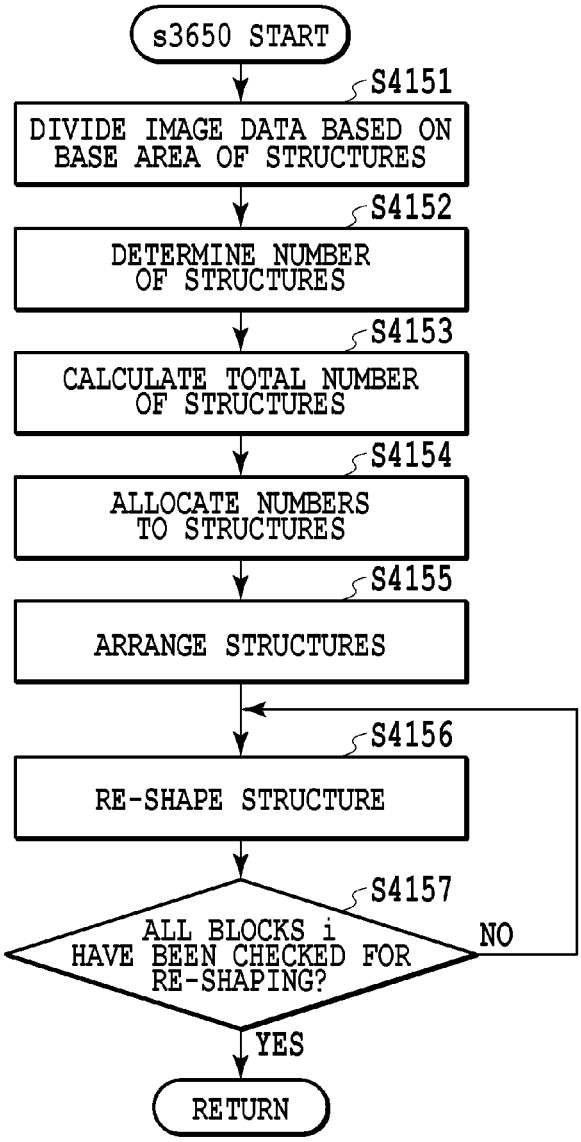
FIG. 41 is a flowchart showing the procedure of a process of generating arrangement data in Embodiment 10.

FIG. 41 is a flowchart showing the procedure of a process by the arrangement-data generation unit 304 in this embodiment. Details of the procedure of the process by the arrangement-data generation unit 304 in this embodiment will be described below with reference to FIG. 41. Note that the process in the flowchart in FIG. 41 corresponds to the process in the sub-flowchart in S3650 in Embodiment 9. Moreover, sub-processes in S4151 to S4153 are the same as the sub-processes in S3651 to S3653 in Embodiment 9, and description thereof will therefore be omitted.

In S4154, the arrangement-data generation unit 304 allocates numbers to all the structures whose total number is calculated in S4152. FIG. 42A is a diagram schematically showing a list of numbers allocated to the structures. In FIG. 42A, D denotes an inclination angle, Nθn denotes the number of structures associated with an inclination angle θn, and W denotes the number of directions.

FIG. 42B is a diagram showing a specific example of numbers allocated to structures that are associated with inclination angles of 0 degree, 14.0 degrees, 26.6 degrees, 36.9 degrees, and 45 degrees and are to be formed in each of directions 1 to 8. Successive numbers 1 to 25 are allocated to the structures to be formed in the direction 1. Subsequently, successive numbers 1 to 25 are likewise allocated to the structures to be formed in the direction 2, . . . , and the direction W. Thus, in this embodiment, unlike Embodiment 9, common numbers are allocated to the structures to be formed in the direction 1, the direction 2, . . . , and the direction W.

In S4155, the arrangement-data generation unit 304 allocates the structures to the rectangular blocks i in the image data divided in S4151, by using mask patterns defining the arrangement of the structures. On the mask patterns in this embodiment, numbers are given in advance in accordance with how the structures are to be arranged. The arrangement-data generation unit 304 allocates the structures to the rectangular blocks i based on which numbers allocated to the structures match which numbers given to the mask patterns. Note that, unlike Embodiment 9 above, this embodiment uses mask patterns defining the arrangement of the structures differently for each of the directions 1 to 8.

In S4156, the structure re-shaping unit 4001 re-shapes the structure at the i-th rectangular block in a case where a plurality of directions are allocated to the i-th rectangular block. FIG. 43 shows an example of the structure reference table 4002 in this embodiment. In the structure reference table 4002 in this embodiment, which is stored in the data storage unit 306, the combinations of the directions allocated by the arrangement-data generation unit 304 and structure shapes are associated with each other. As described with reference to FIG. 37, the image processing apparatus 1 can form a structure in a given direction (s) by selectively arranging the ink dots in each layer forming the structure. The structure re-shaping unit 4001 in this embodiment searches the image data generated in S4155 and changes the dot arrangement at the i-th rectangular block in a case where a plurality of directions are allocated to the i-th rectangular block. In the structure reference table 4002, "○" indicates that the direction is allocated, and "×" indicates that the direction is not allocated. As shown in FIG. 43, it can be seen that the direction 1 and the direction 2 are allocated to the i-th rectangular block, and the dot arrangement at the i-th rectangular block are changed. Meanwhile, in the example described and shown in FIG. 37, the base area s2 is 60×60 μm^2, and the number of dots on one side of the base of a structure is "2." However, the number of dots is not limited to this value. In the example described in this embodiment, the number of dots on one side is "4" for the sake of description.

Figure 44:
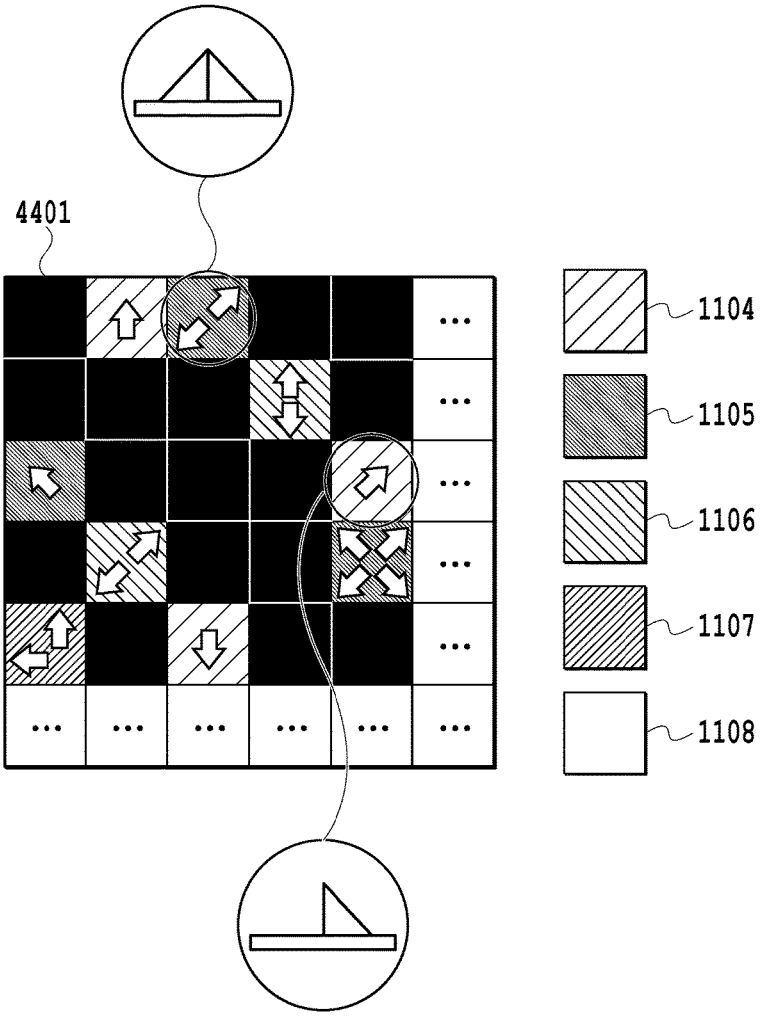
FIG. 44 is a schematic view of structure arrangement data specifying the arrangement and directions of structures in Embodiment 10.

FIG. 44 is a schematic diagram showing part of image data 4401 after the re-shaping by the structure re-shaping unit 4001 in S4156. As in FIG. 11A, 11B in Embodiment 1, in the image data 4401, five types of structures associated with different inclination angles of 0 degree, 14.0 degrees, 26.6 degrees, 36.9 degrees, and 45 degrees are arranged in blocks 1104 to 1108, respectively. Further, in this embodiment, the structures arranged in the blocks are each associated with a direction (s) in which reflected light is emitted from the inclined surface (s) of the structure. In FIG. 44, the arrows show the directions of the structures. In a case where a plurality of directions are allocated to the i-th rectangular block, the dot arrangement at the i-th rectangular block is changed. Thus, a plurality of structures differing in direction are combined. As shown in FIG. 44, it can be seen that a structure including a single inclined surface is formed at the i-th rectangular block in a case where only a single direction is allocated thereto, whereas structures including inclined surfaces facing in mutually different directions are combined at the i-th rectangular block in a case where a plurality of directions are allocated thereto.

In S4157, the structure re-shaping unit 4001 determines whether or not all the rectangular blocks in the image data have been checked for the re-shaping. If not all the rectangular blocks have been checked for the re-shaping (S4157: NO), the structure re-shaping unit 4001 adds 1 to i and returns to S4156. If all the rectangular blocks in the image data have been checked for the re-shaping (S4157: YES), the structure re-shaping unit 4001 terminates the process in this flowchart.

As described above, the image processing apparatus 1 in this embodiment allocates structures to rectangular blocks by using different mask patterns for different directions. In a case where a plurality of directions are allocated to a rectangular block, structures including inclined surfaces in the plurality of directions are combined. With this configuration, the image processing apparatus 1 in this embodiment can allocate structures necessary for reproducing the sense of sparkle into structure arrangement data even if the numbers of directions and inclination angles increase.

[Modifications]

In the methods described in the foregoing embodiments, structures are formed by laminating a UV curable ink. However, the method of forming structures is not limited to this method. For example, it is also possible to form structures by a nanoimprint technique in which a template having a shape corresponding to the structures are pressed against a print medium to form the structures. Also, in the foregoing embodiments, structures are formed such that the area of sparkle points remains the same irrespective of the illumination angle when the image printed on a printing material is observed from a normal direction. However, the structures to be formed are not limited to those. For example, it is also possible to employ an approach focusing on the inclined-surface areas of structures instead of the base area thereof such that structures having the same inclined-surface area or a predetermined range of inclined-surface areas are formed. Also, in the methods described in the foregoing embodiments, the direction of specularly reflected light from the interface of a structure is controlled. However, it is also possible to use a method in which a structure controls the direction of specularly reflected light from the surface of the print medium. For example, it is conceivable to employ an approach in which the direction of specularly reflected light from the surface of the print medium is refracted at the interface of a structure made of a clear ink with small absorption and scattering coefficients, to thereby control the direction of the specularly reflected light. Also, instead of the image processing apparatus 1, an engine embedded in the printing device 24 may perform some or all processes described in the foregoing embodiments.

Other Embodiments

Embodiment (s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment (s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

According to the present invention, it is possible to provide an image processing apparatus, an image processing method, and a non-transitory computer readable storage medium storing a program capable of forming structures for artificially expressing the sense of sparkle.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-104459, filed May 22, 2015, and Patent Application No. 2016-088486, filed Apr. 26, 2016, which are hereby incorporated by reference wherein in its entirety.

The invention claimed is:

1. An image processing apparatus for forming structures on a print medium, the structures being configured to express such a characteristic that sparkle points change in position with change in angle of observation, the image processing apparatus comprising:

a generation unit configured to generate arrangement data based on information on a characteristic of sparkle points, the arrangement data specifying arrangement of the structures of two or more types that are capable of being formed on the print medium and at least include one or more first structures associated with a first inclination angle and one or more second structures associated with a second inclination angle different from the first inclination angle.

2. The image processing apparatus according to claim 1, wherein the information indicates at least one of size, number, and intensity of the sparkle points.

3. The image processing apparatus according to claim 1, wherein the generation unit generates the arrangement data specifying arrangement in which the first structures and the second structures are arranged to be distributed within a predetermined region respectively.

4. The image processing apparatus according to claim 1, wherein the structures are formed by laminating dots of a printing material, and the generation unit generates the arrangement data specifying arrangement in which the first structures and the second structures are arranged such that a difference in number of dots between layers forming each first structure and a difference in number of dots between layers forming each second structure are different from each other.

5. The image processing apparatus according to claim 1, wherein the information includes first information indicating the number of sparkle points observed from a first angle, and second information indicating the number of sparkle points observed from a second angle different from the first angle, and the generation unit determines the number of the first structures, which correspond to the first angle, based on the first information, and determines the number of the second structures, which correspond to the second angle, based on the second information.

6. The image processing apparatus according to claim 1, wherein the generation unit determines area of bases of the first structures and the second structures based on the information, and generates the arrangement data specifying arrangement in which the first structures and the second structures, whose area of bases have the same size, are arranged in predetermined respective proportions.

7. The image processing apparatus according to claim 6, wherein based on the area of the bases, the generation unit determines a plurality of directions in which inclined surfaces of the first structures and the second structures are to face, and the generation unit generates the arrangement data specifying arrangement of the first structures and the second structures, each of which is associated with at least one of the plurality of directions.

8. The image processing apparatus according to claim 7, further comprising a re-shaping unit configured to re-shape the structures associated with two or more of the directions, in accordance with the combination of the directions.

9. The image processing apparatus according to claim 8, wherein the structures are formed by laminating dots of a printing material, and the re-shaping unit re-shapes the first structure and the second structure by changing arrangement of dots in layers forming the first structures and the second structures.

10. The image processing apparatus according to claim 1, wherein the generation unit determines area of inclined surfaces of the first structures and the second structures based on the information, and generates the arrangement data specifying arrangement in which the first structures and the second structures, whose area of inclined surfaces have the same size, are arranged in predetermined respective proportions.

11. The image processing apparatus according to claim 10, wherein the area of the inclined surfaces is determined in accordance with an amount of reflected light per unit area on the print medium, on which the structures are to be formed.

12. The image processing apparatus according to claim 10, wherein the information is intensity of the sparkle points, and the image processing apparatus further comprises a display unit configured to display a UI of a prompt for input of a value of sparkle point intensity different from the intensity of the sparkle points, in a case where it is impossible to form the structures with the inclined surfaces that emit reflected light corresponding to the intensity of the sparkle points.

13. The image processing apparatus according to claim 10, wherein the information is intensity of the sparkle points, and the image processing apparatus further comprises a display unit configured to display a UI of a prompt for input to specify a type of print medium material different from the print medium, in a case where it is impossible to form the structures with the inclined surfaces that emit reflected light corresponding to the intensity of the sparkle points.

14. The image processing apparatus according to claim 10, wherein the information is intensity of the sparkle points, and the image processing apparatus further comprises a correction unit configured to correct contrast of at least one of color and brightness between the structures and regions around the structures in a case where it is impossible to form the structures with the inclined surfaces that emit reflected light corresponding to the intensity of the sparkle points.

15. The image processing apparatus according to claim 1, further comprising:

an obtaining unit configured to obtain a plurality of types of the information on a plurality of the characteristics of the sparkle points; and a priority determination unit configured to determine which one of the plurality of types of information obtained has priority.

16. The image processing apparatus according to claim 1, further comprising an extraction unit configured to extract the information from an image.

17. The image processing apparatus according to claim 16, wherein the extraction unit generates a binary image by binarizing the image, and extracts the information from a region having a predetermined pixel value in the binary image.

18. The image processing apparatus according to claim 1, further comprising a selection receiving unit configured to receive a mode selected from a plurality of modes, wherein based on the information, the generation unit determines at least one of area of bases of the structures, area of inclined surfaces of the structures, degree of variance of inclination angles associated with the structures, and range of the inclination angles associated with the structures, each of which changes depending on the mode selected.

19. The image processing apparatus according to claim 1, further comprising a formation control unit configured to perform control based on the arrangement data to form the structures on the print medium.

20. The image processing apparatus according to claim 19, wherein the formation control unit performs control to form the structures by using a transparent printing material.

21. The image processing apparatus according to claim 19, wherein the formation control unit performs control to form a color image on the print medium and further form the structures on top of the formed color image.

22. The image processing apparatus according to claim 19, wherein the formation control unit further performs control to apply a metallic ink to the structures, the metallic ink containing a sparkly material.

23. The image processing apparatus according to claim 19, wherein the formation control unit further performs control to apply a UV curable ink to the structures, the UV curable ink having high wettability.

24. An image processing method of forming structures on a print medium, the structures being configured to express such a characteristic that sparkle points change in position with change in angle of observation, the image processing method comprising a step of:

generating arrangement data based on information on a characteristic of sparkle points, the arrangement data specifying arrangement of the structures of two or more types that are capable of being formed on the print medium and at least include one or more first structures associated with a first inclination angle and one or more second structures associated with a second inclination angle different from the first inclination angle.

25. A non-transitory computer readable storage medium storing a program for causing a computer to function as an image processing apparatus for forming structures on a print medium, the structures being configured to express such a characteristic that sparkle points change in position with change in angle of observation, wherein the image processing apparatus comprises:

a generation unit configured to generate arrangement data based on information on a characteristic of sparkle points, the arrangement data specifying arrangement of the structures of two or more types that are capable of being formed on the print medium and at least include one or more first structures associated with a first inclination angle and one or more second structures associated with a second inclination angle different from the first inclination angle.

* * * * *